US006582894B1

(12) United States Patent
Hioki et al.

(10) Patent No.: US 6,582,894 B1
(45) Date of Patent: Jun. 24, 2003

(54) SILVER HAIDE PHOTOGRAPHIC EMULSION AND PHOTOGRAPHIC LIGHT-SENSITIVE MATERIAL USING SAME

(75) Inventors: Takanori Hioki, Kanagawa (JP); Katsuhiro Yamashita, Kanagawa (JP); Katsumi Kobayashi, Kanagawa (JP); Takashi Katoh, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/523,582

(22) Filed: Mar. 10, 2000

(30) Foreign Application Priority Data

| | | |
|---|---|---|
| Mar. 12, 1999 | (JP) | 11-066900 |
| Jun. 17, 1999 | (JP) | 11-171324 |
| Jul. 8, 1999 | (JP) | 11-194714 |
| Dec. 21, 1999 | (JP) | 11-363272 |

(51) Int. Cl.[7] ..... G03C 1/005; G03C 1/08

(52) U.S. Cl. ..... 430/572; 430/574; 430/577; 430/578; 430/581; 430/582; 430/583; 430/584; 430/585; 430/586; 430/587; 430/588; 430/589; 430/590; 430/603

(58) Field of Search ..... 430/505, 503, 430/572, 573, 574, 577, 578, 581, 582, 583, 584, 585–592, 603

(56) References Cited

U.S. PATENT DOCUMENTS

| | | | | |
|---|---|---|---|---|
| 5,491,057 A | | 2/1996 | Hioki | |
| 5,609,978 A | | 3/1997 | Giorgianni et al. | |
| 5,919,612 A | * | 7/1999 | Ly et al. | 430/583 |
| 6,040,125 A | | 3/2000 | Siegel et al. | |
| 6,063,557 A | * | 5/2000 | Ly et al. | 430/556 |
| 6,180,332 B1 | * | 1/2001 | Yamashita et al. | 430/574 |

FOREIGN PATENT DOCUMENTS

| | | |
|---|---|---|
| EP | 0 838 719 A2 | 4/1998 |
| EP | 0 866 364 | 9/1998 |

* cited by examiner

*Primary Examiner*—Thorl Chea
(74) *Attorney, Agent, or Firm*—Sughrue Mion, PLLC

(57) ABSTRACT

A silver halide photographic emulsion is disclosed, comprising a silver halide grain having a spectral absorption maximum wavelength of less than 500 nm and a light absorption intensity of 60 or more or having a spectral absorption maximum wavelength of 500 nm or more and a light absorption intensity of 100 or more, wherein assuming that a maximum value of the spectral absorption factor of said emulsion by a sensitizing dye is Amax, the distance between the shortest wavelength showing 80% of Amax and the longest wavelength showing 80% of Amax is 20 nm or more and the distance between the shortest wavelength showing 50% of Amax and the longest wavelength showing 50% of Amax is 120 nm or less.

16 Claims, 2 Drawing Sheets

SILVER HAIDE PHOTOGRAPHIC EMULSION AND PHOTOGRAPHIC LIGHT-SENSITIVE MATERIAL USING SAME

FIELD OF THE INVENTION

The present invention relates to a spectrally sensitized silver halide photographic emulsion and a photographic light-sensitive material using the emulsion.

BACKGROUND OF THE INVENTION

A great deal of effort has heretofore been made for attaining higher sensitivity of silver halide photographic light-sensitive materials. In a silver halide photographic emulsion, a sensitizing dye adsorbed to the surface of a silver halide grain absorbs light entered into a light-sensitive material and transmits the light energy to the silver halide grain, whereby sensitivity can be obtained. Accordingly, in the spectral sensitization of silver halide, it is considered that the light energy transmitted to silver halide can be increased by increasing the light absorption factor per the unit grain surface area of a silver halide grain and thereby the spectral sensitivity can be elevated. The light absorption factor on the surface of a silver halide grain may be improved by increasing the amount of a spectral sensitizing dye adsorbed per the unit grain surface area.

However, the amount of a sensitizing dye adsorbed to the surface of a silver halide grain is limited and the dye chromophore cannot be adsorbed in excess of the single layer saturation adsorption (namely, one layer adsorption). Therefore, individual silver halide grains currently have a low absorption factor in terms of the quantum of incident light in the spectral sensitization region.

To solve these problems, the following methods have been proposed.

In *Photographic Science and Engineering,* Vol. 20, No. 3, page 97 (1976), P. B. Gilman, Jr. et al. disclose a technique where a cationic dye is adsorbed to the first layer and an anionic dye is adsorbed to the second layer using the electrostatic force.

In U.S. Pat. No. 3,622,316, G. B. Bird et al. disclose a technique where a plurality of dyes are adsorbed in multiple layers to silver halide and the Forster-type excitation energy transfer is allowed to contribute to the sensitization.

In JP-A-63-138341 (the term "JP-A" as used herein means an "unexamined published Japanese patent application") and JP-A-64-84244, Sugimoto et al. disclose a technique of performing the spectral sensitization using the energy transfer from a light-emitting dye.

In *Photographic Science and Engineering,* Vol. 27, No. 2, page 59 (1983), R. Steiger et al. disclose a technique of performing the spectral sensitization using the energy transfer from a gelatin-substituted cyanine dye.

In JP-A-61-251842, Ikegawa et al. disclose a technique of performing the spectral sensitization using the energy transfer from a cyclodextrin-substituted dye.

With respect to the so-called linked dye having two separate chromophores which are not conjugated but linked through a covalent bond, examples thereof are described in U.S. Pat. Nos. 2,393,351, 2,425,772, 2,518,732, 2,521,944 and 2,592,196 and European Patent 565,083. However, these are not used for the purpose of improving the light absorption factor. In U.S. Pat. Nos. 3,622,317 and 3,976,493 having an object of improving the light absorption factor, G. B. Bird, A. L. Borror et al. disclose a technique where a linked sensitizing dye molecule having a plurality of cyanine chromophores is adsorbed to increase the light absorption factor and the energy transfer is allowed to contribute to the sensitization. In JP-A-64-91134, Ukai, Okazaki and Sugimoto disclose a technique of bonding at least one substantially non-adsorptive dye such as cyanine dye, merocyanine dye and hemicyanine dye containing at least two sulfo and/or carboxyl groups to a spectral sensitizing dye which can adsorb to silver halide.

In JP-A-6-57235, L. C. Vishwakarma discloses a method of synthesizing a linked dye by a dehydrating condensation reaction of two dyes. Furthermore, in JP-A-6-27578, it is disclosed that the linked dye of monomethinecyanine and pentamethineoxonol has red sensitivity. However, in this case, the light emission of oxonol and the absorption of cyanine do not overlap and the spectral sensitization using the Forster-type excitation energy transfer does not occur, failing in attaining higher sensitivity owing to the light-gathering action of oxonol linked.

In European Patent Publication 887700A1, R. L. Parton et al. disclose a linked dye with a specific linking group.

In U.S. Pat. No. 4,950,587, M. R. Roberts et al. describe spectral sensitization by a cyanine dye polymer.

In this way, a large number of investigations have been made until now for improving the light absorption factor, however, a sufficiently high effect cannot be attained on the improvement of light absorption factor and also a sufficiently high sensitivity cannot be achieved.

Particularly in color light-sensitive materials, the spectral sensitivity must be rendered to fall within an objective wavelength region. The spectral sensitization of a silver halide light-sensitive material usually does not use the absorption of sensitizing dye in the monomer state but uses the J-band formed when the dye is adsorbed to the surface of a silver halide grain. The J-band is very useful for laying the light absorption and the spectral sensitivity in a desired wavelength region because it has absorption acutely shifted to the longer wavelength side than that in the monomer state. In this meaning, even if a sensitizing dye is adsorbed in multiple layers to the grain surface and thereby the light absorption factor can be increased, when the dye indirectly adsorbed to a silver halide grain, namely, dye in the second or subsequent layer is adsorbed in the monomer state, the absorption extends over a very wide range and this is improper as a spectral sensitivity of actual light-sensitive materials.

On the other hand, each color sensitization region has a width of about 100 nm and it is disadvantageous to cause unnecessarily large difference in the sensitivity to light in that range.

Under these circumstances, a technique of adsorbing a sensitizing dye in multiple layers to the surface of a silver halide grain is being demanded, which can satisfy the requirements that the light absorption integrated intensity per the unit grain surface area is increased, the absorption and the spectral sensitivity are limited to a desired color sensitization region, and at the same time the change in the spectral absorption factor and sensitivity with respect to the light in that region is reduced as much as possible.

Furthermore, it has been found that when a sensitizing dye is adsorbed in multiple layers to the grain surface, the amount of gelatin adsorbed decreases, as a result, the protective colloid function is diminished and the grains are readily coagulated in some cases. Accordingly, a technique of adsorbing a sensitizing dye in multiple layers while preventing occurrence of coagulation of grains is being demanded.

SUMMARY OF THE INVENTION

One object of the present invention is to provide a silver halide photographic emulsion prevented from coagulation of grains and having high sensitivity.

Another object of the present invention is to provide a photographic light-sensitive material using the emulsion.

These objects have been attained by the following means.

(1) A silver halide photographic emulsion comprising a silver halide grain having a spectral absorption maximum wavelength of less than 500 nm and a light absorption intensity of 60 or more or having a spectral absorption maximum wavelength of 500 nm or more and a light absorption intensity of 100 or more, wherein assuming that the maximum value of spectral absorption factor of the emulsion by a sensitizing dye is Amax, the distance between the shortest wavelength showing 80% of Amax and the longest wavelength showing 80% of Amax is 20 nm or more and the distance between the shortest wavelength showing 50% of Amax and the longest wavelength showing 50% of Amax is 120 nm or less.

(2) A silver halide photographic emulsion comprising a silver halide grain having a spectral absorption maximum wavelength of less than 500 nm and a light absorption intensity of 60 or more or having a spectral absorption maximum wavelength of 500 nm or more and a light absorption intensity of 100 or more, wherein assuming that the maximum value of spectral sensitivity of the emulsion by a sensitizing dye is Smax, the distance between the shortest wavelength showing 80% of Smax and the longest wavelength showing 80% of Smax is 20 nm or more and the distance between the shortest wavelength showing 50% of Smax and the longest wavelength showing 50% of Smax is 120 nm or less.

(3) The silver halide photographic emulsion as described in (1), wherein the longest wavelength showing a spectral absorption factor of 50% of Amax lies in the region of from 460 to 510 nm, from 560 to 610 nm, or from 640 to 730 nm.

(4) The silver halide photographic emulsion as described in (2), wherein the longest wavelength showing a spectral sensitivity of 50% of Smax lies in the region of from 460 to 510 nm, from 560 to 610 nm, or from 640 to 730 nm.

(5) The silver halide photographic emulsion as described in any one of (1), (2), (3) or (4), wherein the silver halide emulsion contains a dye having at least one aromatic group.

(6) The silver halide photographic emulsion as described in any one of (1) to (5), wherein a sensitizing dye is adsorbed in multiple layers onto a silver halide grain, the second sensitizing dye layer has a structure different from the first sensitizing dye layer, and the second sensitizing dye layer contains both a cationic dye and an anionic dye.

(7) The silver halide photographic emulsion as described in any one of (1) to (5), which contains a sensitizing dye having a basic nucleus formed by the condensation of three or more rings.

(8) The silver halide photographic emulsion as described in any one of (1) to (7), wherein the silver halide grain having a spectral absorption maximum wavelength of less than 500 nm and a light absorption intensity of 60 or more or having a spectral absorption maximum wavelength of 500 nm or more and a light absorption intensity of 100 or more is a tabular grain having an aspect ratio of 2 or more.

(9) The silver halide photographic emulsion as described in any one of (1) to (8), wherein the silver halide grain having a spectral absorption maximum wavelength of less than 500 nm and a light absorption intensity of 60 or more or having a spectral absorption maximum wavelength of 500 nm or more and a light absorption intensity of 100 or more is subjected to selenium sensitization.

(10) A silver halide photographic light-sensitive material comprising at least one silver halide photographic emulsion, which contains a silver halide photographic emulsion described in any one of (1) to (9).

DETAILED DESCRIPTION OF THE INVENTION

Figure 1:
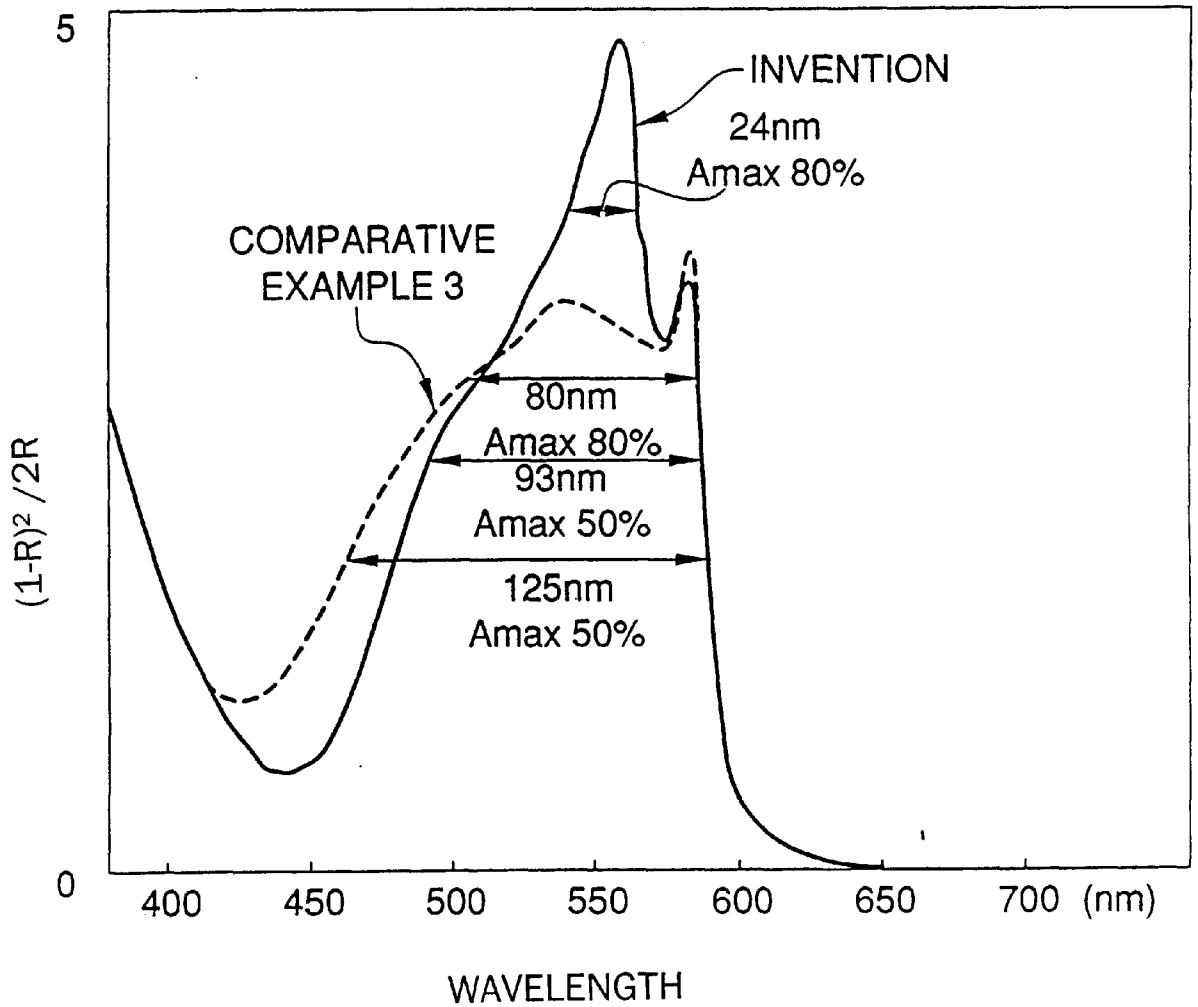
FIG. 1 shows a spectral adsorption spectrum of only a dye (where R is the infinite diffusion reflectance of a dye absorbed emulsion and $(1\text{-}R)^2/2R$ is proportional to absorption factor).

The present invention is described in detail below.

The present invention is a silver halide photographic light-sensitive material using a silver halide grain sensitized by a dye, which has large light absorption intensity, proper spectral absorption waveform and proper sensitivity distribution.

In the present invention, the light absorption intensity is an integrated intensity of light absorption by a sensitizing dye per the unit grain surface area and defined as a value obtained, assuming that the quantity of light entered into the unit surface area of a grain is $I_0$ and the quantity of light absorbed into a sensitizing dye on the surface is I, by integrating the optical density $\mathrm{Log}(I_0/(I_0-I))$ with respect to the wave number ($cm^{-1}$). The integration range is from 5,000 $cm^{-1}$ to 35,000 $cm^{-1}$.

The silver halide photographic emulsion of the present invention preferably contains a silver halide grain having a light absorption intensity of 100 or more in the case of a grain having a spectral absorption maximum wavelength of 500 nm or more, or having a light absorption intensity of 60 or more in the case of a grain having a spectral absorption maximum wavelength of less than 500 nm, in a proportion of a half or more of the entire projected area of all silver halide grains. In the case of a grain having a spectral absorption maximum wavelength of 500 nm or more, the light absorption intensity is preferably 150 or more, more preferably 170 or more, still more preferably 200 or more. In the case of a grain having a spectral absorption maximum wavelength of less than 500 nm, the light absorption intensity is preferably 90 or more, more preferably 100 or more, still more preferably 120 or more. The upper limit is not particularly limited but it is preferably 2,000 or less, more preferably 1,000 or less, still more preferably 500 or less.

The spectral absorption maximum wavelength of a grain having a spectral absorption maximum wavelength of less than 500 nm is preferably 350 nm or more.

One example of the method for measuring the light absorption intensity is a measurement method using a microspectrophotometer. The microspectrophotometer is a device capable of measuring an absorption spectrum of a microscopic area and can measure the transmission spectrum of one grain. The measurement of absorption spectrum of one grain by the microspectrometry is described in the report by Yamashita et al (Nippon Shashin Gakkai, 1996 *Nendo Nenji Taikai Ko'en Yoshi Shu* (*Lecture Summary at Annual Meeting of Japan Photographic Association in* 1996) , page 15). From this absorption spectrum, an absorption intensity per one grain can be obtained, however, the light transmitting the grain is absorbed on two surfaces of upper surface and lower surface, therefore, the absorption intensity per unit area on the grain surface can be obtained as a half (½) of the absorption intensity per one grain obtained by the above-described method. At this time, the segment for the integration of absorption spectrum is definably from 5,000 to 35,000 $cm^{-1}$, however, in experiments, the segment for the integration may contain the region of 500 $cm^{-1}$ shorter or longer than the segment having absorption by the sensitizing dye.

The light absorption intensity may also be obtained by not using the microspectrometry but using a method of aligning grains while preventing the grain from lying one on another, and measuring the transmission spectrum.

The light absorption intensity is a value indiscriminately determined by the oscillator strength of sensitizing dye and the number of molecules adsorbed per unit area, therefore, it may be possible to obtain the oscillator strength of sensitizing dye, the amount of dye adsorbed and the surface area of grain and convert these into the light absorption intensity.

The oscillator strength of sensitizing dye can be experimentally obtained as a value in proportion to the absorption integrated intensity (optical density×$cm^{-1}$) of a sensitizing dye solution. Therefore, assuming that the absorption integrated intensity of a dye per 1 M is A (optical density×$cm^{-1}$), the amount of sensitizing dye adsorbed is B (mol/mol-Ag) and the surface area of grain is C ($m^2$/mol-Ag), the light absorption intensity can be obtained according to the following formula within an error of about 10%:

$$0.156 \times A \times B/C$$

The light absorption intensity calculated from this formula is substantially the same as the light absorption intensity measured based on the above-described definition (a value obtained by the integration of $\mathrm{Log}(I_0/(I_0-I))$ with respect to the wave number ($cm^{-1}$)).

For increasing the light absorption intensity, a method of adsorbing a dye chromophore in one or more layers onto the grain surface, a method of increasing the molecular extinction coefficient of dye and a method of reducing the dye occupation area may be used. Any of these methods may be used but preferred is the method of adsorbing a dye chromophore in one or more layers onto the grain surface.

Here, the state where a dye chromophore is adsorbed in one or more layers onto the grain surface means that the dye bounded to the vicinity of a silver halide grain is present in one or more layers. Dyes present in the dispersion medium is not included in this dye. Also, the case where a dye chromophore is connected to a substance adsorbed to the grain surface through a covalent bond is not regarded as the adsorption in one or more layers, because the connecting group is long, when the dye chromophore is present in the dispersion medium, the effect increasing the light absorption intensity is less. In the case of so-called multi-layer adsorption where a dye chromophore is adsorbed in one or more layers onto the grain surface, it is necessary that spectral sensitization is generated by the dye not directly adsorbed to the grain surface and an excitation energy is transmitted from the dye not directly adsorbed to silver halide to the dye directly adsorbing to a grain. In this meaning, excitation energy transmission which is necessary to pass through over 10 stages is not preferred because the transmission efficiency of excitation energy decreases. One example of such a case is a polymer dye described in JP-A-2-113239 where a majority of dye chromophores are present in a dispersion medium and the excitation energy must be transmitted through over 10 stages.

In the present invention, the number of stages necessary for the dye to form a color per one molecule is preferably from 1 to 3.

The "chromophore" as used herein is defined in *Rikagaku Jiten* (*Physicochemical Dictionary*), pp. 985–986, 4th ed., Iwanami Shoten (1987) and means an atomic group which works out to a main cause for the absorption band of a molecule. Any chromophore, for example, an atomic group having an unsaturated bond such as C═C or N═N, may be used.

Examples thereof include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes, azomethine dyes, coumarin dyes, allylidene dyes, anthraquinone dyes, triphenylmethine dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophile dyes, phthalocyanine dyes and metal complex dyes.

Among these, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes and polymethine chromophores such as azamethine dyes, more preferred are cyanine dyes, merocyanine dyes, trinuclear merocyanine dyes, tetranuclear merocyanine dyes and rhodacyanine dyes, still more preferred are cyanine dyes, merocyanine dyes and rhodacyanine dyes, and most preferred are cyanine dyes.

These dyes are described in detain in F. M. Harmer, *Heterocyclic Compounds-Cyanine Dyes and Related Compounds,* John Wiley & Sons (1964), D. M. Sturmer, *Heterocyclic Compounds—Special topics in heterocyclic chemistry,* Chap. 18, Section 14, pp. 482–515. For cyanine dyes, merocyanine dyes and rhodacyanine dyes, formulae (XI), (XII) and (XIII) described in U.S. Pat. No. 5,340,694, columns 21 to 22, are preferred on the condition that the numbers of n12, n15, n17 and n18 are not limited and each is an integer of 0 or more (preferably 4 or less).

The dye chromophore adsorbed to a silver halide grain is preferably in 1.5 or more layers, more preferably 1.7 or more layers, still more preferably in 2 or more layers. The upper limit of the layer number is not particularly limited, however, it is preferably 10 or less layers, more preferably 5 or less layers.

In the present invention, the state where a chromophore is adsorbed in one or more layers onto the surface of a silver halide grain means that when saturation adsorption achieved by a dye having a smallest dye occupation area on a silver halide grain surface of sensitizing dyes added to an emulsion is defined as a single layer saturation coverage, the adsorption amount of a dye chromophore per unit layer is large based on the single layer saturation coverage. The adsorption layer number means an adsorption amount based on the single layer saturation coverage. In the case of a dye where dye chromophores are connected through a covalent bond, the adsorption layer number may be based on the dye occupation area of individual dyes in the state such that these dye chromophores are not connected.

The dye occupation area may be obtained from an adsorption isotherm showing the relationship between the free dye concentration and the dye adsorption amount, and a grain surface area. The adsorption isotherm may be obtained by referring, for example, to A. Herz et al., *Adsorption from Aqueous Solution, Advances in chemistry Series,* No. 17, page 173 (1968).

For determining the amount of a sensitizing dye adsorbed to an emulsion layer, two methods may be used, namely, one is a method of centrifuging an emulsion having adsorbed thereto a dye to separate emulsion grains from supernatant aqueous gelatin solution, measuring the spectral absorption of the supernatant to obtain a non-absorbed dye concentration, subtracting the concentration from the amount of dye added and thereby determining the dye adsorption amount, and another is a method of drying emulsion grains precipitated, dissolving a predetermined weight of the precipitate in a 1:1 mixed solution of aqueous sodium thiosulfate solution and methanol, measuring the spectral absorption and thereby determining the dye adsorption amount. In the case where a plurality of dyes are used, the adsorption amount of individual dyes may also be obtained by a means such as high-speed liquid chromatography. The method of determining the dye adsorption amount by quantitating the amount of dye in the supernatant is described, for example, in W. West et al, *Journal of Physical Chemistry,* Vol. 56, page 1054 (1952). However, under the conditions that the amount of dye added is large, even non-adsorbed dyes may precipitate and exact determination of the adsorption amount may not be obtained by the method of quantitating the dye concentration in the supernatant. On the other hand, according to the method of dissolving silver halide grains precipitated and measuring the dye adsorption amount, the amount of only the dye adsorbed to grains can be exactly determined because the emulsion grain is by far higher in the precipitation rate and the dye precipitated with grains can be easily separated. This method is most reliable for determining the dye adsorption amount.

As one example of the method for measuring the surface area of a silver halide grain, a method of taking a transmission electron microscopic photograph by a replica process and calculating the shape and size of individual grains may be used. In this case, the thickness of a tabular grain is calculated from the length of a shadow of the replica. The transmission electron microscopic photograph may be taken, for example, by referring to *Denshi Kenbikyo Shiryo Gijutsu Shu* (*Electron Microscopic Sample Technologies*), Nippon Denshi Kenbikyo Gakkai Kanto Shibu (compiler), Seibundo Shinko Sha (1970), P. B. Hirsch et al, *Electron Microscopy of Thin Crystals,* Butterworths, London (1965).

Other examples of the measuring method are described in A. M. Kragin et al., *The Journal of Photographic Science,* Vol. 14, page 185 (1966), J. F. Paddy, *Transactions of the Faraday Society,* Vol. 60, page 1325 (1964), S. Boyer et al., *Journal de Chimie Physique et de Physicochimie Biologique,* Vol. 63, page 1123 (1963), W. West et al., *Journal of Physical Chemistry,* Vol. 56, page 1054 (1952), E. Klein et al., *International Coloquium,* compiled by H. Sauvernier, and *Scientific Photography,* Liege (1959).

The dye occupation area of individual grains may be experimentally determined by the above-described methods, however, the molecular occupation area of sensitizing dyes usually used is mostly present in the vicinity of 80 $Å^2$, therefore, the adsorption layer number may be roughly estimated by a simple method of counting the dye occupation area as 80 $Å^2$.

In the present invention, when a dye chromophore is adsorbed in multiple layers onto a silver halide grain, the dye chromophore directly adsorbing to the silver halide grain, namely, dye chromophore in the first layer, and the dye chromophores in the second and subsequent layers may have any reduction potential and any oxidation potential, however, the reduction potential of the dye chromophore in the first layer is preferably more positive than the value obtained by subtracting 0.2 V from the reduction potential of the dye chromophore in the second or subsequent layer.

The reduction potential and the oxidation potential may be measured by various methods, however, these are preferably measured by phase discrimination-type second harmonic a.c. polarography for determining exact values. The method for determining the potential by phase discrimination-type second harmonic a.c. polarography is described in *Journal of Imaging Science,* Vol. 30, page 27 (1986).

The dye chromophore in the second or subsequent layer is preferably a light-emitting dye. The light-emitting dye preferably has a skeleton (i.e., a basic) structure of dyes used for dye laser. These are described, for example, in Mitsuo Maeda, *Laser Kenkyu* (*Study of Laser*), Vol. 8, page 694, page 803 and page 958 (1980), ibid., Vol. 9, page 85 (1981), and F. Shaefer, *Dye Lasers,* Springer (1973).

The absorption maximum wavelength of the dye chromophore in the first layer in a silver halide photographic light-sensitive material is preferably longer than the absorption maximum wavelength of the dye chromophore in the second or subsequent layer. Furthermore, the light emission of the dye chromophore in the second or subsequent layer preferably overlaps the absorption of the dye chromophore in the first layer. In addition, the dye chromophore in the first layer preferably forms J-association product (i.e., J-aggregate) . In order to have absorption and spectral sensitivity in a desired wavelength range, the dye chromophores in the second and subsequent layers also preferably form a J-association product.

The meanings of the terms used in the present invention are described below.

Dye Occupation Area

An occupation area per one molecule of dye. This can be experimentally determined from the adsorption isotherm. In the case of a dye where dye chromophores are connected by a covalent bond, the area is determined based on the dye occupation area of individual dyes not connected. Simply, 80 $Å^2$.

Single Layer Saturation Coverage

A dye adsorption amount per unit grain surface area at the time of single layer saturation covering. A reciprocal of the minimum dye occupation area among dyes added.

Multi-Layer Adsorption

A state where the adsorption amount of dye chromophore per unit grain surface area is larger than the single layer saturation coverage.

Adsorption Layer Number

An adsorption amount of dye chromophore per the unit grain surface area based on the single layer saturation coverage.

In the emulsion containing a silver halide photographic emulsion grain having a light absorption intensity of 60 or more or 100 or more, the distance between the shortest wavelength showing 50% of a maximum value Amax of the spectral absorption factor by a sensitizing dye and showing 50% of a maximum value Smax of the spectral sensitivity and the longest wavelength showing 50% of Amax and 50% of Smax is preferably 120 nm or less, more preferably 100 nm or less.

The distance between the shortest wavelength showing 80% of Amax and 80% of Smax and the longest wavelength showing 80% of Amax and 80% of Smax is 20 nm or more and is preferably 100 nm or less, more preferably 80 nm or less, still more preferably 50 nm or less.

The distance between the shortest wavelength showing 20% of Amax and 20% of Smax and the longest wavelength showing 20% of Amax and 20% of Smax is preferably 180 nm or less, more preferably 150 nm or less, still more preferably 120 nm or less, and most preferably 100 nm or less.

The longest wavelength showing 50% of Amax and 50% of Smax is preferably from 460 to 510 nm, from 560 nm to 610 nm, or from 640 to 730 nm.

For realizing a silver halide grain having a spectral absorption maximum wavelength of less than 500 nm and a light absorption intensity of 60 or more or having a spectral absorption maximum wavelength of 500 nm or more and a light absorption intensity of 100 or more, a first preferred method is a method of using a specific dye described below.

For example, a method of using a dye having an aromatic group or a cationic dye having an aromatic group and an anionic dye in combination described in JP-A-10-239789, JP-A-8-269009, JP-A-10-123650 and JP-A-8-328189, a method of using a dye having a polyvalent electric charge described in JP-A-10-171058, a method of using a dye having a pyridinium group described in JP-A-10-104774, a method of using a dye having a hydrophobic group described in JP-A-10-186559, and a method of using a dye having a coordinate bond group described in JP-A-10-197980 are preferred.

Among these, preferred is a method of using a dye having at least one aromatic group, and more preferred is a method of using only a positively charged dye, a dye cancelled in the electric charge within the molecule or a dye having no electric charge, or a method of using a positively charged dye and a negative charged dye in combination there at least one of the positively charged dye and the negatively charged dye is a dye having at least one aromatic group as a substituent.

The aromatic group is described in detail below. The aromatic group includes a hydrocarbon aromatic group and a heterocyclic aromatic group. The group may have a polycyclic condensation structure obtained by condensing a hydrocarbon aromatic ring and a heterocyclic aromatic ring to each other or a polycyclic condensation structure obtained by combining an aromatic hydrocarbon group and an aromatic heterocyclic ring, and may be substituted by a substituent V which will be described later. Examples of the aromatic ring which is preferably contained in the aromatic group include benzene, naphthalene, anthracene, phenanthrene, fluorene, triphenylene, naphthacene, biphenyl, pyrrole, furane, thiophene, imidazole, oxazole, thiazole, pyridine, pyrazine, pyrimidine, pyridazine, indolizine, indole, benzofurane, benzothiophene, isobenzofurane, quinolizine, quinoline, phthalazine, naphtylidine, quinoxaline, quinoxazoline, quinoline, carbazole, phenanthridine, acridine, phenanthroline, thianthrene, chromene, xanthene, phenoxathine, phenothiazine and phenazine.

Among these, preferred are the hydrocarbon aromatic rings, more preferred are benzene and naphthalene, and most preferred is benzene.

Examples of the dye include the dyes described above as examples of the dye chromophore. Among these, preferred are dyes described above as examples of the polymethine dye chromophore.

More preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, suqarium dyes, croconium dyes and azamethine dyes, still more preferred are cyanine dyes, merocyanine dyes, trinuclear merocyanine dyes, tetranuclear merocyanine dyes and rhodacyanine dyes, particularly preferred are cyanine dyes, merocyanine dyes and rhodacyanine dyes, and most preferred are cyanine dyes.

Particularly preferred methods are described in detail below by referring to structural formulae.

The methods (1) and (2) are preferred. Of the methods (1) and (2), the method (2) is more preferred.

(1) A method of using at least one cationic, betaine or nonionic methine dye represented by the following formula (I); and (2) A method of simultaneously using at least one cationic methine dye represented by the following formula (I) and at least one anionic methine dye represented by the following formula (II):

(I)

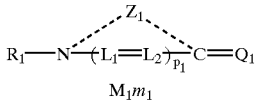

wherein $Z_1$ represents an atomic group necessary for forming a nitrogen-containing heterocyclic ring, provided that a ring may further be condensed to $Z_1$, $R_1$ represents an alkyl group, an aryl group or a heterocyclic group, $Q_1$ represents a group necessary for allowing the compound represented by formula (I) to form a methine dye, $L_1$ and $L_2$ each represents a methine group, pi represents 0 or 1, provided that $Z_1$, $R_1$, $Q_1$, $L_1$ and $L_2$ each has a substituent which allows the methine dye represented by formula (I) as a whole to form a cationic dye, a betaine dye or a nonionic dye and in the case where formula (I) is a cyanine dye or a rhodacyanine dye, $Z_1$, $R_1$, $Q_1$, $L_1$ and $L_2$ each preferably has a substituent which allows the methine dye represented by formula (I) as a whole to form a cationic dye, $M_1$ represents a counter ion for balancing the electric charge, and $m_1$ represents an integer of 0 or more necessary for neutralizing the electric charge of the molecule;

(II)

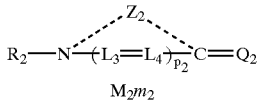

wherein $Z_2$ represents an atomic group necessary for forming a nitrogen-containing heterocyclic ring, provided that a ring may further be condensed to $Z_2$, $R_2$ represents an alkyl group, an aryl group or a heterocyclic group, $Q_2$ represents a group necessary for allowing the compound represented by formula (II) to form a methine dye, $L_3$ and $L_4$ each represents a methine group, $p_2$ represents 0 or 1, provided that $Z_2$, $R_2$, $Q_2$, $L_3$ and $L_4$ each has a substituent which allows the methine dye represented by formula (II) as a whole to form an anionic dye, $M_2$ represents a counter ion for balancing the electric charge, and $m_2$ represents a number of 0 or more necessary for neutralizing the electric charge of molecule.

In the case of using the compound represented by formula (I) alone, $R_1$ is preferably a group having an aromatic ring.

In the case of using the compound represented by formula (I) and the compound represented by formula (II) in combination, preferably, at least one of $R_1$ and $R_2$ is a group having an aromatic ring, and more preferably, $R_1$ and $R_2$ both are a group having an aromatic ring.

The cationic dye for use in the present invention may be any as long as the electric charge of the dye exclusive of the counter ion is cationic, but a dye having no anionic substituent is preferred. The anionic dye for use in the present invention may be any as long as the electric charge of the dye exclusive of the counter ion is anionic, but a dye having one or more anionic substituent is preferred. The betaine dye for use in the present invention is a dye having an electric charge within the molecule, where an inner salt is formed and the molecule as a whole has no electric charge. The nonionic dye for use in the present invention is a dye not having an electric charge at all within the molecule.

The term "anionic substituent" as used herein means a substituent having a negative charge. Examples thereof include a proton-dissociative acidic group having a dissociation ratio of 90% or more at a pH of from 5 to 8. Specific examples thereof include a sulfo group, a carboxyl group, a sulfate group, a phosphoric acid group, a boric acid group, an alkylsulfonylcarbamoylalkyl group (e.g., methanesulfonylcarbamoylmethyl group), an acylcarbamoylalkyl group (e.g., acetylcarbamoylmethyl group), an acylsulfamoylalkyl group (e.g., acetylsulfamoylmethyl group) and an alkylsulfonylsulfamoylalkyl group (e.g., methanesulfonylsulfamoylemethyl group). Among these, preferred are a sulfo group and a carboxyl group, and more preferred are a sulfo group.

Examples of the cationic substituent include a substituted or unsubstituted ammonium group and a pyridium group.

The dye represented by formula (I) is more preferably represented by the following formula (I-1), (I-2) or (I-3):

(I-1)

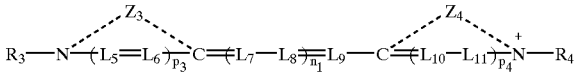

$M_1m_1$ wherein $L_5$, $L_6$, $L_7$, $L_8$, $L_9$, $L_{10}$ and $L_{11}$ each represents a methine group, $p_3$ and $p_4$ each represents 0 or 1, $n_1$ represents 0, 1, 2, 3 or 4, $Z_3$ and $Z_4$ each represents an atomic group necessary for forming a nitrogen-containing heterocyclic ring, provided that a ring may be condensed to $Z_3$ and $Z_4$, $R_3$ and $R_4$ each represents an alkyl group, an aryl group or a heterocyclic group, and $M_1$ and $m_1$ have the same meanings as in formula (I), provided that $R_3$, $R_4$, $Z_3$, $Z_4$ and $L_5$ to $L_{11}$ each has no anionic substituent when the compound (I-1) is a cationic dye, and has an anionic substituent so as to balance the electric charge within the dye molecule, preferably one anionic substituent, when the compound (I-1) is a betaine dye;

(I-2)

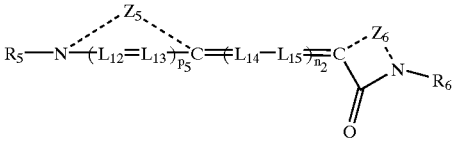

$M_1m_1$ wherein $L_{12}$, $L_{13}$, $L_{14}$ and $L_{15}$ each represents a methine group, $p_5$ represents 0 or 1, $n_2$ represents 0, 1, 2, 3 or 4, $Z_5$ and $Z_6$ each represents an atomic group necessary for forming a nitrogen-containing heterocyclic ring, provided that a ring may be condensed to $Z_5$ and $Z_6$, $R_5$ and $R_6$ each represents an alkyl group, an aryl group or a heterocyclic group, and $M_1$ and $m_1$ have the same meanings as in formula (I), provided that $R_5$, $R_6$, $Z_5$, $Z_6$ and $L_{12}$ to $L_{15}$ each has a cationic substituent when the compound (I-2) is a cationic dye, has a cationic substituent and an anionic substituent, preferably one cationic substituent and one anionic substituent, so as to balance the electric charge when the compound (I-2) is a betaine dye, and has neither cationic substituent nor anionic substituent when the compound (I-2) is a nonionic dye; or (I-3)

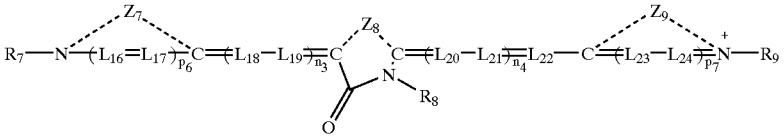

$M_1m_1$ wherein $L_{16}$, $L_{17}$, $L_{18}$, $L_{19}$, $L_{20}$, $L_{21}$, $L_{22}$, $L_{23}$ and $L_{24}$ each represents a methine group, $p_6$ and $p_7$ each represents 0 or 1, $n_3$ and $n_4$ each represents 0, 1, 2, 3 or 4, $Z_7$, $Z_8$ and $Z_9$ each represents an atomic group necessary for forming a nitrogen-containing heterocyclic ring, provided that a ring may be condensed to $Z_7$ and $Z_9$, $R_7$, $R_8$ and $R_9$ each represents an alkyl group, an aryl group or a heterocyclic group, and $M_1$ and $m_1$ have the same meanings as in formula (I), provided that $R_7$, $R_8$, $R_9$, $Z_7$, $Z_8$, $Z_9$ and $L_{16}$ to $L_{24}$ each has no anionic substituent when the compound (I-3) is a cationic dye, and has an anionic substituent so as to balance the electric charge within the dye molecule, preferably one anionic substituent, when the compound (I-3) is a betaine dye.

The anionic dye represented by formula (II) is more preferably represented by the following formula (II-1), (II-2) or (II-3):

(II-1)

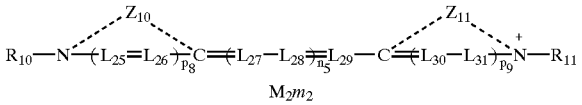

$M_2m_2$ wherein $L_{25}$, $L_{26}$, $L_{27}$, $L_{28}$, $L_{29}$, $L_{30}$ and $L_{31}$ each represents a methine group, $p_8$ and $p_9$ each represents 0 or 1, $n_5$ represents 0, 1, 2, 3 or 4, $Z_{10}$ and $Z_{11}$ each represents an atomic group necessary for forming a nitrogen-containing heterocyclic ring, provided that a ring may be condensed to $Z_{10}$ and $Z_{11}$, $R_{10}$ and $R_{11}$ each represents an alkyl group, an aryl group or a heterocyclic group, and $M_2$ and $m_2$ have the same meanings as in formula (II) , provided that $R_{10}$ and $R_{11}$ each has an anionic substituent;

(II-2)

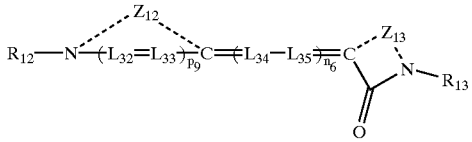

$M_2m_2$ wherein $L_{32}$, $L_{33}$, $L_{34}$ and $L_{35}$ each represents a methine group, $p_9$ represents 0 or 1, $n_6$ represents 0, 1, 2, 3 or 4, $Z_{12}$ and $Z_{13}$ each represents an atomic group necessary for forming a nitrogen-containing heterocyclic ring, provided that a ring may be condensed to $Z_{12}$ and $Z_{13}$, $R_{12}$ and $R_{13}$ each represents an alkyl group, an aryl group or a heterocyclic group, and $M_2$ and $m_2$ have the same meanings as in formula (II), provided that at least one of $R_{12}$ and $R_{13}$ has an anionic substituent; or (II-3)

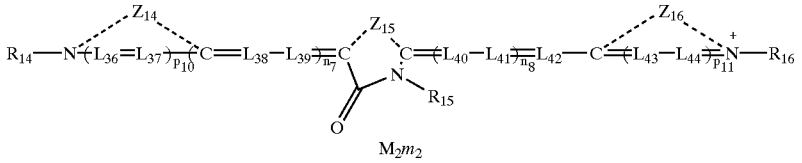

$M_2m_2$ wherein $L_{36}$, $L_{37}$, $L_{38}$, $L_{39}$, $L_{40}$, $L_{41}$, $L_{42}$, $L_{43}$ and $L_{44}$ each represents a methine group, $p_{10}$ and $p_{11}$ each represents 0 or 1, $n_7$ and $n_8$ each represents 0, 1, 2, 3 or 4, $Z_{14}$, $Z_{15}$ and $Z_{16}$ each represents an atomic group necessary for forming a nitrogen-containing heterocyclic ring, provided that a ring may be condensed to $Z_{14}$ and $Z_{15}$, $R_{14}$, $R_{15}$ and $R_{16}$ each represents an alkyl group, an aryl group or a heterocyclic group, and $M_2$ and $m_2$ have the same meanings as in formula (II), provided that at least two of $R_{14}$, $R_{15}$ and $R_{16}$ have an anionic substituent.

In the case where the compound represented by formula (I-1), (I-2) or (I-3) is used alone, at least one and preferably both of $R_3$ and $R_4$ is(are) a group having an aromatic ring, at least one and preferably both of $R_5$ and $R_6$ is(are) a group having an aromatic ring, and at least one, preferably two and more preferably all three of $R_7$, $R_8$ and $R_9$ is(are) a group having an aromatic ring.

In the case where the compound represented by formula (I-1), (I-2) or (I-3) and the compound represented by formula (II-1), (II-2) or (II-3) are used in combination, at least one, preferably two, more preferably three and still more preferably four or more of $R_3$ to $R_9$ or $R_{10}$ to $R_{16}$ is(are) a group having an aromatic group.

By the above-described preferred method, a silver halide grain having a spectral absorption maximum wavelength of less than 500 nm and a light absorption intensity of 60 or more or having a spectral absorption maximum wavelength of 500 nm or more and a light absorption intensity of 100 or more may be obtained. However, the dye in the second layer is usually adsorbed in the state of a monomer and the absorption width and the spectral sensitivity width thereof are broader than respective desired ranges in most cases. For realizing high sensitivity in the desired wavelength region, the dye adsorbed in the second layer must form a J-association product (i.e., J-aggregate). The J-aggregate has high fluorescence yield and small Stokes' shift, therefore, this is advantageous in transferring the light energy absorbed by the dye in the second layer to the dye in the first layer, which are approximated in the light absorption wavelength, utilizing the Forster-type energy transfer.

In the present invention, the dye in the second and subsequent layers means a dye which is adsorbed to a silver halide grain but not adsorbed directly to the silver halide In the present invention, the J-aggregate of dye in the second or subsequent layer is defined as a product such that the absorption width in the longer wavelength side of absorption shown by a dye adsorbed to the second or subsequent layer is 2 times or less of the absorption width in the longer wavelength side of absorption shown by the dye solution in the monomer state where interaction between dye chromophores does not occur. The absorption width in the longer wavelength side as used herein means an energy width between the absorption maximum wavelength and the wavelength being longer than the absorption maximum wavelength and showing absorption as small as ½ of the absorption maximum. It is well-known that when a J-aggregate is formed, the absorption width in the longer wavelength side is generally reduced as compared with the case in the monomer state. If the dye adsorbed to the second layer is still in the monomer state, the absorption width increases as large as 2 times or more the absorption width in the longer wavelength side of absorption shown by the dye solution in the monomer state because the adsorption site and the adsorption state are not uniform. Accordingly, the dye in the second or subsequent layer can be defined as above.

The spectral absorption of dye adsorbed to the second and subsequent layers can be obtained by subtracting the spectral absorption attributable to the dye in the first layer from the entire spectral absorption of the emulsion.

The spectral absorption attributable to the dye in the first layer can be determined by measuring the absorption spectrum when only the dye in the first layer is added. The spectral absorption spectrum may also be measured by adding a dye desorbing agent to the emulsion having adsorbed thereto a sensitizing dye in multiple layers and thereby desorbing the dyes in the second and subsequent layers.

In the experiment of desorbing a dye from the grain surface using a dye desorbing agent, the dye in the first layer is usually desorbed after the dyes in the second and subsequent layers are desorbed. Therefore, by selecting appropriate desorption conditions, the spectral absorption attributable to the dye in the first layer can be obtained and thereby the spectral absorption of dye in the second and subsequent layers may be obtained. The method of using a dye desorbing agent is described in Asanuma et al., *Journal of Physical Chemistry B,* Vol. 101, pp. 2149–2153 (1997).

In order to form a J-aggregate of dye in the second layer using the cationic dye, betaine dye or nonionic dye represented by formula (I) and the anionic dye represented by formula (II), the dye adsorbed to form the first layer and the dye adsorbed to form the second or subsequent layer are preferably added separately and it is more preferred that the dye used for the first layer and the dye used for the second or subsequent layer have different structures from each other. The dye in the second or subsequent layer preferably comprises a cationic dye, a betaine dye or a nonionic dye alone or comprises a combination of a cationic dye and an anionic dye.

For the dye in the first layer, any dye may be used, however, the dye represented by formula (I) or (II) is preferred and the dye represented by formula (I) is more preferred.

For the dye in the second layer, the cationic dye, betaine dye or nonionic dye represented by formula (I) is preferably used alone. In the case of using a cationic dye and an anionic dye in combination which is another preferred embodiment of the dye in the second layer, either one of the dyes used is preferably the cationic dye represented by formula (I) or the anionic dye represented by formula (II), and it is more preferred that the cationic dye represented by formula (I) and the anionic dye represented by formula (II) both are contained. The ratio of cationic dye/anionic dye as the dye in the second layer is preferably from 0.5 to 2, more preferably from 0.75 to 1.33, most preferably from 0.9 to 1.11.

In the present invention, a dye other than the dyes represented by formulae (I) and (II) may be added, however, the dye represented by formula (I) or (II) preferably occupies 50% or more, more preferably 70% or more, most preferably 90% or more, of the total amount of dyes added.

By adding the dye in the second layer as such, the interaction between dyes in the second layer can be increased while promoting rearrangement of the dyes in the second layer and thereby, the J-association product (i.e., J-aggregate) can be formed.

In the case of using the dye represented by formula (I) or (II) as the dye in the first layer, $Z_1$ and $Z_2$ is preferably a basic nucleus substituted by an aromatic group or a basic nuclear resulting from condensation of three or more rings. In the case of using the dye represented by formula (I) or (II) as the dye in the second or subsequent layer, $Z_1$ and $Z_2$ is preferably a basic nucleus resulting from condensation of three or more rings.

The number of rings condensed in the basic nucleus is, for example, 2 in the benzoxazole nucleus and 3 in the naphthoxazole nucleus. Even if the benzoxazole nucleus is substituted by a phenyl group, the number of rings condensed is 2. The basic nucleus resulting from condensation of three or more rings may be any as long as it is a polycyclic condensation-type heterocyclic basic nucleus obtained by the condensation of three or more rings, however, a tricyclic condensation-type heterocyclic ring and a tetracyclic condensation-type heterocyclic ring are preferred. Preferred examples of the tricyclic condensation-type heterocyclic ring include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, naphtho[2,3-d]imidazole, naphtho[1,2-d]-imidazole, naphtho[2,1-d]imidazole, naphtho[2,3-d]selenazole, naphtho[1,2-d]selenazole, naphtho[2,1-d]selenazole, indolo[5,6-d]oxazole, indolo[6,5-d]oxazole, indolo[2,3-d]oxazole, indolo[5,6-d]thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole and benzothieno[2,3-d]oxazole. Preferred examples of the tetracyclic condensation-type heterocyclic ring include anthra[2,3-d]oxazole, anthra[1,2-d]oxazole, anthra[2,1-d]oxazole, anthra[2,3-d]thiazole, anthra[1,2-d]thiazole, phenanthro[2,1-d]oxazole, phenanthro[2,3-d]imidazole, anthra[1,2-d]imidazole, anthra[2,1-d]imidazole, anthra[2,3-d]selenazole, phenanthro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, dibenzothieno[3,2-d]oxazole, tetrahydrocarbazolo[6,7-d]oxazole, tetrahydrocarbazolo[7,6-d]oxazole, dibenzothieno[3,2-d]thiazole, dibenzothieno[3,2-d]thiazole and tetrahydrocarbazolo[6,7-d]thiazole. More preferred examples of the basic nucleus resulting from condensation of three or more rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole. Among these, still more preferred are naphtho[2,3-d]oxazole, naphtho[1,2-d]oxazole, naphtho[2,3-d]thiazole, indolo[5,6-d]oxazole, indolo[6,5-d]oxazole, indolo[5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole.

Another preferred example of the method for realizing an adsorption state such that a dye chromophore is coated in multiple layers on a silver halide grain surface is a method of using a dye compound having two or more dye chromophore moieties connected by covalent bonding though a linking group. The dye chromophore which can be used may be any and examples thereof include the dye chromophores described above. Among those, preferred are the polymethine dye chromophores described above for the dye chromophore, more preferred are cyanine dyes, merocyanine dyes, rhodacyanine dyes and oxonol dyes, still more preferred are cyanine dyes, rhodacyanine dyes and merocyanine dyes, and most preferred are cyanine dyes.

Preferred examples of the above-described method include a method of using a dye connected by a methine chain described in JP-A-9-265144, a method of using a dye having connected thereto an oxonol dye described in JP-A-10-226758, a method of using a linked dye having a specific structure described in JP-A-10-110107, JP-A-10-307358, JP-A-10-307359 and JP-A-10-310715, a method of using a linked dye having a specific linking group described in JP-A-9-189986 and JP-A-10-204306, a method of using a linked dye having a specific structure described in Japanese Patent Application Nos. 11-34444, 11-34463 and 11-34462, and a method of using a dye having a reactive group and producing a linked dye in an emulsion described in Japanese Patent Application No. 10-249971.

The linked dye is preferably a dye represented by the following formula (III):

$$D_1-(La-[D_2]_q)_rM_3m_3 \quad \text{(III)}$$

wherein $D_1$ and $D_2$ each represents a dye chromophore, La represents a linking group or a single bond, q and r each represents an integer of from 1 to 100, $M_3$ represents a charge-balancing counter ion, and $m_3$ represents a number necessary for neutralizing the electric charge of molecule.

$D_1$, $D_2$ and La are described below.

The chromophore represented by $D_1$ or $D_2$ may be any. Specific examples thereof include the dye chromophores described above. Among those, preferred are the polymethine dye chromophores described above for the dye chromophore, more preferred are cyanine dyes, merocyanine dyes, rhodacyanine dyes and oxonol dyes, still more preferred are cyanine dyes, merocyanine dyes and rhodacyanine dyes, and most preferred are cyanine dyes.

In the present invention, in the case where a linked dye represented by formula (III) is adsorbed to a silver halide grain, $D_2$ is preferably a chromophore not directly adsorbed to silver halide.

In other words, $D_2$ is preferably lower than $D_1$ in the adsorption strength to a silver halide grain. The adsorption strength to a silver halide grain is most preferably in the order of $D_1$>La>$D_2$.

As such, $D_1$ is preferably a sensitizing dye moiety having adsorptivity to a silver halide grain, however, the adsorption may also be attained by either physical adsorption or chemical adsorption.

$D_2$ is preferably weak in the adsorptivity to a silver halide grain and is also preferably a light-emitting dye. As the light-emitting dye, those having a skeleton structure (i.e., a basic structure) of dyes used for dye laser are preferred.

These are described, for example, in Mitsuo Maeda, *Laser Kenkyu* (*Study of Laser*), Vol. 8, page 694, page 803 and page 958 (1980), ibid., Vol. 9, page 85 (1981), and F. Shaefer, *Dye Lasers,* Springer (1973).

The absorption maximum wavelength of $D_1$ in a silver halide photographic light-sensitive material is preferably longer than the absorption maximum wavelength of $D_2$. Furthermore, the light emission of $D_2$ preferably overlaps the absorption of $D_1$. In addition, $D_1$ preferably forms a J-aggregate. In order to allow the linked dye represented by formula (I) to have absorption and spectral sensitivity in a desired wavelength range, $D_2$ also preferably forms a J-aggregate.

$D_1$ and $D_2$ each may have any reduction potential and any oxidation potential, however, the reduction potential of $D_1$ is preferably more positive than the value obtained by subtracting 0.2 V from the reduction potential of $D_2$.

La represents a linking group (preferably a divalent linking group) or a single bond. This linking group preferably comprises an atom or atomic group containing at least one of carbon atom, nitrogen atom, sulfur atom and oxygen atom. La preferably represents a linking group having from 0 to 100 carbon atoms, more preferably from 1 to 20 carbon atoms, constituted by one or a combination of two or more of an alkylene group (e.g., methylene, ethylene, propylene, butylene, pentylene), an arylene group (e.g., phenylene, naphthylene,), an alkenylene group (e.g., ethenylene, propenylene), an alkynylene group (e.g., ethynylene, propynylene), an amide group, an ester group, a sulfoamido group, a sulfonic acid ester group, a ureido group, a sulfonyl group, a sulfinyl group, a thioether group, ether group, a carbonyl group, —N(Va)— (wherein Va represents hydrogen atom or a monovalent substituent; examples of the monovalent group include those represented by V which is described later) and a heterocyclic divalent group (e.g., 6-chloro-1,3,5-triazine-2,4-diyl, pyrimidine-2,4-diyl, quinoxaline-2,3-diyl).

The above-described linking groups each may have a substituent represented by V which is described later. Furthermore, these linking groups each may contain a ring (aromatic or non-aromatic hydrocarbon or heterocyclic ring).

La more preferably represents a divalent linking group having from 1 to 10 carbon atoms, constituted by one or a combination of two or more of an alkylene group having from 1 to 10 carbon atoms (e.g., methylene, ethylene, propylene, butylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amide group, an ester group, a sulfonamido group and a sulfonic acid ester group. These linking groups each may be substituted by V which is described later.

La is a linking group which may perform energy transfer or electron transfer by the through-bond interaction. The through-bond interaction includes tunnel interaction and super-exchange interaction. Of these, a through-bond interaction based on the super-exchange interaction is preferred. The through-bond interaction and the super-exchange interaction are interactions defined in Shammai Speiser, *Chem. Rev.,* Vol. 96, pp. 1960–1963 (1996). As the linking group which can allow the occurrence of energy transfer or electron transfer by such an interaction, those described in Shammai Speiser, *Chem. Rev.,* Vol. 96, pp. 1967–1969 (1996) are preferred.

q and r each represents an integer of from 1 to 100, preferably from 1 to 5, more preferably from 1 to 2, still more preferably 1. When q and r each is 2 or more, a plurality of linking groups La contained may be different from each other and a plurality of dye chromophores $D_2$ contained may also be different from each other.

The dye represented by formula (III) as a whole preferably has an electric charge of −1.

The dye is more preferably a methine dye where $D_1$ and $D_2$ in formula (III) each is independently represented by the following formula (IV), (V) or (VI):

(IV)

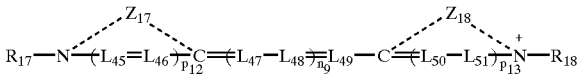

$M_4m_4$ wherein $L_{45}$, $L_{46}$, $L_{47}$, $L_{48}$, $L_{49}$, $L_{50}$ and $L_{51}$ each represents methine group, $p_{12}$ and $p_{13}$ each represents 0 or 1, $n_9$ represents 0, 1, 2, 3 or 4, $Z_{17}$ and $Z_{18}$ each represents an atomic group necessary for forming a nitrogen-containing heterocyclic ring, provided that a ring may be condensed to $Z_{17}$ and $Z_{18}$, $M_4$ represents a charge-balancing counter ion, $m_4$ represents a number of 0 or more necessary for neutralizing the electric charge of molecule, and $R_{17}$ and $R_{18}$ each represents an alkyl group, an aryl group or a heterocyclic group;

(V)

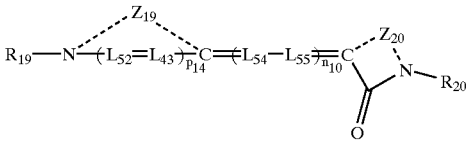

$M_5m_5$ wherein $L_{52}$, $L_{53}$, $L_{54}$ and $L_{55}$ each represents a methine group, $p_{14}$ represents 0 or 1, $n_{10}$ represents 0, 1, 2, 3 or 4, $Z_{19}$ and $Z_{20}$ each represents an atomic group necessary for forming a nitrogen-containing heterocyclic ring, provided that a ring may be condensed to $Z_{19}$, $M_5$ represents a charge-balancing counter ion, $m_5$ represents a number of 0 or more necessary for neutralizing the electric charge of molecule, and $R_{19}$ and $R_{20}$ each represents an alkyl group, an aryl group or a heterocyclic group; or (VI)

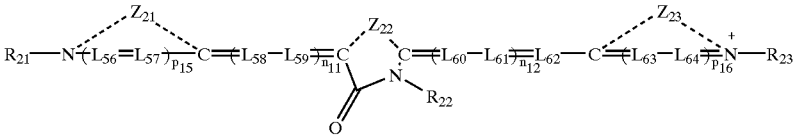

$M_6m_6$ wherein $L_{56}$, $L_{57}$, $L_{58}$, $L_{59}$, $L_{60}$, $L_{61}$, $L_{62}$, $L_{63}$ and $L_{64}$ each represents a methine group, $p_{15}$ and $p_{16}$ each represents 0 or 1, $n_{11}$, and $n_{12}$ each represents 0, 1, 2, 3 or 4, $Z_{21}$, $Z_{22}$ and $Z_{23}$ each represents an atomic group necessary for forming a nitrogen-containing heterocyclic ring, provided that a ring may be condensed to $Z_{21}$ and $Z_{23}$, $M_6$ represents a charge-balancing counter ion, $m_6$ represents a number of 0 or more necessary for neutralizing the electric charge of molecule, and $R_{21}$, $R_{22}$ and $R_{23}$ each represents an alkyl group, an aryl group or a heterocyclic group.

Between the method using the dyes represented by formulae (I) and (II) and the method using the dye represented by formula (III), the method using the dyes represented by formulae (I) and (II) is preferred.

The methine compounds represented by formulae (I) (including formulae (I-1), (I-2) and (I-3)), (II) (including formulae (II-1), (II-2) and (II-3)), (IV), (V) and (VI) are described in detail below.

In formulae (I) and (II), $Q_1$ and $Q_2$ each represents a group necessary for forming a methine dye. By the groups $Q_1$ and $Q_2$, any methine dye can be formed but examples thereof include methine dyes described above as examples of the dye chromophore.

Among those, preferred are cyanine dyes, merocyanine dyes, rhodacyanine dyes, trinuclear merocyanine dyes, tetranuclear merocyanine dyes, allopolar dyes, hemicyanine dyes and styryl dyes, more preferred are cyanine dyes, merocyanine dyes and rhodacyanine dyes, still more preferred are cyanine dyes. These dyes are described in detail in F. M. Harmer, *Heterocyclic Compounds-Cyanine Dyes and Related Compounds,* John Wiley & Sons, New York, London (1964), D. M. Sturmer, *Heterocyclic Compounds—Special topics in heterocyclic chemistry,* Chap. 18, Section 14, pp. 482–515.

For cyanine dyes, merocyanine dyes and rhodacyanine dyes, formulae (XI), (XII) and (XIII) described in U.S. Pat. No. 5,340,694, columns 21 to 22, are preferred on the condition that the numbers of n12, n15, n17 and n18 are not limited and each is an integer of 0 or more (preferably 4 or less).

In the case where a cyanine dye or a rhodacyanine dye is formed by $Q_1$ or $Q_2$, formulae (I) and (II) may be expressed by the following resonance formulae:

(I)

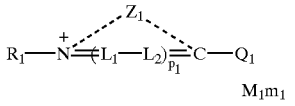

$M_1m_1$ (II)

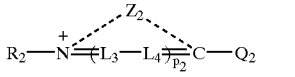

$M_2m_2$

In formulae (I), (II), (IV), (V) and (VI), $Z_1$, $Z_2$, $Z_3$, $Z_4$, $Z_5$, $Z_7$, $Z_9$, $Z_{10}$, $Z_{11}$, $Z_{12}$, $Z_{14}$, $Z_{16}$, $Z_{17}$, $Z_{18}$, $Z_{19}$, $Z_{21}$ and $Z_{23}$ each represents an atomic group necessary for forming a nitrogen-containing heterocyclic ring, preferably a 5- or 6-membered nitrogen-containing heterocyclic ring. However, a ring may be condensed to each of these groups. The ring may be either an aromatic ring or a non-aromatic ring, but an aromatic ring is preferred and examples thereof include hydrocarbon aromatic rings such as benzene ring and naphthalene ring, and heteroaromatic rings such as pyrazine ring and thiophene ring.

Examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus and pyrimidine nucleus. Among these, preferred are benzothiazole nucleus, benzoxazole nucleus, 3,3-dialkylindolenine nucleus (e.g., 3,3-dimethylindolenine), benzimidazole nucleus, 2-pyridine nucleus, 4-pyridine nucleus, 2-quinoline nucleus, 4-quinoline nucleus, 1-isoquinoline nucleus and 3-isoquinoline nucleus; more preferred are benzothiazole nucleus, benzoxazole nucleus, 3,3-dialkylindolenine nucleus (e.g., 3,3-dimethylindolenine) and benzimidazole nucleus; still more preferred are benzoxazole nucleus, benzothiazole nucleus and benzimidazole nucleus; and most preferred are benzoxazole nucleus and benzothiazole nucleus.

Assuming that the substituent on the nitrogen-containing heterocyclic ring is V, the substituent represented by V is not particularly limited, however, examples thereof include a halogen atom (e.g., chlorine, bromine, iodine, fluorine), a mercapto group, a cyano group, a carboxy group, a phosphoric acid group, a sulfo group, a hydroxy group, a carbamoyl group having from 1 to 10, preferably from 2 to 8, more preferably from 2 to 5, carbon atoms (e.g., methylcarbamoyl, ethylcarbamoyl, morpholinocarbonyl), a sulfamoyl group having from 0 to 10, preferably from 2 to 8, more preferably from 2 to 5, carbon atoms (e.g., methylsulfamoyl, ethylsulfamoyl, piperidinosulfonyl), a nitro group, an alkoxy group having from 1 to 20, preferably from 1 to 10, more preferably from 1 to 8, carbon atoms (e.g., methoxy, ethoxy, 2-methoxyethoxy, 2-phenylethoxy), an aryloxy group having from 6 to 20, preferably from 6 to 12, more preferably from 6 to 10, carbon atoms (e.g., phenoxy, p-methylphenoxy, p-cholorphenoxy, naphthoxy), an acyl group having from 1 to 20, preferably from 2 to 12, more preferably from 2 to 8, carbon atoms (e.g., acetyl, benzoyl, trichloroacetyl), an acyloxy group having from 1 to 20, preferably from 2 to 12, more preferably from 2 to 8, carbon atoms (e.g., acetyloxy, benzoyloxy), an acylamino group having from 1 to 20, preferably from 2 to 12, more preferably from 2 to 8, carbon atoms (e.g., acetylamino), a sulfonyl group having from 1 to 20, preferably from 1 to 10, more preferably from 1 to 8, carbon atoms (e.g., methanesulfonyl, ethanesulfonyl, benzenesulfonyl), a sulfinyl group having from 1 to 20, preferably from 1 to 10, more preferably from 1 to 8, carbon atoms (e.g., methanesulfinyl, ethanesulfinyl, benzenesulfinyl), a sulfonylamino group having from 1 to 20, preferably from 1 to 10, more preferably from 1 to 8, carbon atoms (e.g., methanesulfonylamino, ethanesulfonylamino, benzenesulfonylamino), an amino group, a substituted amino group having from 1 to 20, preferably from 1 to 12, more preferably from 1 to 8, carbon atoms (e.g., methylamino, dimethylamino, dibenzylamino, anilino, diphenylamino), an ammonium group having from 0 to 15, preferably from 3 to 10, more preferably from 3 to 6, carbon atoms (e.g., trimethylammonium, triethylammonium), a hydrazino group having from 0 to 15, preferably from 1 to 10, more preferably from 1 to 6, carbon atoms (e.g., trimethylhydrazino), a ureido group having from 1 to 15, preferably from 1 to 10, more preferably from 1 to 6, carbon atoms (e.g., ureido, N,N-dimethylureido), an imido group having from 1 to 15, preferably from 1 to 10, more preferably from 1 to 6, carbon atoms (e.g., succinimido), an alkylthio group having from 1 to 20, preferably from 1 to 12, more preferably from 1 to 8, carbon atoms (e.g., methylthio, ethylthio, propylthio), an arylthio group having from 6 to 20, preferably from 6 to 12, more preferably from 6 to 10, carbon atoms (e.g., phenylthio, p-methylphenylthio, p-chlorophenylthio, 2-pyridylthio, naphthylthio), an alkoxycarbonyl group having from 2 to 20, preferably from 2 to 12, more preferably from 2 to 8, carbon atoms (e.g., methoxycarbonyl, ethoxycarbonyl, 2-benzyloxycarbonyl), an aryloxycarbonyl group having from 6 to 20, preferably from 6 to 12, more preferably from 6 to 10, carbon atoms (e.g., phenoxycarbonyl), an unsubstituted alkyl group having from 1 to 18, preferably from 1 to 10, more preferably from 1 to 5, carbon atoms (e.g., methyl, ethyl, propyl, butyl), a substituted alkyl group having from 1 to 18, preferably from 1 to 10, more preferably from 1 to 5, carbon atoms {e.g., hydroxymethyl, trifluoromethyl, benzyl, carboxyethyl, ethoxycarbonylmethyl, acetylaminomethyl; the substituted alkyl group includes an unsaturated hydrocarbon group having from 2 to 18, preferably from 3 to 10, more preferably from 3 to 5, carbon atoms (e.g., vinyl, ethynyl, 1-cyclohexenyl, benzylidyne, benzylidene)}, a substituted or unsubstituted aryl group having from 6 to 20, preferably from 6 to 15, more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl) and a substituted or unsubstituted heterocyclic group having from 1 to 20, preferably from 2 to 10, more preferably from 4 to 6, carbon atoms (e.g., pyridyl, 5-methylpyridyl, thienyl, furyl, morpholino, tetrahydrofurfuryl). These each may have a structure such that a ring (an aromatic or non-aromatic hydrocarbon or heterocyclic ring, e.g., benzene ring, naphthalene ring, anthracene ring, quinoline ring) is condensed thereto.

The substituent represented by V may be further substituted by V.

Among these substituents, preferred are the alkyl group, the aryl group, the alkoxy group, the halogen atom, the aromatic ring condensation product, the sulfo group, the carboxy group and the hydroxy group.

The substituent V on $Z_1$, $Z_2$, $Z_3$, $Z_4$, $Z_5$, $Z_7$, $Z_9$, $Z_{10}$, $Z_{11}$, $Z_{12}$, $Z_{14}$ and $Z_{16}$ is more preferably the aromatic group and the aromatic ring condensation product.

In the case where the chromophore represented by $D_1$ in formula (III) is the methine dye represented by formula (IV), (V) or (VI), the substituent V on $Z_{17}$, $Z_{18}$, $Z_{19}$, $Z_{21}$ and $Z_{23}$ is more preferably the aromatic group or the aromatic ring condensation product.

In the case where the chromophore represented by $D_2$ in formula (III) is the methine dye represented by formula (IV), (V) or (VI), the substituent V on $Z_{17}$, $Z_{18}$, $Z_{19}$, $Z_{21}$ and $Z_{23}$ is more preferably the carboxy group, the sulfo group or the hydroxy group, still more preferably the sulfo group.

$Z_6$, $Z_{13}$ and $Z_{20}$ each represents an atomic group necessary for forming an acidic nucleus, however, an acidic nucleus form of any general merocyanine dye may also be formed. The term "acidic nucleus" as used herein is defined, for example, in James (compiler), *The Theory of the Photographic Process,* 4th ed., page 198, Macmillan (1977). Specific examples thereof include those described in U.S. Pat. Nos. 3,567,719, 3,575,869, 3,804,634, 3,837,862, 4,002,480 and 4,925,777, and JP-A-3-167546.

The acidic nucleus preferably forms a 5- or 6-membered nitrogen-containing heterocyclic ring comprising carbon, nitrogen and chalcogen (typically oxygen, sulfur, selenium or tellurium) atoms. Examples thereof include the following nuclei:

nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isooxazolin-5-one, 2-thiazolin-4-one, thiazolidin-4-one, thiazolidine-2,4-dione, rhodanine, thiazolidin-2,4-dione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophen-1,1-dioxide and 3-dicyanomethine-2,3-dihydrobenzo[d]thiophen-1,1-dioxide.

$Z_6$, $Z_{13}$ and $Z_{20}$ each is preferably hydantoin, 2- or 4-thiohydantoin, 2-oxazolin-5-one, 2-thiooxazoline-2,4-dione, thiazolidine-2,4-dione, rhodanine, thiazolidine-2,4-dione, barbituric acid or 2-thiobarbituric acid, more preferably hydantoin, 2- or 4-thiohydantoin, 2-oxazolin-5-one, rhodanine, barbituric acid or 2-thiobarbituric acid, still more preferably 2- or 4-thiohydantoin, 2-oxazolin-5-one, rhodanine or barbituric acid.

The 5- or 6-membered nitrogen-containing heterocyclic ring formed by $Z_8$, $Z_{15}$ or $Z_{22}$ is the heterocyclic ring represented by $Z_6$, $Z_{13}$ or $Z_{20}$ from which an oxo or thioxo group is excluded, preferably hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid or 2-thiobarbituric acid from which an oxo or thioxo group is excluded, more preferably hydantoin, 2- or 4-thiohydantoin, 2-oxazolin-5-one, rhodanine, barbituric acid or 2-thiobarbituric acid from which an oxo or thioxo group is excluded, still more preferably 2- or 4-thiohydantoin, 2-oxazolin-5-one or rhodanine from which an oxo or thioxo group is excluded.

$R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$ and $R_{23}$ each represents an alkyl group, an aryl group or a heterocyclic group. Specific examples thereof include an unsubstituted alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, more preferably from 1 to 4, carbon atoms {for example, an alkyl group substituted by the above-described substituent V, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl, aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfoalkenyl group, a sulfatoalkyl group, (e.g., 2-sulfatoethyl, 3-sulfatopropyl, 4-sulfatobutyl), a heterocyclic ring-substituted alkyl group (e.g., 2-(pyrrolidin-2-one-1-yl)ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl)}, an unsubstituted aryl group having from 6 to 20, preferably from 6 to 10, more preferably from 6 to 8, carbon atoms (e.g., phenyl, 1-naphthyl), a substituted aryl group having from 6 to 20, preferably from 6 to 10, more preferably from 6 to 8, carbon atoms (e.g., an aryl group substituted by V described above as examples of the substituent; specifically, p-methoxyphenyl, p-methylphenyl, p-chlorophenyl), an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl) and a substituted heterocyclic group having from 1 to 20, preferably from 3 to 10, more preferably from 4 to 8, carbon atoms (e.g., a heterocyclic group substituted by V described above as examples of the substituent; specifically, 5-methyl-2-thienyl, 4-methoxy-2-pyrimidyl).

$R_1$, $R_3$, $R_4$, $R_5$, $R_6$, $R_7$, $R_8$ and $R_9$ each is preferably a group having an aromatic ring. Examples of the aromatic ring include a hydrocarbon aromatic ring and a heteroaromatic ring. These rings each may be a polycyclic condensation ring resulting from the condensation of hydrocarbon aromatic rings or heteroaromatic rings to each other, or a polycyclic condensation ring resulting from an aromahydrocarbon ring and an aromatic heterocyclic ring being combined. These rings each may be substituted by the above-described substituent V or the like. Preferred examples of the aromatic ring include those described above as examples of the aromatic ring for the aromatic group.

The group having an aromatic ring may also be expressed by —Lb—$A_1$, wherein Lb represents a single bond or a linking group, and $A_1$ represents an aromatic group. Preferred examples of the linking group represented by Lb include the linking groups described above for La and the like. Examples of the aromatic group represented by $A_1$ include those described above as examples of the group having an aromatic ring.

Preferred examples of the group having an aromatic ring containing no anionic group include an alkyl group having a hydrocarbon aromatic ring, such as an aralkyl group (e.g., benzyl, 2-phenylethyl, naphthylmethyl, 2-(4-biphenyl) ethyl), an aryloxyalkyl group (e.g., 2-phenoxyethyl, 2-(1-naphthoxy)ethyl, 2-(4-biphenyloxy)ethyl, 2-(o- , m- or p-halophenoxy)ethyl, 2-(o-, m- or p-methoxy-phenoxy) ethyl) and an aryloxycarbonylalkyl group (e.g., 3-phenoxycarbonylpropyl, 2-(1-naphthoxycarbonyl)ethyl); an alkyl group having a heteroaromatic ring, such as 2-(2-pyridyl)ethyl, 2-(4-pyridyl)ethyl, 2-(2-furyl)ethyl, 2-(2-thenyl)ethyl and 2-(2-pyridylmethoxy)ethyl; a hydrocarbon aromatic group such as 4-methoxyphenyl, phenyl, naphthyl and biphenyl; and a heteroaromatic group such as 2-thienyl, 4-chloro-2-thienyl, 2-pyridyl and 3-pyrazolyl.

Among these, more preferred are the alkyl group having a substituted or unsubstituted hydrocarbon aromatic ring or the heteroaromatic ring, still more preferred are the alkyl group having a substituted or unsubstituted hydrocarbon aromatic ring.

$R_2$, $R_{10}$, $R_{11}$, $R_{12}$, $R_{13}$, $R_{14}$, $R_{15}$ and $R_{16}$ each is preferably a group having an aromatic ring. Both of $R_{10}$ and $R_{11}$, at least one of $R_{12}$ and $R_{13}$, and at least one of $R_{14}$, $R_{15}$ and $R_{16}$ have an anionic substituent. $R_2$ preferably has an anionic substituent. Examples of the aromatic ring include a hydrocarbon aromatic ring and a heteroaromatic ring. These rings each may be a polycyclic condensation ring resulting from the condensation of hydrocarbon aromatic rings or heteroaromatic rings to each other, or a polycyclic condensation ring resulting from an aromahydrocarbon ring and an aromatic heterocyclic ring being combined. These rings each may be substituted by the above-described substituent V or the like. Preferred examples of the aromatic ring include those described above as examples of the aromatic ring for the aromatic group.

The group having an aromatic ring may also be expressed by —Lc—$A_2$, wherein Lc represents a single bond or a linking group, and $A_2$ represents an aromatic group. Preferred examples of the linking group represented by Lc include the linking groups described for La. Preferred examples of the aromatic group represented by $A_2$ include those described above as examples of the aromatic group. Lc or $A_2$ is preferably substituted by at least one anionic substituent.

Preferred examples of the group having an aromatic ring substituted by an anionic substituent include an alkyl group having a hydrocarbon aromatic ring, such as an aralkyl group substituted by a sulfo group, a phosphoric acid group or a carboxyl group (e.g., 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl, 4-phosphobenzyl), an aryloxycarbonylalkyl group substituted by a sulfo group, a phosphoric acid group or a carboxyl group (e.g., 3-sulfophenoxycarbonylpropyl) and an aryloxyalkyl group substituted by a sulfo group, a phosphoric acid group or a carboxyl group (e.g., 2-(4-sulfophenoxy)ethyl, 2-(2-phosphenoxy)ethyl, 4,4-diphenoxy-3-sulfobutyl);

an alkyl group having a heteroaromatic ring, such as 3-(2-pyridyl)-3-sulfopropyl, 3-(2-furyl)-3-sulfopropyl and 2-(2-thienyl)-2-sulfopropyl;

an aryl group having a hydrocarbon aromatic group, such as an aryl group substituted by a sulfo group, a phosphoric acid group or a carboxyl group (e.g., 4-sulfophenyl, 4-sulfonaphthyl); and a heteroaromatic group such as a heteroaromatic group substituted by a sulfo group, a phosphoric acid group or a carboxyl group (e.g., 4-sulfo-2-thenyl, 4-sulfo-2-pyridyl).

Among these, more preferred are the alkyl group having a hydrocarbon aromatic or heteroaromatic group substituted by a sulfo group, a phosphoric acid group or a carboxyl group, still more preferred is the alkyl group having a hydrocarbon aromatic ring substituted by a sulfo group, a phosphoric acid group or a carboxyl group, and most preferred are 2-sulfobenzyl, 4-sulfobenzyl, 4-sulfo-phenethyl, 3-phenyl-3-sulfopropyl and 4-phenyl-4-sulfobutyl.

In the case where the chromophore represented by $D_1$ in formula (III) is the methine dye represented by formula (IV), (V) or (VI), the substituents represented by $R_{17}$, $R_{18}$, $R_{19}$, $R_{20}$, $R_{21}$, $R_{22}$ and $R_{23}$ each is preferably the above-described unsubstituted alkyl group or substituted alkyl group (an alkyl group such as carboxyalkyl, sulfoalkyl, aralkyl and aryloxyalkyl).

In the case where the chromophore represented by $D_2$ in formula (III) is the methine dye represented by formula (IV), (V) or (VI), the substituents represented by $R_{17}$, $R_{18}$, $R_{19}$, $R_{20}$, $R_{21}$, $R_{22}$ and $R_{23}$ each is preferably the above-described unsubstituted alkyl group or substituted alkyl group, more preferably an alkyl group having an anionic substituent (an alkyl group such as carboxyalkyl and sulfoalkyl), still more preferably a sulfoalkyl group.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$, $L_{55}$, $L_{56}$, $L_{57}$, $L_{58}$, $L_{59}$, $L_{60}$, $L_{61}$, $L_{62}$, $L_{63}$ and $L_{64}$ each independently represents a methine group. The methine group represented by $L_1$ to $L_{64}$ may have a substituent. Examples of the substituent include V described above, such as a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6 to 20, preferably from 6 to 12, more preferably from 6 to 10, carbon atoms (e.g., phenylthio, p-methylphenylthio). A ring may be formed with another methine group or a ring may be formed together with $Z_1$ to $Z_{23}$ or $R_1$ to $R_{23}$.

$L_1$, $L_2$, $L_3$, $L_4$, $L_5$, $L_6$, $L_{10}$, $L_{11}$, $L_{12}$, $L_{13}$, $L_{16}$, $L_{17}$, $L_{23}$, $L_{24}$, $L_{25}$, $L_{26}$, $L_{30}$, $L_{31}$, $L_{32}$, $L_{33}$, $L_{36}$, $L_{37}$, $L_{43}$, $L_{44}$, $L_{45}$, $L_{46}$, $L_{50}$, $L_{51}$, $L_{52}$, $L_{53}$, $L_{56}$, $L_{57}$, $L_{63}$ and $L_{64}$ each is preferably an unsubstituted methine group.

$n_1$, $n_2$, $n_3$, $n_4$, $n_5$, $n_6$, $n_7$, $n_8$, $n_9$, $n_{10}$, $n_{11}$ and $n_{12}$ each independently represents 0, 1, 2, 3 or 4, preferably 0, 1, 2 or 3, more preferably 0, 1 or 2, still more preferably 0 or 1. When $n_1$, $n_2$, $n_3$, $n_4$, $n_5$, $n_6$, $n_7$, $n_8$, $n_9$, $n_{10}$, $n_{11}$ and $n_{12}$ each is 2 or more, the methine group is repeated but these methine groups need not be the same.

$p_1$, $p_2$, $p_3$, $p_4$, $p_5$, $p_6$, $p_7$, $p_8$, $p_9$, $p_{10}$, $p_{11}$, $p_{12}$, $p_{13}$, $p_{14}$, $p_{15}$ and $p_{16}$ each independently represents 0 or 1, preferably 0.

$M_1$, $M_2$, $M_3$, $M_4$, $M_5$ and $M_6$ each is included in the formulae so as to show the presence of a cation or anion when the ion charge of the dye is necessary to be neutralized. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkyl-ammonium ion, pyridinium ion, ethylpyridinium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a reverse charge to the dye may be used. When hydrogen ion is the counter ion, $CO_2^-$ and $SO_3^-$ may be denoted as $CO_2H$ and $SO_3H$, respectively.

$m_1$, $m_2$, $m_3$, $m_4$, $m_5$ and $m_6$ each represents a number of 0 or greater necessary for balancing the electric charge, preferably a number of from 0 to 4, more preferably from 0 to 1, and is 0 when an inner salt is formed.

Specific examples only of the dyes used in preferred techniques described in Detailed Description of the Invention are set forth below, however, needless to say, the present invention is by no means limited thereto.

Specific Examples of Compound Represented by Formula (I) of the Present Invention (Including Lower Concept Structures)

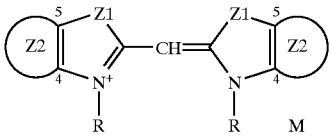

| No. | Z1 | Z2 | R | M |
|---|---|---|---|---|
| I-1 | S | 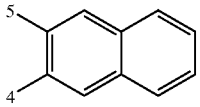 | $(CH_2)_2OC_6H_5$ | $p\text{-}CH_3C_6H_4SO_3^-$ |
| I-2 | S | 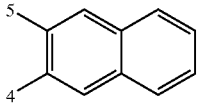 | $(CH_2)_2O(CH_2)_2O(CH_2)_2OC_6H_5$ | $p\text{-}CH_3C_6H_4SO_3^-$ |
| I-3 | S | 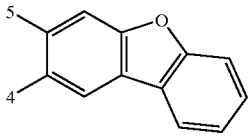 | 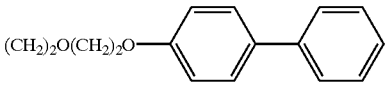 | $p\text{-}CH_3C_6H_4SO_3^-$ |
| I-4 | S | 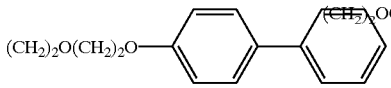 | $(CH_2)_2OC_6H_5$ | $p\text{-}CH_3C_6H_4SO_3^-$ |

-continued
| | | | | |
|---|---|---|---|---|
| I-5 | S | 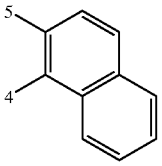 | $(CH_2)_2OC_6H_5$ | $p\text{-}CH_3C_6H_4SO_3^-$ |
| I-6 | S | 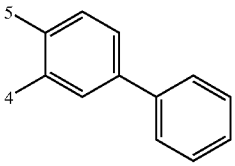 | $(CH_2)_2O(CH_2)_2O(CH_2)_2OC_6H_5$ | $p\text{-}CH_3C_6H_4SO_3^-$ |
| I-7 | S | 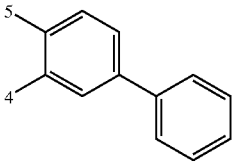 | 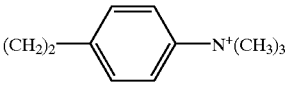 | $3Br^-$ |
| I-8 | S | 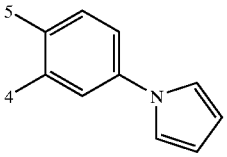 | $(CH_2)_2OC_6H_5$ | $p\text{-}CH_3C_6H_4SO_3^-$ |
| I-9 | S | 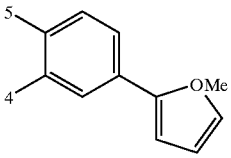 | $(CH_2)_2OC_6H_5$ | $p\text{-}CH_3C_6H_4SO_3^-$ |
| I-10 | O | 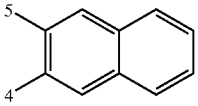 | $(CH_2)_2OC_6H_5$ | $p\text{-}CH_3C_6H_4SO_3^-$ |
| I-11 | O | 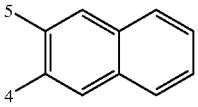 | $(CH_2)_2O(CH_2)_2O(CH_2)_2OC_6H_5$ | $p\text{-}CH_3C_6H_4SO_3^-$ |
| I-12 | O | 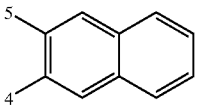 | 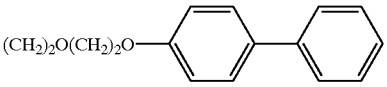 | $p\text{-}CH_3C_6H_4SO_3^-$ |
| I-13 | O | 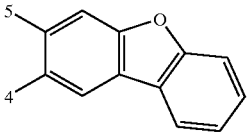 | 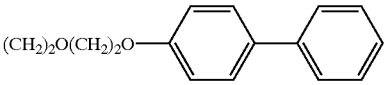 | $p\text{-}CH_3C_6H_4SO_3^-$ |
| I-14 | O | 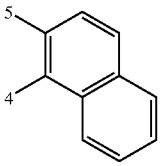 | $(CH_2)_2OC_6H_5$ | $p\text{-}CH_3C_6H_4SO_3^-$ |

-continued
| | | | | |
|---|---|---|---|---|
| I-15 | O | 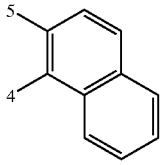 | $(CH_2)_2OC_6H_4Br$ | p-$CH_3C_6H_4SO_3^-$ |
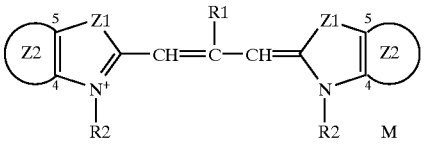
| No. | Z1 | Z2 | R1 | R2 | M |
|---|---|---|---|---|---|
| I-16 | S | 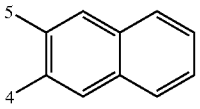 | $C_2H_5$ | $(CH_2)_3OC_6H_5$ | p-$CH_3C_6H_4SO_3^-$ |
| I-17 | S | 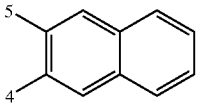 | $C_2H_5$ | $\left[(CH_2)_2O\right]_3$—Ph | p-$CH_3C_6H_4SO_3^-$ |
| I-18 | S | 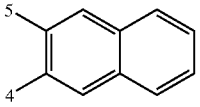 | $C_2H_5$ | $(CH_2)_2OC_6H_5$ | $Br^-$ |
| I-19 | S | 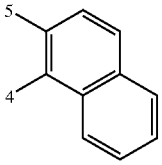 | $C_2H_5$ | $(CH_2)_2OC_6H_5$ | p-$CH_3C_6H_4SO_3^-$ |
| I-20 | S | 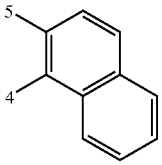 | $C_2H_5$ | $(CH_2)_2O(CH_2)_2O$— 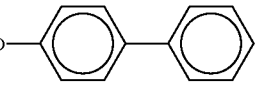 | p-$CH_3C_6H_4SO_3^-$ |
| I-21 | S | 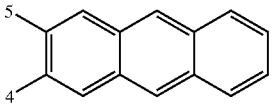 | $C_2H_5$ | $(CH_2)_2O(CH_2)_2O$— 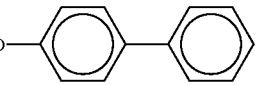 | p-$CH_3C_6H_4SO_3^-$ |
| I-22 | S | 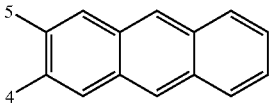 | $C_2H_5$ | $(CH_2)_2OC_6H_4OCH_3$-p | p-$CH_3C_6H_4SO_3^-$ |
| I-23 | S | 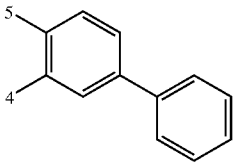 | $C_2H_5$ | $(CH_2)_2O(CH_2)_2O(CH_2)_2O$—Ph | p-$CH_3C_6H_4SO_3^-$ |

-continued
| | | | | | |
|---|---|---|---|---|---|
| I-24 | S | 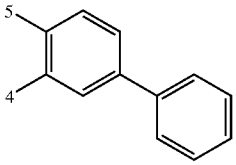 | $C_2H_5$ | 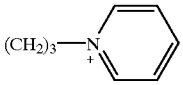 | 3p-$ClC_6H_4SO_3^-$ |
| I-25 | S | 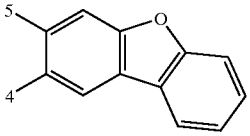 | $C_2H_5$ | $(CH_2)_3OC_6H_5$ | p-$CH_3C_6H_4SO_3^-$ |
| I-26 | S | 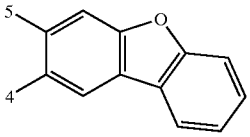 | $C_2H_5$ | $(CH_2)_2O(CH_2)_2OPh$ | p-$CH_3C_6H_4SO_3^-$ |
| I-27 | S | 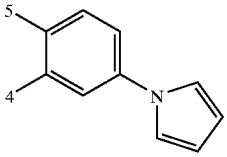 | $C_2H_5$ | 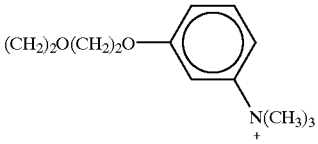 | $3I^-$ |
| I-28 | S | 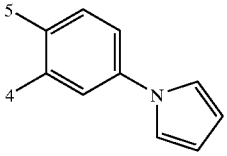 | $C_2H_5$ | $(CH_2)_3OC_6H_5$ | $I^-$ |
| I-29 | S | 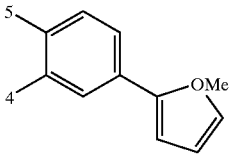 | $C_2H_5$ | 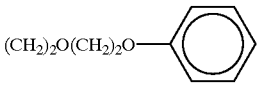 | p-$CH_3C_6H_4SO_3^-$ |
| I-30 | S | 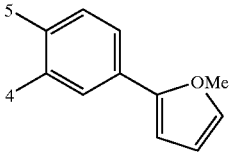 | $C_2H_5$ | $(CH_2)_2OC_6H_5$ | p-$CH_3C_6H_4SO_3^-$ |
| I-31 | S | 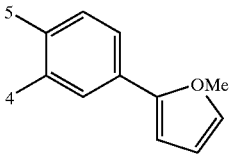 | $C_2H_5$ | 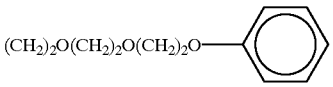 | p-$CH_3C_6H_4SO_3^-$ |
| I-32 | S | 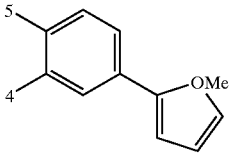 | $CH_3$ | 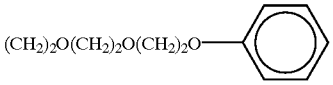 | p-$ClC_6H_4SO_3^-$ |

-continued
| | | | | | |
|---|---|---|---|---|---|
| I-33 | O | 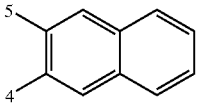 | $C_2H_5$ | $(CH_2)_3OC_6H_5$ | p-$CH_3C_6H_4SO_3^-$ |
| I-34 | O | 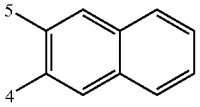 | $C_2H_5$ | $(CH_2)_2O(CH_2)_2O(CH_2)_2OPh$ | p-$CH_3C_6H_4SO_3^-$ |
| I-35 | O | 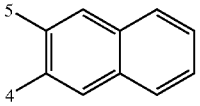 | $C_2H_5$ | $(CH_2)_2OC_6H_5$ | p-$CH_3C_6H_4SO_3^-$ |
| I-36 | O | 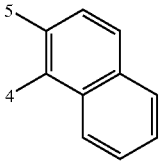 | $C_2H_5$ | $(CH_2)_2OC_6H_5$ | p-$CH_3C_6H_4SO_3^-$ |
| I-37 | O | 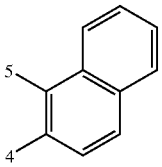 | $C_2H_5$ | $(CH_2)_2OC_6H_5$ | $I^-$ |
| I-38 | O | 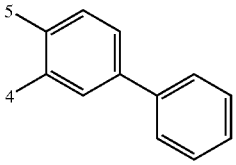 | $C_2H_5$ | $(CH_2)_2OC_6H_5$ | $I^-$ |
| I-39 | O | 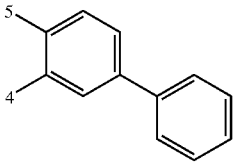 | $C_2H_5$ | $(CH_2)_2O(CH_2)_2O$ 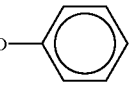 | $I^-$ |
| I-40 | O | 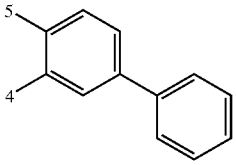 | $C_2H_5$ | $(CH_2)_2O(CH_2)_2OPh$ | $I^-$ |
| I-41 | O | 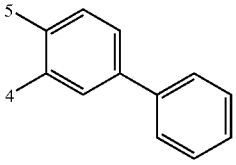 | $C_2H_5$ | $(CH_2)_2O(CH_2)_2O$ 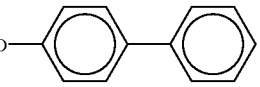 | p-$CH_3C_6H_4SO_3^-$ |
| I-42 | O | 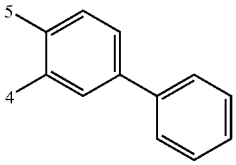 | $C_2H_5$ | $(CH_2)_2O$ 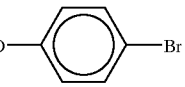 Br | p-$CH_3C_6H_4SO_3^-$ |

-continued
| | | | | | |
|---|---|---|---|---|---|
| I-43 | O | 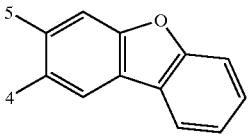 | $C_2H_5$ | $(CH_2)_2OC_6H_5$ | p-$CH_3C_6H_4SO_3^-$ |
| I-44 | O | 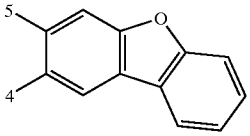 | $C_2H_5$ | $(CH_2)_2OC_6H_4OCH_3$-p | p-$CH_3C_6H_4SO_3^-$ |
| I-45 | O | 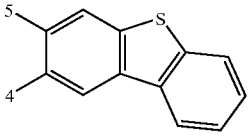 | $C_2H_5$ | $(CH_2)_2OC_6H_5$ | p-$CH_3C_6H_4SO_3^-$ |
| I-46 | O | 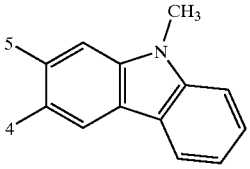 | $C_2H_5$ | $(CH_2)_2OC_6H_5$ | p-$CH_3C_6H_4SO_3^-$ |
| I-47 | O | 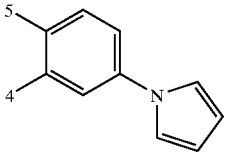 | $C_2H_5$ | $(CH_2)_2OC_6H_5$ | p-$CH_3C_6H_4SO_3^-$ |
| I-48 | O | 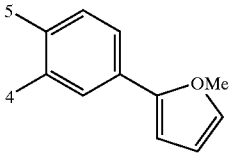 | $C_2H_5$ | $(CH_2)_2OC_6H_5$ | p-$CH_3C_6H_4SO_3^-$ |
| I-49 | O | 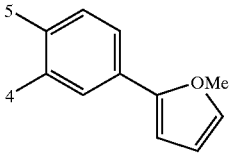 | $C_2H_5$ | $(CH_2)_2O(CH_2)_2O$- 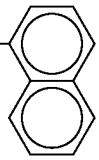 | p-$CH_3C_6H_4SO_3^-$ |
| I-50 | O | 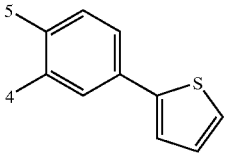 | $CH_3$ | $(CH_2)_2OC_6H_5$ | p-$CH_3C_6H_4SO_3^-$ |

-continued
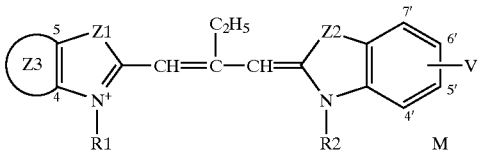
| No. | Z1 | Z3 | Z2 | V | R1 | R2 | M |
|---|---|---|---|---|---|---|---|
| I-51 | S | 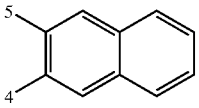 | O | 5',6'-benzo | $(CH_2)_2O(CH_2)_2OPh$ | $(CH_2)_2O(CH_2)_2OPh$ | $p\text{-}CH_3C_6H_4SO_3^-$ |
| I-52 | S | 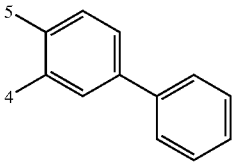 | O | 5'-Ph | $(CH_2)_2OC_6H_6$ | $(CH_2)_2OC_6H_6$ | $p\text{-}CH_3C_6H_4SO_3^-$ |
| I-53 | S | 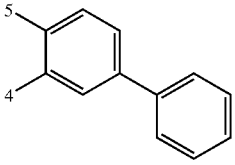 | O | 5',6'-benzo | $(CH_2)_2OC_6H_6$ | $(CH_2)_2OC_6H_6$ | $Br^-$ |
| I-54 | S | 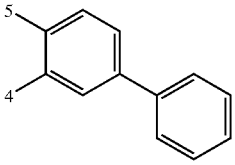 | O | 5'-(2'-Furyl) | $(CH_2)_2OC_6H_6$ | $(CH_2)_2OC_6H_4C_6H_{53}\text{-}p$ | $p\text{-}ClC_6H_4SO_3^-$ |
| I-55 | S | 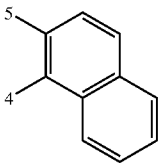 | O | 4',5'-benzo | $(CH_2)_2OC_6H_6$ | $(CH_2)_2OC_6H_6$ | $p\text{-}CH_3C_6H_4SO_3^-$ |
| I-56 | S | 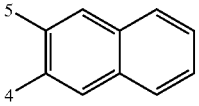 | O | 5'-Ph | $(CH_2)_2OC_6H_6$ | $(CH_2)_2OC_6H_6$ | $p\text{-}CH_3C_6H_4SO_3^-$ |
| I-57 | S | 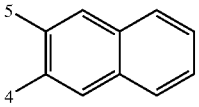 | O | 5'-(2'-Thienyl) | $(CH_2)_2OC_6H_4OCH_3\text{-}p$ | $(CH_2)_2OC_6H_6$ | $p\text{-}CH_3C_6H_4SO_3^-$ |

-continued
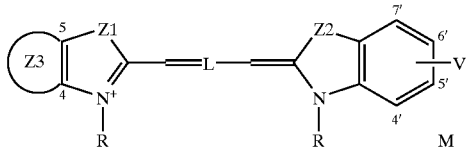
| No. | Z1 | Z3 | Z2 | V | L | R | M |
|---|---|---|---|---|---|---|---|
| I-58 | S | 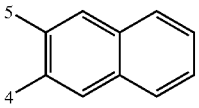 | S | 5',6'-benzo | =CH—CH=CH— | $(CH_2)_2OC_6H_6$ | p-$CH_3C_6H_4SO_3^-$ |
| I-59 | O | 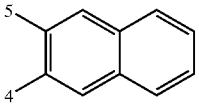 | O | 5',6'-benzo | 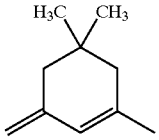 | $(CH_2)_2OC_6H_6$ | p-$CH_3C_6H_4SO_3^-$ |
| I-60 | S | 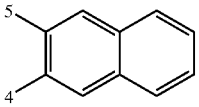 | S | 5'-Ph | 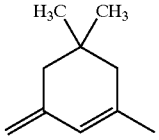 | $(CH_2)_2OC_6H_4OCH_3$-p | p-$CH_3C_6H_4SO_3^-$ |
| I-61 | S | 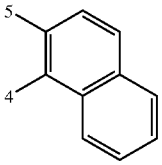 | S | 4',5'-benzo | =CH—CH=CH— | $(CH_2)_2OC_6H_5$ | p-$CH_3C_6H_4SO_3^-$ |
| I-62 | S | 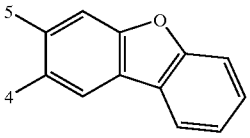 | S | 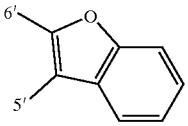 | 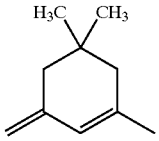 | $(CH_2)_2OC_6H_5$ | p-$CH_3C_6H_4SO_3^-$ |
| I-63 | O | 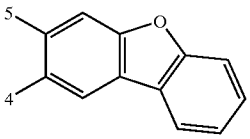 | O | 4',5'-benzo | 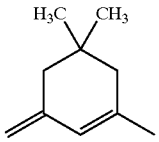 | $(CH_2)_4OC_6H_6$ | p-$CH_3C_6H_4SO_3^-$ |
| I-64 | O | 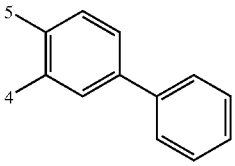 | O | 5'-Ph | 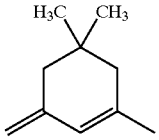 | $(CH_2)_2OC_6H_6$ | p-$CH_3C_6H_4SO_3^-$ |
| I-65 | O | 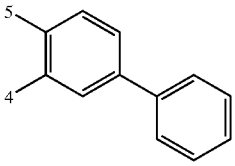 | S | 5'-Ph | 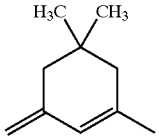 | $(CH_2)_2OC_6H_6$ | p-$CH_3C_6H_4SO_3^-$ |

-continued
| | | | | | | | |
|---|---|---|---|---|---|---|---|
| I-66 | O | 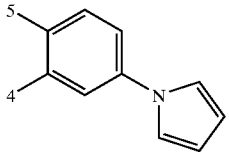 | O | 4',5'-benzo | 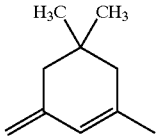 | $(CH_2)_2OC_6H_6$ | $p\text{-}CH_3C_6H_4SO_3^-$ |
I-67
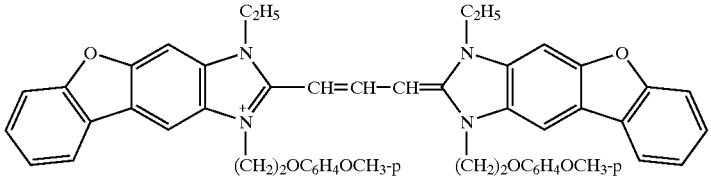
$p\text{-}CH_3C_6H_4SO_3^-$
I-68
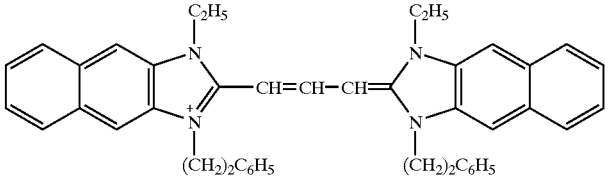
$p\text{-}CH_3C_6H_4SO_3^-$
I-69
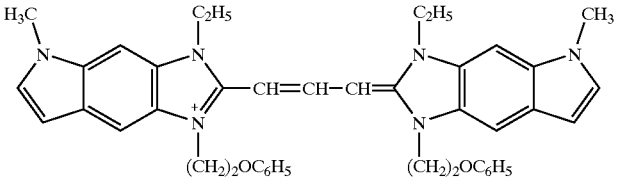
$p\text{-}CH_3C_6H_4SO_3^-$
I-70
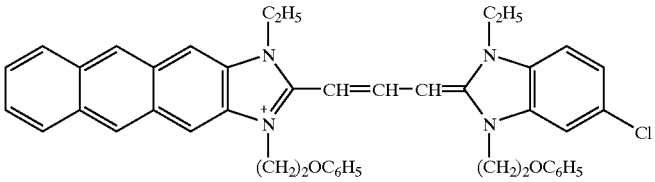
$p\text{-}CH_3C_6H_4SO_3^-$
I-71
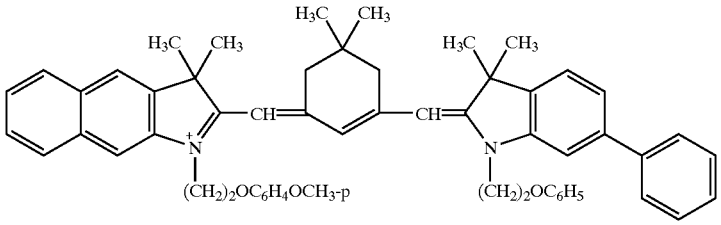
$I^-$ -continued
I-72
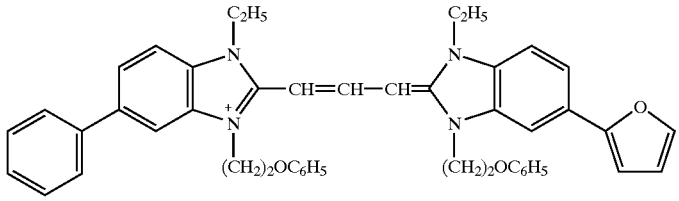
p-$CH_3C_6H_4SO_3^-$
I-73
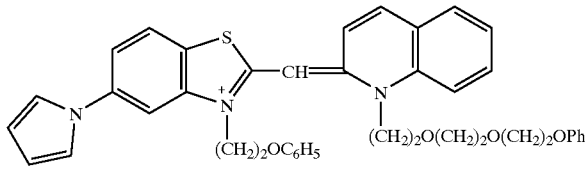
p-$CH_3C_6H_4SO_3^-$
I-74
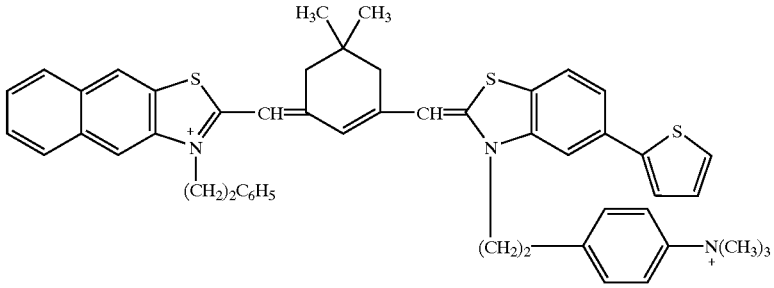
3Br
Specific Examples of Compound Represented by Formula (II) of the Present invention (Including Lower Concept Structures)
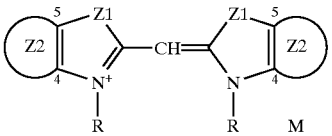
| No. | Z1 | Z2 | R | M |
|---|---|---|---|---|
| II-1 | S | 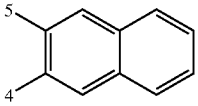 | $CH_2C_6H_4SO_3^-$-p | $HN^+(C_2H_5)_3$ |
| II-2 | S | 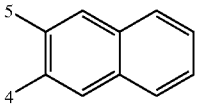 | $(CH_2)_2CH(SO_3^-)Ph$ | $HN^+(C_2H_5)_3$ |

-continued
| | | | | |
|---|---|---|---|---|
| II-3 | S | 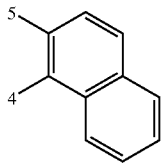 | $CH_2C_6H_4SO_3^-$-o | $HN^+(C_2H_5)_3$ |
| II-4 | S | 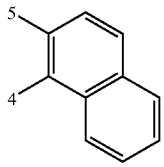 | 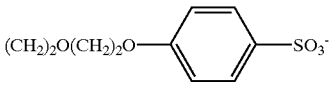 | $Na^+$ |
| II-5 | S | 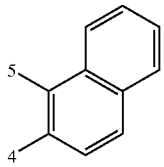 | $CH_2C_6H_4SO_3^-$-o | $HN^+(C_2H_5)_3$ |
| II-6 | S | 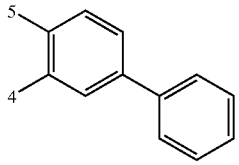 | 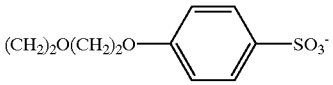 | $HN^+(C_2H_5)_3$ |
| II-7 | S | 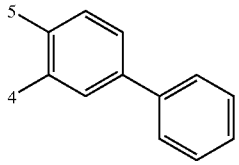 | $(CH_2)_2CH(SO_3^-)Ph$ | $HN^+(C_2H_5)_3$ |
| II-8 | S | 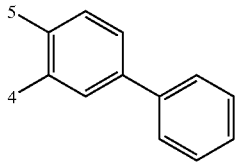 | $CH_2C_6H_4SO_3^-$-o | $HN^+(C_2H_5)_3$ |
| II-9 | O | 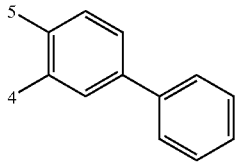 | $CH_2C_6H_4SO_3^-$-o | $HN^+(C_2H_5)_3$ |
| II-10 | O | 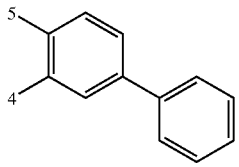 | $(CH_2)_2CH(SO_3^-)Ph$ | $HN^+(C_2H_5)_3$ |

-continued
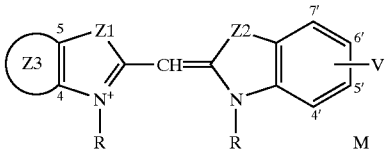
| No. | Z1 | Z3 | Z2 | V | R | M |
|---|---|---|---|---|---|---|
| II-11 | S | 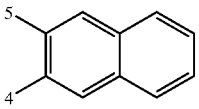 | O | 5',6'-benzo | $CH_2C_6H_4SO_3^-$-o | $HN^+(C_2H_5)_3$ |
| II-12 | O | 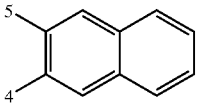 | O | 5'-(2-Thienyl) | $CHC_6H_3$-2,4-di$SO_3^-$ | $3Na^+$ |
| II-13 | S | 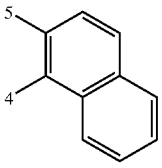 | O | 5'-(2-Furyl) | 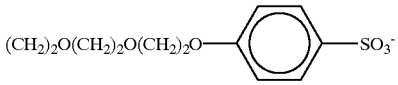 | $HN^+(C_2H_5)_3$ |
| II-14 | S | 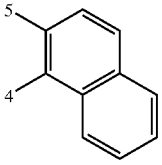 | O | 5'-Ph | 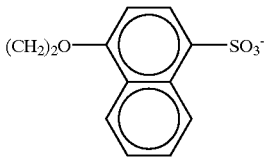 | $HN^+(C_2H_5)_3$ |
| II-15 | S | 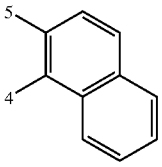 | O | 4',5'-benzo | $(CH_2)_2C_6H_4SO_3^-$-o | $HN^+(C_2H_5)_3$ |
| II-16 | S | 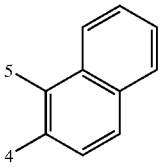 | O | 5'-Ph | $CHC_6H_3$-2,4-di$SO_3^-$ | $3HN^+(C_2H_5)_3$ |
| II-17 | S | 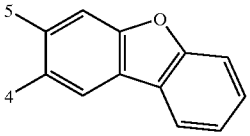 | O | 5',6'-benzo | $CH_2C_6H_4SO_3^-$-o | $HN^+(C_2H_5)_3$ |
| II-18 | S | 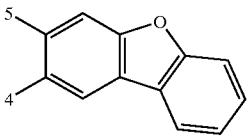 | O | 5'-Ph | 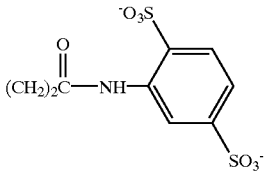 | $3Na^+$ |

-continued
| | | | | | | |
|---|---|---|---|---|---|---|
| II-19 | O | 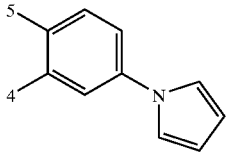 | O | 4',5'-benzo | $CH_2C_6H_4SO_3^-$-o | $3Na^+$ |
| II-20 | S | 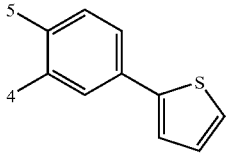 | O | 5'-Ph | $(CH_2)_2C_6H_4SO_3^-$-p | $Na^+$ |
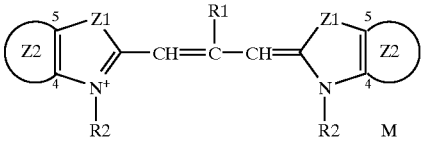
| No. | Z1 | Z2 | R1 | R2 | M |
|---|---|---|---|---|---|
| II-21 | S | 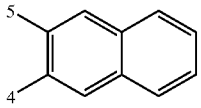 | $C_2H_5$ | $CH_2C_6H_4SO_3^-$-o | $HN^+(C_2H_5)_3$ |
| II-22 | S | 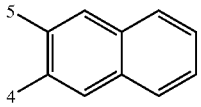 | $C_2H_5$ | 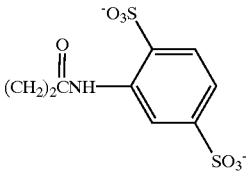 | $3Na^+$ |
| II-23 | S | 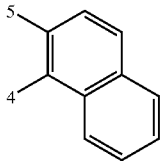 | $C_2H_5$ | $CH_2C_6H_4SO_3^-$-o | $HN^+(C_2H_5)_3$ |
| II-24 | S | 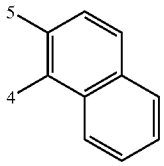 | $C_2H_5$ | $CHC_6H_3$-2,4-di$SO_3^-$ | $3Na^+$ |
| II-25 | S | 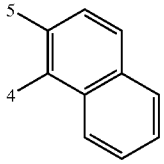 | $C_2H_5$ | $(CH_2)_2CH(SO_3^-)Ph$ | $HN^+(C_2H_5)_3$ |
| II-26 | S | 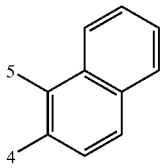 | $C_2H_5$ | $CH_2C_6H_4SO_3^-$-o | $HN^+(C_2H_5)_3$ |

-continued
| | | | | | |
|---|---|---|---|---|---|
| II-27 | S | 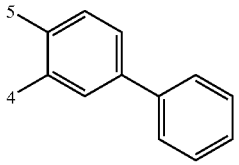 | $C_2H_5$ | $(CH_2)_2CH(SO_3^-)Ph$ | $HN^+(C_2H_5)_3$ |
| II-28 | S | 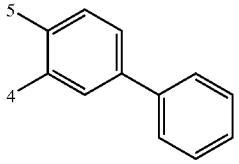 | $C_2H_5$ | $CH_2C_6H_4SO_3^-$-o | $HN^+(C_2H_5)_3$ |
| II-29 | S | 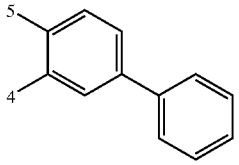 | $C_2H_5$ | 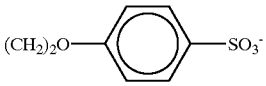 | $HN^+(C_2H_5)_3$ |
| II-30 | S | 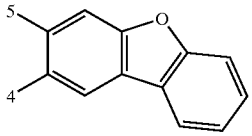 | $C_2H_5$ | $CH_2C_6H_4SO_3^-$-o | $HN^+(C_2H_5)_3$ |
| II-31 | S | 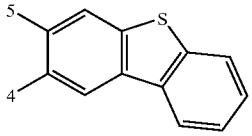 | $C_2H_5$ | $CH_2C_6H_4SO_3^-$-o | $HN^+(C_2H_5)_3$ |
| II-32 | S | 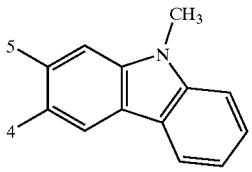 | $C_2H_5$ | $CH_2C_6H_4SO_3^-$-o | $HN^+(C_2H_5)_3$ |
| II-33 | S | 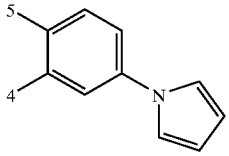 | $C_2H_5$ | $(CH_2)_2CH(SO_3^-)Ph$ | $HN^+(C_2H_5)_3$ |
| II-34 | S | 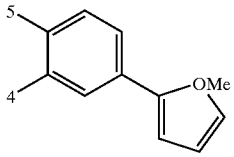 | $C_2H_5$ | $(CH_2)_2CH(SO_3^-)Ph$ | $HN^+(C_2H_5)_3$ |
| II-35 | S | 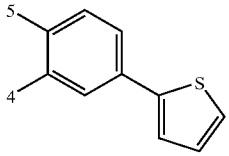 | $C_2H_5$ | $CH_2C_6H_4SO_3^-$-o | $HN^+(C_2H_5)_3$ |

-continued
| | | | | | |
|---|---|---|---|---|---|
| II-36 | S | 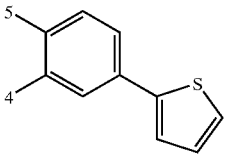 | $C_2H_5$ | $(CH_2)_2C_6H_4SO_3^-Ph$ | $Na^+$ |
| II-37 | S | 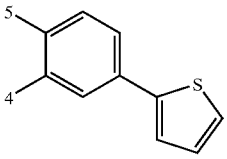 | $CH_3$ | 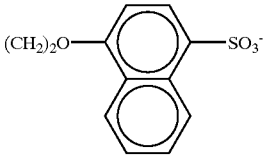 | $HN^+(C_2H_5)_3$ |
| II-38 | O | 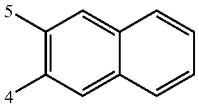 | $C_2H_5$ | $CH_2C_6H_4SO_3^-$-o | $HN^+(C_2H_5)_3$ |
| II-39 | O | 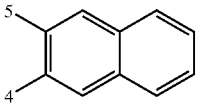 | $C_2H_5$ | $(CH_2)_2CH(SO_3^-)Ph$ | $HN^+(C_2H_5)_3$ |
| II-40 | O | 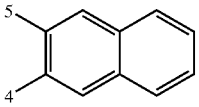 | $C_2H_5$ | 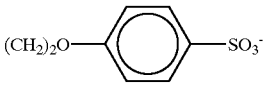 | $HN^+(C_2H_5)_3$ |
| II-41 | O | 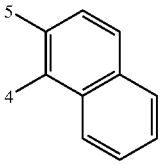 | $C_2H_5$ | $CH_2C_6H_4SO_3^-$-o | $HN^+(C_2H_5)_3$ |
| II-42 | O | 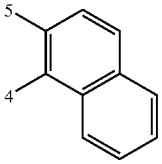 | $C_2H_5$ | $(CH_2)_2CH(SO_3^-)Ph$ | $HN^+(C_2H_5)_3$ |
| II-43 | O | 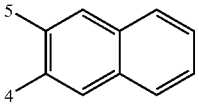 | $C_2H_5$ | 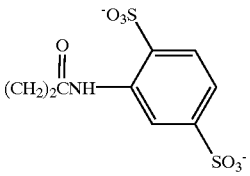 | $3HN^+(C_2H_5)_3$ |
| II-44 | O | 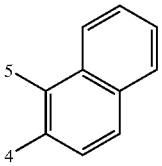 | $C_2H_5$ | $(CH_2)_2CH(SO_3^-)Ph$ | $Na^+$ |
| II-45 | O | 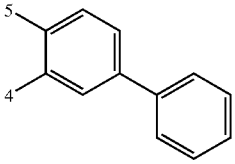 | $C_2H_5$ | $CH_2C_6H_4SO_3^-$-o | $HN^+(C_2H_5)_3$ |

-continued
| | | | | | |
|---|---|---|---|---|---|
| II-46 | O | 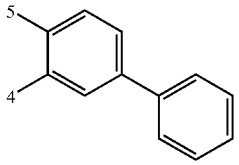 | $C_2H_5$ | 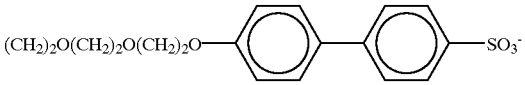 | $HN^+(C_2H_5)_3$ |
| II-47 | O | 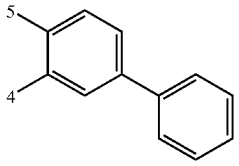 | $C_2H_5$ | 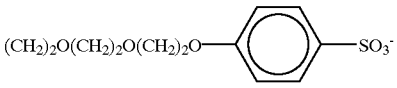 | $HN^+(C_2H_5)_3$ |
| II-48 | O | 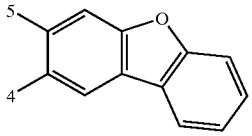 | $C_2H_5$ | $CH_2C_6H_4SO_3^-$-o | $HN^+(C_2H_5)_3$ |
| II-49 | O | 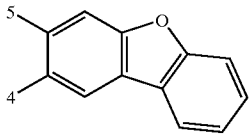 | $C_2H_5$ | $(CH_2)_2CH(SO_3^-)Ph$ | $HN^+(C_2H_5)_3$ |
| II-50 | O | 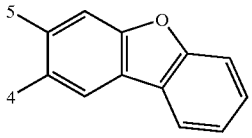 | $C_2H_5$ | 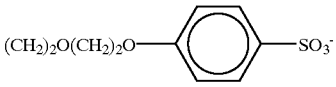 | $HN^+(C_2H_5)_3$ |
| II-51 | O | 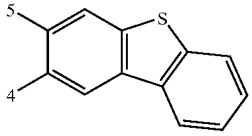 | $C_2H_5$ | $CH_2C_6H_4SO_3^-$-o | $HN^+(C_2H_5)_3$ |
| II-52 | O | 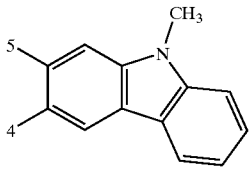 | $C_2H_5$ | $CH_2C_6H_4SO_3^-$-o | $HN^+(C_2H_5)_3$ |
| II-53 | O | 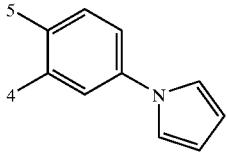 | $C_2H_5$ | $CH_2C_6H_4SO_3^-$-o | $HN^+(C_2H_5)_3$ |
| II-54 | O | 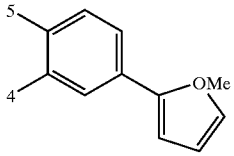 | $C_2H_5$ | $CH_2C_6H_4SO_3^-$-o | $HN^+(C_2H_5)_3$ |

-continued
| | | | | | |
|---|---|---|---|---|---|
| II-55 | O | 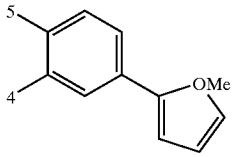 | $C_2H_5$ | 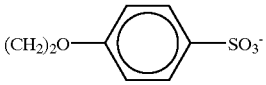 | $HN^+(C_2H_5)_3$ |
| II-56 | O | 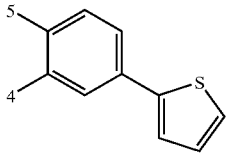 | $C_2H_5$ | $(CH_2)_2CH(SO_3^-)Ph$ | $HN^+(C_2H_5)_3$ |
| II-57 | O | 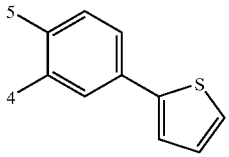 | $CH_3$ | 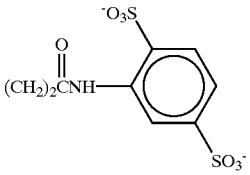 | $Na^+$ |
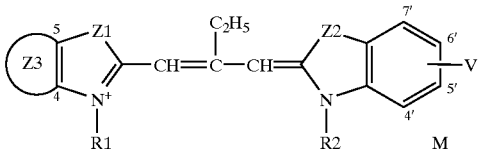
| No. | Z1 | Z3 | Z2 | V | R1 |
|---|---|---|---|---|---|
| II-58 | S | 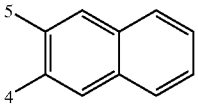 | O | 5',6'-benzo | $CH_2C_6H_4SO_3^-$-o |
| II-59 | S | 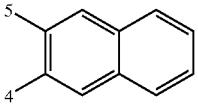 | O | 5',6'-benzo | $(CH_2)_2CH(SO_3^-)Ph$ |
| II-60 | S | 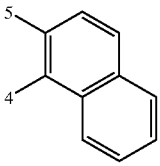 | O | 5'-Ph | $CH_2C_6H_4SO_3^-$-o |
| II-61 | S | 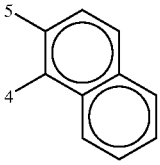 | O | 6',7'-benzo | 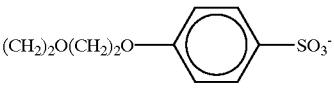 |
| II-62 | S | 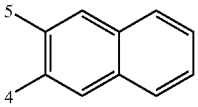 | O | 5'-Ph | $CH_2C_6H_4SO_3^-$-o |

-continued
| | | | | | |
|---|---|---|---|---|---|
| II-63 | S | 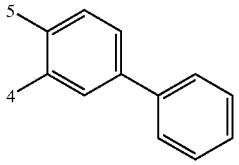 | O | 5'-Ph | $CH_2C_6H_4SO_3^-$-o |
| II-64 | S | 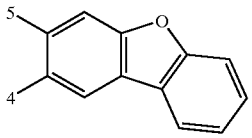 | O | 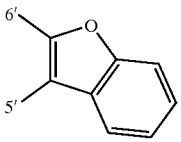 | $CH_2C_6H_4SO_3^-$-o |
| II-65 | S | 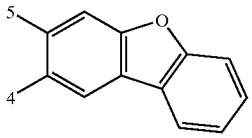 | O | 5'-Ph | $(CH_2)_2CH(SO_3^-)Ph$ |
| II-66 | S | 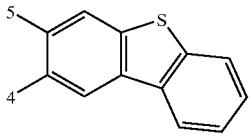 | O | 5'-Ph | $(CH_2)_2CH(SO_3^-)Ph$ |
| II-67 | S | 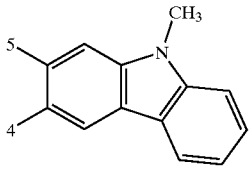 | O | 5'-(2-Furyl) | $(CH_2)_2CH(SO_3^-)Ph$ |
| II-68 | S | 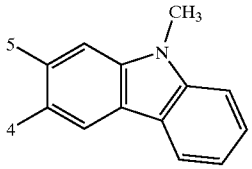 | O | 5'-Ph | $(CH_2)_2CH(SO_3^-)Ph$ |
| II-69 | S | 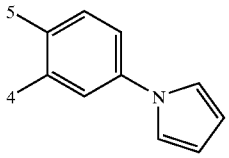 | O | 5'-Ph | $(CH_2)_2CH(SO_3^-)Ph$ |
| II-70 | S | 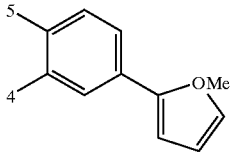 | O | 5'-Ph | $(CH_2)_3CH(SO_3^-)Ph$ |
| II-71 | S | 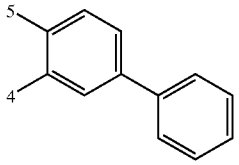 | O | 5'-(2'-Furyl) | $CH_2C_6H_4SO_3^-$-o |

-continued

| | | | | | |
|---|---|---|---|---|---|
| II-72 | S | 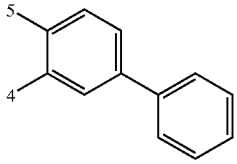 | O | 5'-Ph | 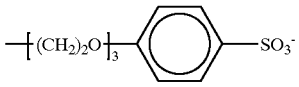 |

| No. | R2 | M |
|---|---|---|
| II-58 | $CH_2C_6H_4SO_3^-$-o | $HN^+(C_2H_5)_3$ |
| II-59 | $CH_2C_6H_4SO_3^-$-o | $HN^+(C_2H_5)_3$ |
| II-60 | $CH_2C_6H_4SO_3^-$-o | $HN^+(C_2H_5)_3$ |
| II-61 | $CH_2C_6H_4SO_3^-$-o | $Na^+$ |
| II-62 | 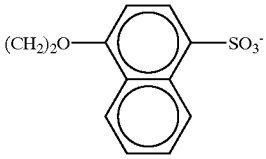 | $Na^+$ |
| II-63 | $CH_2C_6H_4SO_3^-$-o | $Na^+$ |
| II-64 | $CH_2C_6H_4SO_3^-$-o | $HN^+(C_2H_5)_3$ |
| II-65 | $CH_2C_6H_4SO_3^-$-o | $HN^+(C_2H_5)_3$ |
| II-66 | $CH_2C_6H_4SO_3^-$-o | $HN^+(C_2H_5)_3$ |
| II-67 | $(CH_2)_2CH(SO_3^-)Ph$ | $Na^+$ |
| II-68 | 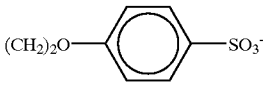 | $Na^+$ |
| II-69 | 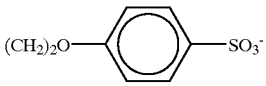 | $Na^+$ |
| II-70 | $(CH_2)_3CH(SO_3^-)Ph$ | $HN^+(C_2H_5)_3$ |
| II-71 | $CH_2C_6H_4SO_3^-$-o | $HN^+(C_2H_5)_3$ |
| II-72 | 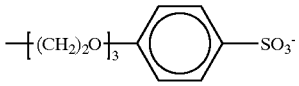 | $HN^+(C_2H_5)_3$ |

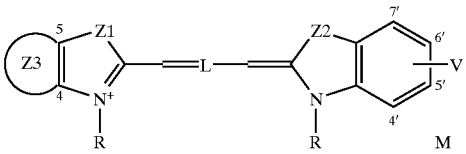

| No. | Z1 | Z3 | Z2 | V | L | R | M |
|---|---|---|---|---|---|---|---|
| II-73 | S | 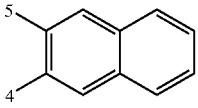 | S | 5',6'-benzo | =CH—CH=CH— | $CH_2C_6H_4SO_3^-$-o | $HN^+(C_2H_5)_3$ |
| II-74 | O | 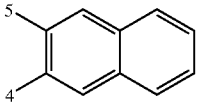 | O | 5',6'-benzo | 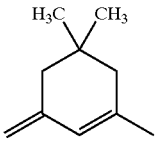 | $(CH_2)_2CH(SO_3^-)Ph$ | $HN^+(C_2H_5)_3$ |

-continued
| | | | | | | | |
|---|---|---|---|---|---|---|---|
| II-75 | O | 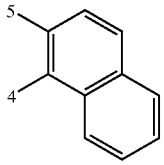 | O | 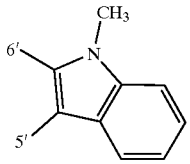 | 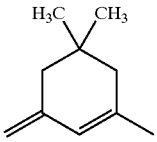 | $(CH_2)_2C_6H_4SO_3^-$-p | $HN^+(C_2H_5)_3$ |
| II-76 | O | 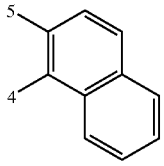 | O | 4',5'-benzo | 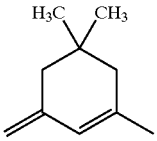 | $(CH_2)_2C_6H_4SO_3^-$-p | $HN^+(C_2H_5)_3$ |
| II-77 | O | 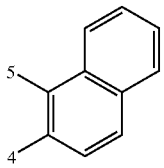 | O | 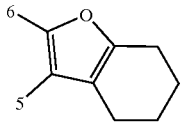 | 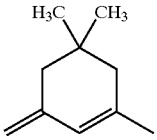 | $CH_2C_6H_4SO_3^-$-o | $HN^+(C_2H_5)_3$ |
II-78
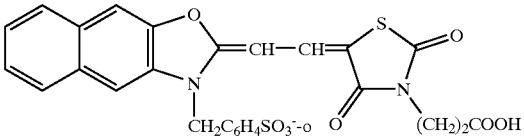
$HN(C_2H_5)_3^+$
II-79
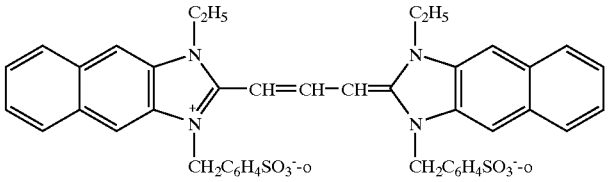
$HN(C_2H_5)_3^+$
II-80
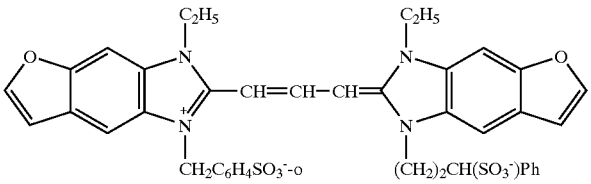
$HN(C_2H_5)_3^+$
II-81
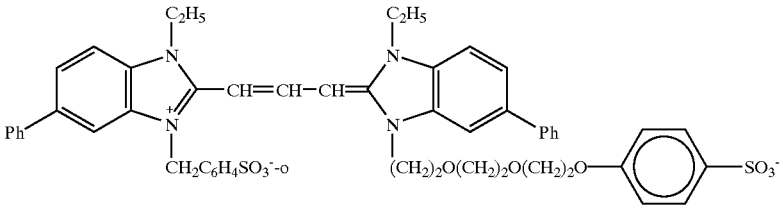
$HN(C_2H_5)_3^+$ -continued
II-82
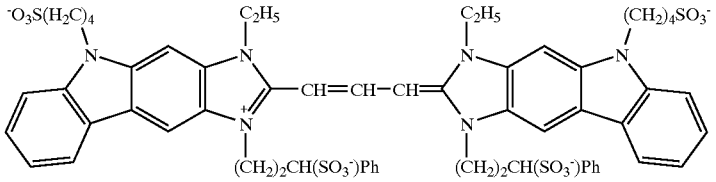
$3Na^+$
II-83
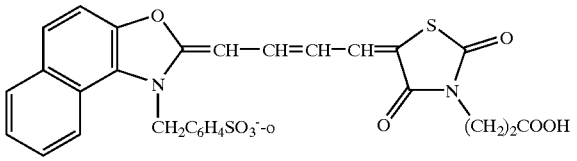
$HN(C_2H_5)_3^+$
II-84
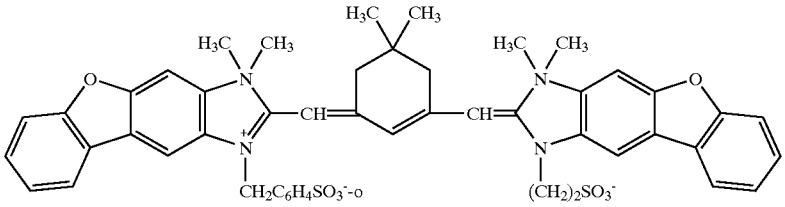
$HN(C_2H_5)_3^+$
II-85
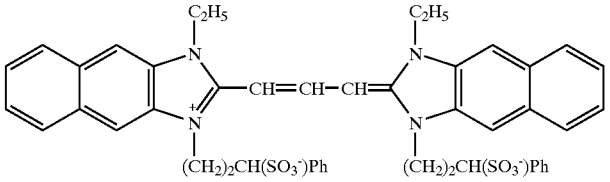
$HN(C_2H_5)_3^+$
II-86
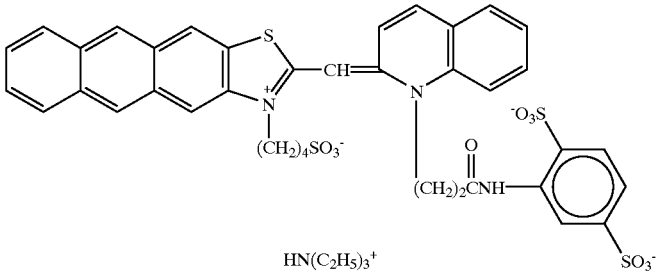
$HN(C_2H_5)_3^+$ -continued

II-87

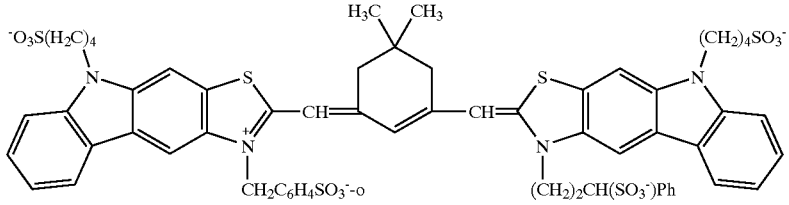

3K+

Specific Examples of Compound Represented by Formula (III) of the Present Invention (III-1)

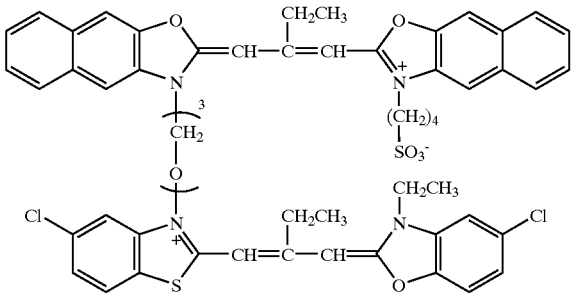

In the present invention, other than the above-described method using a sensitizing dye having a specific spectral absorption maximum wavelength or spectral sensitivity distribution, by using a dye represented by the following formula (IV', both midpoint sensitivity and foot sensitivity on the photographic characteristic curve can be elevated and a sharp spectral sensitivity spectrum can be obtained.

(IV')

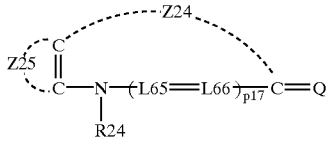

M7 m7 wherein Z24 represents an atomic group necessary for forming a 5- or 6-membered nitrogen-containing heterocyclic ring, Z25 represents an atomic group necessary for forming an aliphatic or aromatic ring and necessary for forming a polycyclic condensation structure comprising three or more rings including the nitrogen-containing heterocyclic ring formed by Z24, Q represents a group necessary for allowing the compound represented by formula (IV') to form a methine dye, R24 represents an alkyl group, an aryl group or a heterocyclic group, L65 and L66 each represents a methine group, p17 represents 0 or 1, M7 represents a counter ion for balancing the electric charge, and m7 represents a number of from 0 to 10 necessary for neutralizing the electric charge of the molecule.

Preferred embodiments in practice of the dye represented by formula are described below.

(1) Among the compounds represented by formula (IV'), a dye having no anionic substituent, namely, a dye having a substituent for forming a cationic dye as a whole is used (this dye is defined as a "dye IV'c").

However, in the case of using the dye IV'c alone, R24 is preferably an alkyl group substituted by an aromatic group (an aryl group or an aromatic heterocyclic group), an aryl group or an aromatic heterocyclic group.

(2) Among the compounds represented by formula (IV'), a dye having a substituent for forming an anionic dye as a whole is used (this dye is defined as a "dye IV'a").

(3) At least one methine dye represented by the following formula (IV'-1) and at least one dye IV'a are simultaneously used:

(IV'-1)

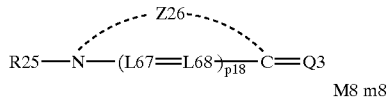

M8 m8 wherein Z26 represents an atomic group necessary for forming a nitrogen-containing heterocyclic ring, provided that an aromatic ring may be condensed to Z26, R25 represents an alkyl group, an aryl group or a heterocyclic group, Q3 represents a group necessary for allowing the compound represented by formula (IV'-1) to form a methine group, L67 and L68 each represents a methine group, p18 represents 0 or 1, provided that Z26, R25, Q3, L67 and L68 each has a substituent for allowing the methine dye represented by formula (IV'-1) to form a cationic dye as a whole (namely, each does not have an anionic substituent), M8 represents an anion for balancing the electric charge, and m8 represents a number of from 0 to 10 necessary for neutralizing the molecular charge.

The dye IV'a is included in the methine dye represented by the following formula (IV'-2) (anionic dye). More specifically, the dye where the nitrogen-containing heterocyclic ring formed by Z27 has a polycyclic condensation structure comprising three or more rings corresponds to the dye IV'a.

(4) At least one dye IV'c and at least one methine dye represented by the following formula (IV'-2) are simultaneously used:

(IV'-2)

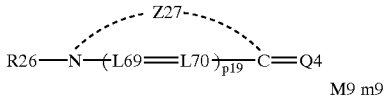

M9 m9 wherein Z27 represents an atomic group necessary for forming a nitrogen-containing heterocyclic ring, provided that an aromatic ring may be condensed to Z27, R26 represents an alkyl group, an aryl group or a heterocyclic group, Q4 represents a group necessary for allowing the compound represented by formula (IV'-2) to form a methine group, L69 and L70 each represents a methine group, p19 represents 0 or 1, provided that Z27, R26, Q4, L69 and L70 each has a substituent for allowing the methine dye represented by formula (IV'-2) to form an anionic dye as a whole, M9 represents a cation for balancing the electric charge, and m9 represents a number of from 0 to 10 necessary for neutralizing the molecular charge.

The dye IV'c is included in the methine dye represented by formula (IV'-1) above (cationic dye). More specifically, the dye where the nitrogen-containing heterocyclic ring formed by Z26 has a polycyclic condensation structure comprising three or more rings corresponds to the dye IV'c.

In the case of using a methine dye represented by formula (IV'-1) and a dye IV'a in combination, at lease one of R24 and R25 is preferably an alkyl group substituted by an aromatic group (an aryl group or an aromatic heterocyclic group), an aryl group or an aromatic heterocyclic group.

In more preferred embodiment, R24 and R25 both are an alkyl group substituted by an aromatic group (an aryl group or an aromatic heterocyclic group), an aryl group or an aromatic heterocyclic group.

In the case of using a dye IV'c and a methine dye represented by formula (IV'-2) in combination, at lease one of R24 and R26 is preferably an alkyl group substituted by an aromatic group (an aryl group or an aromatic heterocyclic group), an aryl group or an aromatic heterocyclic group.

In more preferred embodiment, R24 and R26 both are an alkyl group substituted by an aromatic group (an aryl group or an aromatic heterocyclic group), an aryl group or an aromatic heterocyclic group.

The compound of formula (IV'-1) is more preferably represented by the following formula (IV'-3):

(IV'-3)

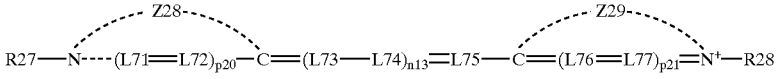

M8m8 wherein L71, L72, L73, L74, L75, L76 and L77 each represents a methine group, p20 and p21 each represents 0 or 1, n13 represents 0, 1, 2, 3 or 4, Z28 and Z29 each represents an atomic group necessary for forming a 5- or 6-membered nitrogen-containing heterocyclic ring, provided that an aromatic ring may be condensed to Z28 or Z29, R27 and R28 each represents an alkyl group, an aryl group or a heterocyclic group, provided that R27, R28, Z28, Z29, L71, L72 and L73 each has no anionic substituent, namely, each has a substituent for forming a cationic dye as a whole, and M8 and m8 have the same meanings as in formula (IV'-1).

The compound of formula (IV'-L2) is more preferably represented by the following formula (IV'-4):

(IV'-4)

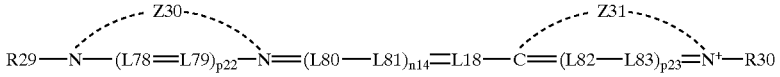

M9m9 wherein L78, L79, L80, L81, L82, L83 and L84 each represents a methine group, p22 and p23 each represents 0 or 1, n14 represents 0, 1, 2, 3 or 4, Z30 and Z31 each represents an atomic group necessary for forming a 5- or 6-membered nitrogen-containing heterocyclic ring, provided that an aromatic ring may be condensed to Z30 or Z31, R29 and R30 each represents an alkyl group, an aryl group or a heterocyclic group, provided that R29 and R30 each has an anionic substituent, and M9 and m9 have the same meanings as in formula (IV'-2).

In the case where a methine dye represented by formula (IV'-3) and included in the dye IV'c is used alone, at least one of R27 and R28 is preferably an alkyl group substituted by an aromatic group (an aryl group or an aromatic heterocyclic group), an aryl group or an aromatic heterocyclic group.

In more preferred embodiment, R27 and R28 both are an alkyl group substituted by an aromatic group (an aryl group or an aromatic heterocyclic group), an aryl group or an aromatic heterocyclic group.

In the case where a methine dye represented by formula (IV'-3) and included in the dye IV'c and a methine dye represented by formula (IV'-4) and included in the dye IV'a are used in combination, at least one of R27, R28, R29 and R30 is preferably an alkyl group substituted by an aromatic group (an aryl group or an aromatic heterocyclic group), an aryl group or an aromatic heterocyclic group.

In a more preferred embodiment, at least two of R27, R28, R29 and R30 are an alkyl group substituted by an aromatic group (an aryl group or an aromatic heterocyclic group), an aryl group or an aromatic heterocyclic group; in still more preferred embodiment, at least three of R27, R28, R29 and R30 are an alkyl group substituted by an aromatic group (an aryl group or an aromatic heterocyclic group), an aryl group or an aromatic heterocyclic group; and in particularly preferred embodiment, all of R27, R28, R29 and R30 are an alkyl group substituted by an aromatic group (an aryl group or an aromatic heterocyclic group), an aryl group or an aromatic heterocyclic group.

(5) A spectral sensitizer represented by the following formula (V') (having a polycyclic condensation structure comprising three rings) is used:

(V')

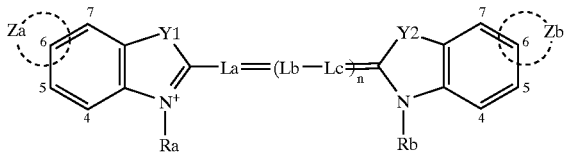

M10m10 wherein Y1 and Y2 each represents O or S, Za and Zb each represents an atomic group necessary for forming a benzene ring, the numerical values (4, 5, 6 and 7) in the formula each shows the site to which a benzene ring is bonded, the benzene ring is bonded to any one of (4,5), (5,6) and (6,7), Ra and Rb each has the same meaning as R24 in formula (IV'), La, Lb and Lc each represents a methine group and has the same meaning as L73, n represents 0, 1 or 2, and M10 and m10 have the same meanings as M7 and m7, respectively.

(i) In a preferred embodiment of formula (V'), n is 1, La and Lc each is an unsubstituted methine group, and Lb is a methine group substituted by an alkyl group having from 1 to 5 carbon atoms (preferably a methyl group or an ethyl group).

(ii) In (i), the benzene ring formed by Za or zb is more preferably bonded to (4,5) or (5,6). In this case, Y1 and Y2 both are particularly preferably 0.

(iii) In (ii), Ra and Rb both are an alkyl group substituted by an aromatic group, an aryl group or an aromatic heterocyclic group.

(iv) In (iii), the substituent is selected such that the spectral sensitizer as a whole forms a cationic dye or an anionic dye.

(v) Furthermore, a cationic dye belonging to the spectral sensitizer represented by formula (V') and an anionic dye belonging to the spectral sensitizer represented by formula g are preferably used at the same time.

In the present invention, the cationic dye means a dye having no anionic substituent and the anionic dye means a dye having an anionic substituent.

The anionic substituent referred to in the present invention is a substituent having a negative charge and this substituent is an atomic group capable of readily dissociating under neutral or weakly alkaline conditions, particularly a substituent having hydrogen atom. Examples thereof include a sulfo group ($—SO_3^-$), a sulfuric acid group ($—OSO_3^-$), a carboxyl group ($—CO_2^-$), a phosphoric acid group ($—PO_3^-$), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl).

Light-sensitive materials using silver halide grains obtained by adsorbing a dye chromophore in one or more layers on a silver halide grain as described above exhibit a broad spectral sensitivity distribution in many cases. The present inventors have found out that this problem can be improved by allowing the dye in the first layer and also the dyes in the second and subsequent layers to have spectral sensitivity due to absorption attributable to the J-association (i.e., J-aggregation).

The compounds represented by formulae (IV'), (IV'-1), (IV'-2), (IV'-3) and (IV'-4) for use in the present invention are described in detail below.

According to the structure of Q, Q3 and Q4 in formulae (IV'), (IV'-1) and (IV'-2), any methine dye can be formed. Preferred examples thereof include cyanine dyes, merocyanine dyes, rhodacyanine dyes, oxonol dyes, trinuclear merocyanine dyes, tetranuclear merocyanine dyes, allopolar dyes, styryl dyes, styryl base dyes, hemicyanine dyes, streptocyanine dyes and hemioxonol dyes. Among these, more preferred are cyanine dyes, merocyanine dyes and rhodacyanine dyes, and still more preferred are cyanine dyes (in which the electric charge may be any of cation, anion and betaine). These dyes are described in detail in F. M. Harmer, *Heterocyclic Compounds—Cyanine Dyes and Related Compounds,* John Wiley & Sons, New York, London (1964), and D. M. Sturmer, *Heterocyclic Compounds—Special Topics in Heterocyclic Chemistry,* Chap. 18, Sec. 14, pp. 482–515, John Wiley & Sons, New York, London (1977).

For merocyanine dyes and rhodacyanine dyes, formulae (XII) and (XIII) described in U.S. Pat. No. 5,340,694, pages 21 and 22, are preferred.

In the case where a cyanine dye is formed by Q, formula (IV') may be expressed by the following resonance formula:

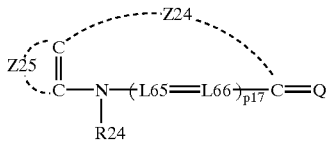

M7 m7

The number of methine groups in Q, Q3 or Q4 is preferably from 0 to 7, more preferably from 0 to 5, still more preferably 3. Here, as long as Q, Q3 or Q4 forms the above-described dye (e.g., cyanine dye, merocyanine dye, rhodacyanine dye, trinuclear merocyanine dye, allopolar dye, hemicyanine dye, styryl dye), the number of methine groups may be 0 (for example, simple merocyanine). The methine group is preferably substituted by a substituent (e.g., heterocyclic group, aliphatic group, aromatic group) necessary for forming a methine dye. The substituent is preferably a heterocyclic group, an aliphatic group or an aromatic group, more preferably a heterocyclic group.

The aromatic group includes a substituted or unsubstituted aromatic group (e.g., 4-dimethylaminophenyl, 4-methoxyphenyl, phenyl, 4-dimethylaminonaphthyl).

Preferred examples of the aliphatic group include an alkoxy carbonyl group (e.g., ethoxycarbonyl) and an acyl group (e.g., acetyl). Other examples include the substituents represented by V described above. Among those, preferred are, for example, a substituted or unsubstituted amino group (e.g., amino, dimethylamino), a cyano group, an alkoxycarbonyl group (e.g., ethoxycarbonyl), a substituted or unsubstituted alkylsulfonyl group (e.g., methylsulfonyl) and a substituted or unsubstituted acyl group (e.g., acetyl)

In formula (IV'), Z24 represents an atomic group necessary for forming a 5- or 6-membered nitrogen-containing heterocyclic ring. The nitrogen-containing heterocyclic ring formed by Z24 may be condensed with an aromatic ring. Examples thereof include thiazoline nucleus, thiazole nucleus, oxazoline nucleus, oxazole nucleus, selenazoline nucleus, selenazole nucleus, 3,3-dialkyl-3H-pyrrole nucleus (e.g., 3,3-dimethyl-3H-pyrrole), imidazoline nucleus, imidazole nucleus, 2-pyridine nucleus, 4-pyridine nucleus, imidazo[4,5-b]quinoxaline nucleus, oxadiazole nucleus, thiadiazole nucleus, tetrazole nucleus, pyrimidine nucleus, pyridazine nucleus and pyrazine nucleus. Among these, preferred are thiazole nucleus, oxazole nucleus, selenazole nucleus, 3,3-dialkyl-3H-pyrrole nucleus, imidazole nucleus and 2-pyridine nucleus, and more preferred are thiazole nucleus, oxazole nucleus, imidazole nucleus and 2-pyridine nucleus.

Assuming that the substituent on the nitrogen-containing heterocyclic ring is V, the substituent represented by V is not particularly limited, however, examples thereof include a halogen atom (e.g., chlorine, bromine, iodine, fluorine), a mercapto group, a cyano group, a carboxyl group, a phosphoric acid group, a sulfo group, a hydroxy group, a carbamoyl group having from 1 to 10, preferably from 2 to 8, more preferably from 2 to 5, carbon atoms (e.g., methylcarbamoyl, ethylcarbamoyl, morpholino-carbonyl), a sulfamoyl group having from 0 to 10, preferably from 2 to 8, more preferably from 2 to 5, carbon atoms (e.g., methylsulfamoyl, ethylsulfamoyl, piperidinosulfonyl), a nitro group, an alkoxy group having from 1 to 20, preferably from 1 to 10, more preferably from 1 to 8, carbon atoms (e.g., methoxy, ethoxy, 2-methoxyethoxy, 2-phenylethoxy), an aryloxy group having from 6 to 20, preferably from 6 to 12, more preferably from 6 to 10, carbon atoms (e.g., phenoxy, p-methylphenoxy, p-chlorophenoxy, naphthoxy), an acyl group having from 1 to 20, preferably from 2 to 12, more preferably from 2 to 8, carbon atoms (e.g., acetyl, benzoyl, trichloroacetyl), an acyloxy group having from 1 to 20, preferably from 2 to 12, more preferably from 2 to 8, carbon atoms (e.g., acetyloxy, benzoyloxy), an acylamino group having from 1 to 20, preferably from 2 to 12, more preferably from 2 to 8, carbon atoms (e.g., acetylamino), a sulfonyl group having from 1 to 20, preferably from 1 to 10, more preferably from 1 to 8, carbon atoms (e.g., methanesulfonyl, ethanesulfonyl, benzenesulfonyl), a sulfinyl group having from 1 to 20, preferably from 1 to 10, more preferably from 1 to 8, carbon atoms (e.g., methanesulfinyl, ethanesulfinyl, benzenesulfinyl), a sulfonylamino group having from 1 to 20, preferably from 1 to 10, more preferably from 1 to 8, carbon atoms (e.g., methanesulfonylamino, ethanesulfonylamino, benzenesulfonylamino), an amino group, a substituted amino group having from 1 to 20, preferably from 1 to 12, more preferably from 1 to 8, carbon atoms (e.g., methylamino, dimethylamino, dibenzylamino, anilino, diphenylamino), an ammonium group having from 0 to 15, preferably from 3 to 10, more preferably from 3 to 6, carbon atoms (e.g., trimethylammonium, triethylammonium), a hydrazino group having from 0 to 15, preferably from 1 to 10, more preferably from 1 to 6, carbon atoms (e.g., trimethylhydrazino), a ureido group having from 1 to 15, preferably from 1 to 10, more preferably from 1 to 6, carbon atoms (e.g., ureido, N,N-dimethylureido), an imido group having from 1 to 15, preferably from 1 to 10, more preferably from 1 to 6, carbon atoms (e.g., succinimido), an alkylthio group having from 1 to 20, preferably from 1 to 12, more preferably from 1 to 8, carbon atoms (e.g., methylthio, ethylthio, propylthio), an arylthio group having from 6 to 20, preferably from 6 to 12, more preferably from 6 to 10, carbon atoms (e.g., phenylthio, p-methylphenylthio, p-chlorophenylthio, 2-pyridylthio, naphthylthio), an alkoxycarbonyl group having from 2 to 20, preferably from 2 to 12, more preferably from 2 to 8, carbon atoms (e.g., methoxycarbonyl, ethoxycarbonyl, 2-benzyloxycarbonyl), an aryloxycarbonyl group having from 6 to 20, preferably from 6 to 12, more preferably from 6 to 10, carbon atoms (e.g., phenoxycarbonyl), an unsubstituted alkyl group having from 1 to 18, preferably from 1 to 10, more preferably from 1 to 5, carbon atoms (e.g., methyl, ethyl, propyl, butyl), a substituted alkyl group having from 1 to 18, preferably from 1 to 10, more preferably from 1 to 5, carbon atoms {e.g., hydroxymethyl, trifluoromethyl, benzyl, carboxyethyl, ethoxycarbonylmethyl, acetylaminomethyl; the substituted alkyl group includes an unsaturated hydrocarbon group having from 2 to 18, preferably from 3 to 10, more preferably from 3 to 5, carbon atoms (e.g., vinyl, ethynyl, 1-cyclohexenyl, benzylidyne, benzylidene)}, a substituted or unsubstituted aryl group having from 6 to 20, preferably from 6 to 15, more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl) and a substituted or unsubstituted heterocyclic group having from 1 to 20, preferably from 2 to 10, more preferably from 4 to 6, carbon atoms (e.g., pyridyl, 5-methylpyridyl, thienyl, furyl, morpholino, tetrahydrofurfuryl). These each may have a structure such that a benzene ring or a naphthalene ring is condensed thereto. Furthermore, these substituents each may further be substituted by V.

Among these substituents, preferred are the alkyl group, the aryl group, the alkoxy group, the halogen atom and benzene ring condensation products thereof, and more preferred are methyl group, phenyl group, methoxy group, chlorine atom, bromine atom, iodine atom and benzene ring condensation products thereof.

Z25 represents an atomic group necessary for forming an aliphatic or aromatic cyclic compound and necessary for forming a polycyclic condensation structure comprising three or more rings including the nitrogen-containing heterocyclic ring formed by Z24. Examples of the cyclic structure formed by Z25 include an unsubstituted aliphatic cyclic structure having a bicyclic or greater polycyclic condensation ring structure (e.g., decahydronaphthalene), a substituted aliphatic cyclic structure having a bicyclic or greater polycyclic condensation structure (examples of the substituent include those described above as examples of the substituent V), an unsubstituted aromatic cyclic structure having a bicyclic or greater polycyclic condensation ring structure (e.g., pentalene, indene, naphthalene, azulene, anthracene, phananthrene, anthracene), a substituted aromatic cyclic structure having a bicyclic or greater polycyclic condensation ring structure (examples of the substituent include those described above as examples of the substituent V), an unsubstituted heterocyclic structure having a bicyclic or greater polycyclic condensation ring structure (e.g., quinolizine, purine, naphthylidine), a substituted heterocyclic structure having a bicyclic or greater polycyclic condensation ring structure (examples of the substituent include those described above as examples of the substituent V), and a structure having a bicyclic or greater polycyclic condensation ring structure resulting from condensation of two or more of an aliphatic ring structure, an aromatic ring structure and a heterocyclic ring (e.g., benzofurane, benzothiophene, indole, oxathiine, quinoline, thiazine, phenothiazine, phenoxathiine, phenazine, indoline, benzomorpholine, benzopyrane, cyclo-pentapyran, dithianaphthalene, benzoxazine, benzofurane, dibenzothiophene, carbazole, chroman, coumarin, xanthene, thianthrene), which may be substituted by a substituent V.

Among the ring structures formed by Z25, preferred are an unsubstituted aromatic ring structure having a bicyclic or greater polycyclic condensation ring structure (e.g., pentalene, indene, naphthalene, azulene, anthracene, phenanthrene), a substituted aromatic ring structure having a bicyclic or greater polycyclic condensation ring structure, and a structure having a bicyclic or greater polycyclic condensation ring structure resulting from condensation of two or more of an aliphatic ring structure, an aromatic ring structure and a heterocyclic structure (e.g., benzofurane, benzothiophene, indole, thioxathiine, quinoline, thiazine, phenothiazine, phenoxathiine, phenazine, indoline, benzomorpholine, benzopyrane, cyclopentapyran, dithianaphthalene, benzoxazine, dibenzofurane, dibenzothiophene, carbazole, chroman, coumarin, phenoxathiine, xanthene, thianthrene; including substitution products thereof), more preferred are a structure having a tricyclic or greater polycyclic condensation ring structure resulting from condensation of three or more of an aliphatic ring structure, an aromatic ring structure and a heterocyclic structure (e.g., anthracene, phenanthrene, dibenzofurane, dibenzothiophene, carbazole, phenoxathiine, xanthene, thianthrene; including substitution products thereof), and still more preferred are anthracene, dibenzofurane, dibenzothiophene and carbazole.

In formulae (IV'-1), (IV'-2), (IV'-3) and (IV'-4), Z26, Z27, Z28, Z29, Z30 and Z31 each represents an atomic group necessary for forming a nitrogen-containing heterocyclic ring, provided that an aromatic ring may be condensed thereto. Examples of the aromatic ring include a benzene ring, a naphthalene ring and a heteroaromatic ring such as pyrazine ring and thiophene ring. Examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus and pyrimidine nucleus. Among these, preferred are benzothiazole nucleus, benzoxazole nucleus, 3,3-dialkylindolenine nucleus (e.g., 3,3-dimethylindolenine), benzimidazole nucleus, 2-pyridine nucleus, 4-pyridine nucleus, 2-quinoline nucleus, 4-quinoline nucleus, 1-isoquinoline nucleus and 3-isoquinoline nucleus; more preferred are benzothiazole nucleus, benzoxazole nucleus, 3,3-dialkylindolenine nucleus (e.g., 3,3-dimethylindolenine) and benzimidazole nucleus; still more preferred are benzoxazole nucleus, benzothiazole nucleus and benzimidazole nucleus; and most preferred are benzoxazole nucleus and benzothiazole nucleus.

The nitrogen-containing heterocyclic ring may be further substituted by a substituent V described above. The substituent V on Z26, Z27, Z28, Z29, Z30 or Z31 is preferably an aryl group, an aromatic heterocyclic ring or an aromatic ring condensation product.

L65 to L84 each independently represents a methine group. The methine group represented by L65 to L84 may have a substituent and examples of the substituent include a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6 to 20, preferably from 6 to 12, more preferably from 6 to 10, carbon atoms (e.g., phenylthio, p-methylphenylthio). A ring may be formed with another methine group or an auxochrome may also be formed.

L65 to L72, L76 to L79, L83 and L84 each is preferably an unsubstituted methine group.

p17, p18, p19, p20, p21, p22 and p23 each represents 0 or 1 and is preferably 0.

R24, R25, R26, R27, R28, R29 and R30 each represents an alkyl group, an aryl group or a heterocyclic group. Specific examples thereof include an unsubstituted alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, more preferably from 1 to 4, carbon atoms {for example, an alkyl group substituted by a substituent V described above, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic ring-substituted alkyl group (e.g., 2-(pyrrolidin-2-on-1-yl)ethyl, tetrahydrofurfuryl), an alkylsulfonylcarbamoylmethyl group (e.g., methanesulfonylcarbamoylmethyl)}, an unsubstituted aryl group having from 6 to 20, preferably from 6 to 10, more preferably from 6 to 8, carbon atoms (e.g., phenyl, 1-naphthyl), a substituted aryl group having from 6 to 20, preferably from 6 to 10, more preferably from 6 to 8, carbon atoms (for example, an aryl group substituted by V described above as examples of the substituent; specifically, p-methoxyphenyl, p-methylphenyl, p-chlorophenyl), an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), a substituted heterocyclic group having from 1 to 20, preferably from 3 to 10, more preferably from 4 to 8, carbon atoms (for example, a heterocyclic group substituted by V described above as examples of the substituent; specifically, 5-methyl-2-thienyl, 4-methoxy-2-pyridyl).

In formulae (IV'-1) and (IV'-3), it is preferred that R25 and at least one of R27 and R28 represent an alkyl group substituted by an aromatic group (an aryl group or an aromatic heterocyclic group), an aryl group or an aromatic heterocyclic group and that R25 and both of R27 and R28 have no anionic substituent. Examples of the substituent include the substituents V. At this time, the dye in formula (IV'-1) or (IV'-3) must form a cationic dye.

Preferred examples of the aryl-substituted alkyl group include an aralkyl group (e.g., benzyl, 2-phenylethyl, naphthylmethyl, 2-(4-biphenyl)ethyl), an aryloxyalkyl group (e.g., 2-phenoxyethyl, 2-(l-naphthoxy)ethyl, 2-(4-biphenyloxy)ethyl, 2-(o,m,p-halophenoxy)ethyl, 2-(o,m,p-methoxyphenoxy)ethyl) and an aryloxycarbonylalkyl group (e.g., 3-phenoxycarbonylpropyl, 2-(1-naphthoxycarbonyl) ethyl). Preferred examples of the aromatic heterocyclic ring-substituted alkyl group include 2-(2-pyridyl)ethyl, 2-(4-pyridyl)ethyl, 2-(2-furyl)ethyl, 2-(2-thienyl)ethyl and 2-(2-pyridylmethoxy)ethyl. Preferred examples of the aryl group include 4-methoxyphenyl, phenyl, naphthyl and biphenyl. Preferred examples of the aromatic heterocyclic group include 2-thienyl, 4-chloro-2-thienyl, 2-pyridyl and 3-pyrazolyl Among these, more preferred are the alkyl group substituted by an aromatic group (aryl group or aromatic heterocyclic group), and the substituted or unsubstituted aryl group.

In formulae (IV'-2) and (IV'-4), it is preferred that R26 and at least one of R29 and R30 represent an alkyl group substituted by an aromatic group (an aryl group or an aromatic heterocyclic group), an aryl group or an aromatic heterocyclic group and that R26 and both of R29 and R30 have an anionic substituent. Examples of the substituent include the substituents V. At this time, the dye in formula (IV'-2) or (IV'-4) must form an anionic dye.

Preferred examples of the alkyl group include an alkyl a group having from 1 to 15, preferably from 1 to 10, carbon atoms and substituted by a sulfo group, a phosphoric acid group or a carboxyl group (for example, sulfomethyl, sulfoethyl, 2,2-difluoro-2-carboxyethyl, 2-phosphoethyl), an unsaturated hydrocarbon group substituted by a sulfo group, a phosphoric acid group or a carboxyl group (for example, 3-sulfo-2-propenyl), an alkoxyalkyl group substituted by a sulfo group, a phosphoric acid group or a carboxyl group (for example, 2-sulfomethoxyethyl), an alkoxycarbonylalkyl group substituted by a sulfo group, a phosphoric acid group or a carboxyl group (for example, sulfoethoxycarbonylethyl, 2-sulfobenzyloxycarbonylethyl), an acyloxyalkyl group substituted by a sulfo group, a phosphoric acid group or a carboxyl group (for example, 2-phosphoacetyloxyethyl) and an acylalkyl group substituted by a sulfo group, a phosphoric acid group or a carboxyl group (for example, 2-sulfoacetylethyl). Preferred examples of the alkyl group substituted by an aryl group include an aralkyl group substituted by a sulfo group, a phosphoric acid group or a carboxyl group (for example, 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl, 4-phosphobenzyl), an aryloxycarbonylalkyl group substituted by a sulfo group, a phosphoric acid group or a carboxyl group (for example, 3-sulfophenoxycarbonylpropyl), an aryloxyalkyl group substituted by a sulfo group and a phosphoric acid group or a carboxyl group (for example, 2-(4-sulfophenoxy)ethyl, 2-(2-phosphenoxy)ethyl, 4,4-diphenoxy-3-sulfobutyl). Preferred examples of the alkyl group substituted by an aromatic heterocyclic group include an aromatic heterocyclic group-substituted alkyl group substituted by a sulfo group, a phosphoric acid group or a carboxyl group (for example, 3-(2-pyridyl)-3-sulfopropyl, 3-(2-furyl)-3-sulfopropyl, 2-(2-thienyl)-2-sulfopropyl).

Preferred examples of the aryl group include an aryl group substituted by a sulfo group, a phosphoric acid group or a carboxyl group (for example, 4-sulfophenyl, 4-sulfonaphthyl). Preferred examples of the aromatic heterocyclic group include an aromatic heterocyclic group substituted by a sulfo group, a phosphoric acid group or a carboxyl group (for example, 4-sulfo-2-thienyl, 4-sulfo-2-pyridyl).

Among these, more preferred are the aralkyl substituted by a sulfo group, a phosphoric acid group or a carboxyl group, and the aryloxyalkyl group substituted by a sulfo group, a phosphoric acid group or a carboxyl group, still more preferred are 2-sulfobenzyl, 4-sulfobenzyl, 4-sulfophenethyl, 3-phenyl-3-sulfopropyl, 4-phenyl-4-sulfobutyl, 3-phenyl-2-sulfopropyl, 4,4-diphenyl-3-sulfobutyl, 2-(4'-sulfo-4-biphenyl)ethyl, 4-phosphobenzyl, 3-sulfo-2-propenyl and 2-(4-sulfophenoxy)ethyl, and most preferred are 2-sulfobenzyl, 4-sulfobenzyl, 4-sulfophenethyl, 3-phenyl-3-sulfopropyl and 4-phenyl-4-sulfobutyl.

n13 and n14 each independently represents 0, 1, 2, 3 or 4, preferably 0, 1, 2 or 3, more preferably 0, 1 or 2, still more preferably 0 or 1. When n13 and n14 each is 2 or more, the methine group is repeated but these methine groups need not be the same.

p17, p18, p19, p20, p21, p22 and p23 each independently represents 0 or 1, preferably 0.

M7, M8 and M9 each is included in the formulae so as to show the presence of a cation or anion when the ion charge of the dye is necessary to be neutralized. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkylammonium ion, pyridinium ion, ethylpyridinium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a reverse charge to the dye may be used. When hydrogen ion is the counter ion, $CO_2^-$ and $SO_3^-$ may be denoted as $CO_2H$ and $SO_3H$, respectively.

m7, m8 and m9 each represents a number necessary for balancing the electric charge, and is 0 when an inner salt is formed.

Specific examples of the cationic dye contained in formulae (IV'c), (IV'-1), (IV'-3) and (V') are set forth below, however, the present invention is by no means limited thereto.

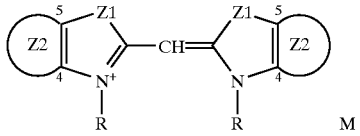
| No. | Z1 | Z2 | R | M |
|---|---|---|---|---|
| IV'c-1 | S | 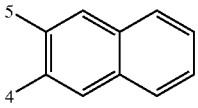 | $(CH_2)_2OC_6H_5$ | $p\text{-}CH_3C_6H_4SO_3^-$ |
| IV'c-2 | S | 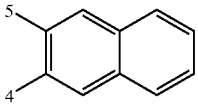 | $(CH_2)_2O(CH_2)_2O(CH_2)_2OC_6H_5$ | $p\text{-}CH_3C_6H_4SO_3^-$ |
| IV'c-3 | S | 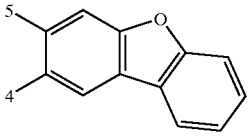 | $(CH_2)_2O(CH_2)_2O$ 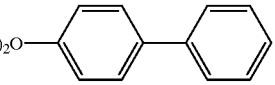 | $p\text{-}CH_3C_6H_4SO_3^-$ |
| IV'c-4 | S | 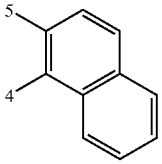 | $(CH_2)_2OC_6H_5$ | $p\text{-}CH_3C_6H_4SO_3^-$ |
| IV'c-5 | S | 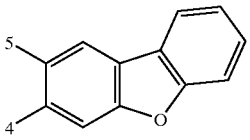 | $(CH_2)_2OC_6H_5$ | $p\text{-}CH_3C_6H_4SO_3^-$ |
| IV'c-6 | O | 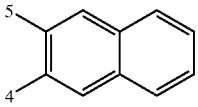 | $(CH_2)_2OC_6H_5$ | $p\text{-}CH_3C_6H_4SO_3^-$ |
| IV'c-7 | O | 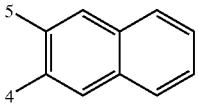 | $(CH_2)_2O(CH_2)_2O(CH_2)_2OC_6H_5$ | $p\text{-}CH_3C_6H_4SO_3^-$ |
| IV'c-8 | O | 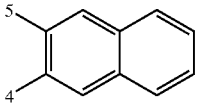 | $(CH_2)_2O(CH_2)_2O$ 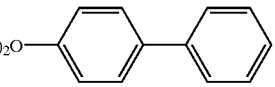 | $p\text{-}CH_3C_6H_4SO_3^-$ |
| IV'c-9 | O | 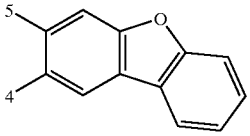 | $(CH_2)_2O(CH_2)_2O$ 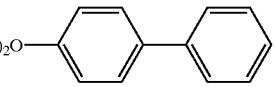 | $p\text{-}CH_3C_6H_4SO_3^-$ |

-continued
| | | | | |
|---|---|---|---|---|
| IV'c-10 | O | 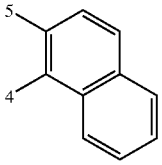 | $(CH_2)_2OC_6H_5$ | $p\text{-}CH_3C_6H_4SO_3^-$ |
| IV'c-11 | O | 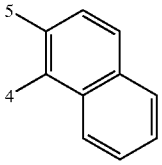 | $(CH_2)_2OC_6H_4Br$ | $p\text{-}CH_3C_6H_4SO_3^-$ |
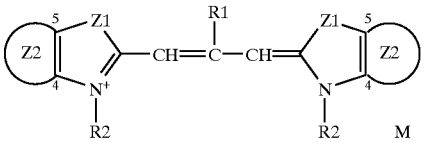
| No. | Z1 | Z2 | R1 | R2 | M |
|---|---|---|---|---|---|
| IV'c-12 | S | 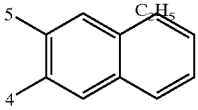 | $C_2H_5$ | $(CH_2)_3OC_6H_5$ | $p\text{-}CH_3C_6H_4SO_3^-$ |
| IV'c-13 | S | 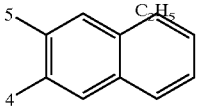 | $C_2H_5$ | $[(CH_2)_2O]_3$—Ph | $p\text{-}CH_3C_6H_4SO_3^-$ |
| IV'c-14 | S | 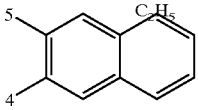 | $C_2H_5$ | $(CH_2)_2OC_6H_5$ | $Br^-$ |
| IV'c-15 | S | 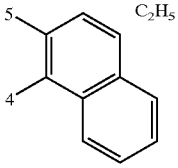 | $C_2H_5$ | $(CH_2)_2OC_6H_5$ | $p\text{-}CH_3C_6H_4SO_3^-$ |
| IV'c-16 | S | 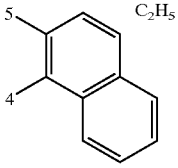 | $C_2H_5$ | $(CH_2)_2O(CH_2)_2O$— 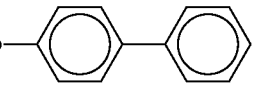 | $p\text{-}CH_3C_6H_4SO_3^-$ |
| IV'c-17 | S | 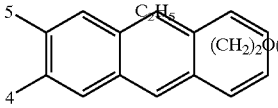 | $C_2H_5$ | $(CH_2)_2O(CH_2)_2O$— 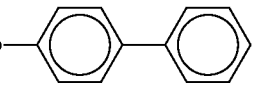 | $p\text{-}CH_3C_6H_4SO_3^-$ |
| IV'c-18 | S | 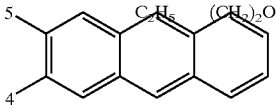 | $C_2H_5$ | $(CH_2)_2OC_6H_4OCH_3$-p | $p\text{-}CH_3C_6H_4SO_3^-$ |

-continued
| | | | | |
|---|---|---|---|---|
| IV'c-19 | S | 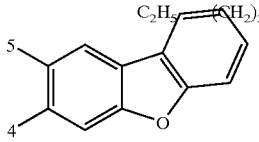 | $C_2H_5$ $(CH_2)_2O(CH_2)_2O—Ph$ | p-$CH_3C_6H_4SO_3^-$ |
| IV'c-20 | S | 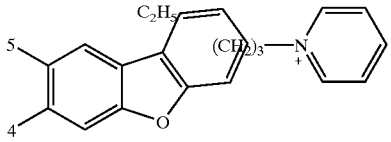 | $C_2H_5$ $(CH_2)_3—N^+$ | 3p-$ClC_6H_4SO_3^-$ |
| IV'c-21 | S | 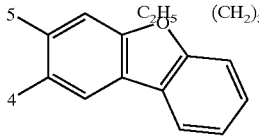 | $C_2H_5$ $(CH_2)_3OC_6H_5$ | p-$CH_3C_6H_4SO_3^-$ |
| IV'c-22 | S | 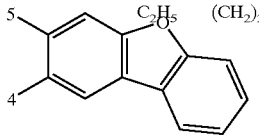 | $C_2H_5$ $(CH_2)_2O(CH_2)_2O(CH_2)_2OPh$ | p-$CH_3C_6H_4SO_3^-$ |
| IV'c-23 | O | 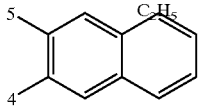 | $C_2H_5$ $(CH_2)_3OC_6H_5$ | p-$CH_3C_6H_4SO_3^-$ |
| IV'c-24 | O | 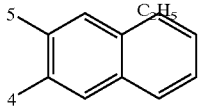 | $C_2H_5$ $(CH_2)_2O(CH_2)_2O(CH_2)_2OPh$ | p-$CH_3C_6H_4SO_3^-$ |
| IV'c-25 | O | 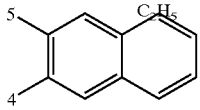 | $C_2H_5$ $(CH_2)_2OC_6H_5$ | p-$CH_3C_6H_4SO_3^-$ |
| IV'c-26 | O | 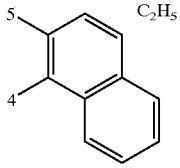 | $C_2H_5$ $(CH_2)_2OC_6H_5$ | p-$CH_3C_6H_4SO_3^-$ |
| IV'c-27 | O | 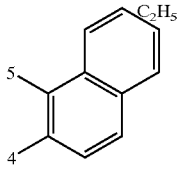 | $C_2H_5$ $(CH_2)_2OC_6H_5$ | $I^-$ |
| IV'c-28 | O | 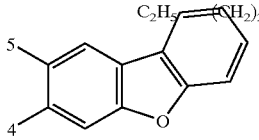 | $C_2H_5$ $(CH_2)_2OC_6H_5$ | $I^-$ |

-continued

| | | | | |
|---|---|---|---|---|
| IV'c-29 | O | 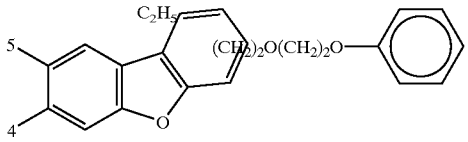 | | $I^-$ |
| IV'c-30 | O | 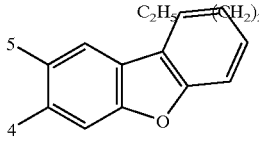 | $(CH_2)_2O(CH_2)_2O(CH_2)_2OPh$ | $I^-$ |
| IV'c-31 | O | 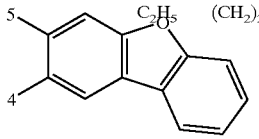 | $(CH_2)_2OC_6H_5$ | $p\text{-}CH_3C_6H_4SO_3^-$ |
| IV'c-32 | O | 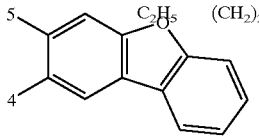 | $(CH_2)_2OC_6H_4OCH_3\text{-}p$ | $p\text{-}CH_3C_6H_4SO_3^-$ |
| IV'c-33 | O | 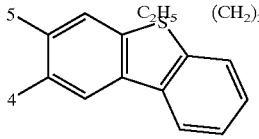 | $(CH_2)_2OC_6H_5$ | $p\text{-}CH_3C_6H_4SO_3^-$ |
| IV'c-34 | O | 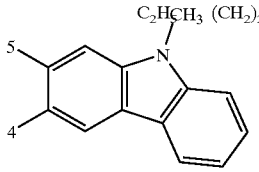 | $(CH_2)_2OC_6H_5$ | $p\text{-}CH_3C_6H_4SO_3^-$ |

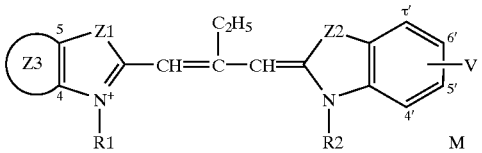

| No. | Z1 | Z3 | Z2 | V | R1 | R2 | M |
|---|---|---|---|---|---|---|---|
| IV'c-35 | S | 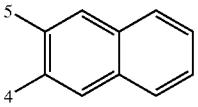 | O | 5',6'-benzo | $(CH_2)_2O(CH_2)_2OPh$ | $(CH_2)_2O(CH_2)_2OPh$ | $p\text{-}CH_3C_6H_4SO_3^-$ |
| IV'c-36 | S | 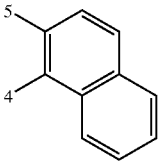 | O | 4',5'-benzo | $(CH_2)_2O(CH_2)_2OPh$ | $(CH_2)_2OC_6H_5$ | $p\text{-}CH_3C_6H_4SO_3^-$ |
| IV'c-37 | S | 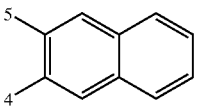 | O | 5'-Ph | $(CH_2)_2O(CH_2)_2OPh$ | $(CH_2)_2OC_6H_5$ | $p\text{-}CH_3C_6H_4SO_3^-$ |

-continued
| | | | | | | | |
|---|---|---|---|---|---|---|---|
| IV'c-38 | S | 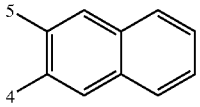 | O | 5'-(2-Thienyl) | $(CH_2)_2OC_6H_4OCH_3$-p | $(CH_2)_2OC_6H_5$ | p-$CH_3C_6H_4SO_3^-$ |
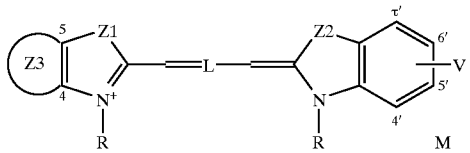
| No. | Z1 | Z3 | Z2 | V | L | R | M |
|---|---|---|---|---|---|---|---|
| IV'c-39 | S | 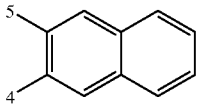 | S | 5',6'-benzo | =CH—CH=CH— | $(CH_2)_2OC_6H_6$ | p-$CH_3C_6H_4SO_3^-$ |
| IV'c-40 | O | 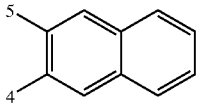 | O | 5',6'-benzo | 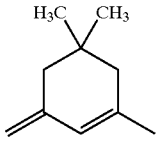 | $(CH_2)_2C_6H_6$ | p-$CH_3C_6H_4SO_3^-$ |
| IV'c-41 | S | 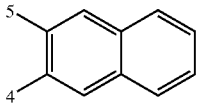 | S | 5'-Ph | 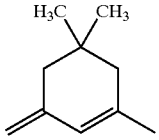 | $(CH_2)_2OC_6H_4OCH_3$-p | p-$CH_3C_6H_4SO_3^-$ |
| IV'c-42 | S | 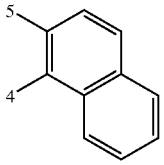 | S | 4',5'-benzo | =CH—CH=CH— | $(CH_2)_2OC_6H_5$ | p-$CH_3C_6H_4SO_3^-$ |
| IV'c-43 | S | 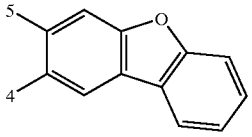 | S | 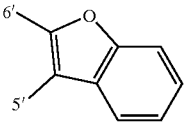 | 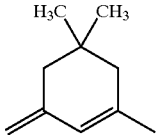 | $(CH_2)_2OC_6H_5$ | p-$CH_3C_6H_4SO_3^-$ |
| IV'c-44 | O | 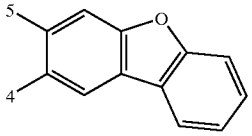 | O | 4',5'-benzo | 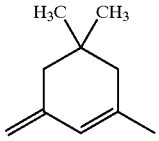 | $(CH_2)_4OC_6H_6$ | p-$CH_3C_6H_4SO_3^-$ |
IV'c-45
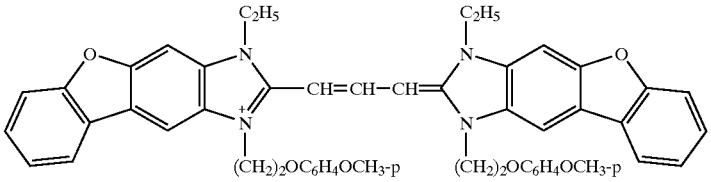
p-$CH_3C_6H_4SO_3^-$ -continued
IV'c-46
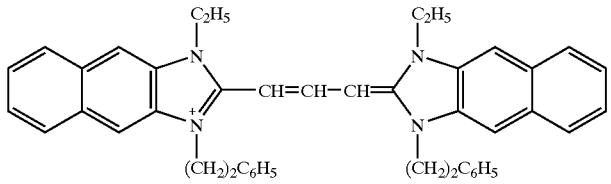
p-$CH_3C_6H_4SO_3^-$
IV'c-47
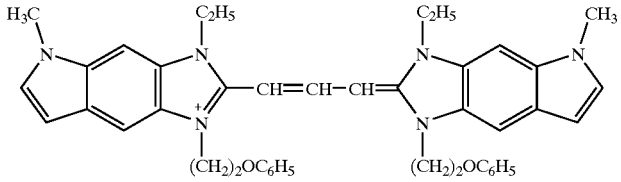
p-$CH_3C_6H_4SO_3$-
IV'c-48
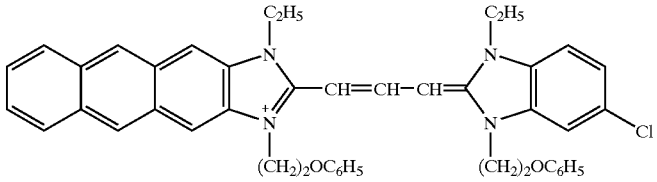
p-$CH_3C_6H_4SO_3^-$
IV'c-49
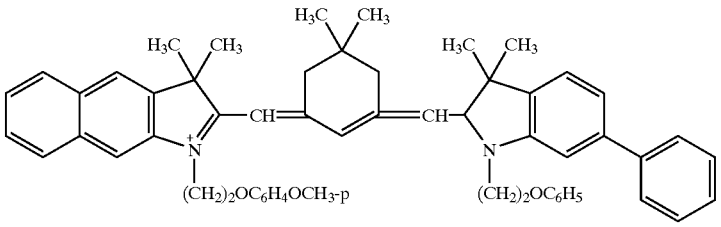
$I^-$
IV'c-50
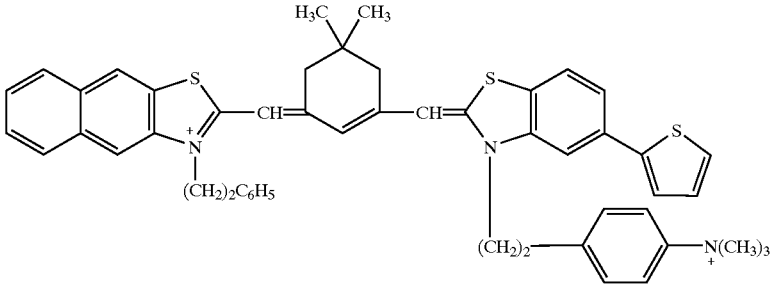
3Br Specific examples of the anionic dye contained in formulae (IV'a), (IV'-2), (IV'-4) and (V') are set forth below, however, the present invention is by no means limited thereto.

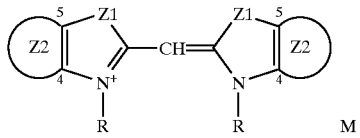

| No. | Z1 | Z2 | R | M |
|---|---|---|---|---|
| IV'a-1 | S | 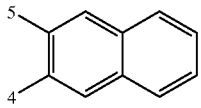 | $CH_2C_6H_4SO_3^-$-p | $HN^+(C_2H_5)_3$ |
| IV'a-2 | S | 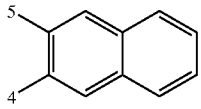 | $(CH_2)_2CH(SO_3^-)Ph$ | $HN^+(C_2H_5)_3$ |
| IV'a-3 | S | 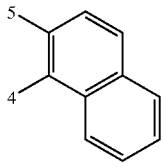 | $CH_2C_6H_4SO_3^-$-o | $HN^+(C_2H_5)_3$ |
| IV'a-4 | S | 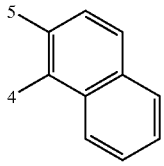 | $(CH_2)_2O(CH_2)_2O$ 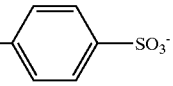 $SO_3^-$ | $Na^+$ |
| IV'a-5 | S | 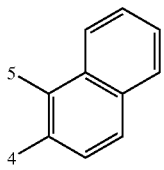 | $CH_2C_6H_4SO_3^-$-o | $HN^+(C_2H_5)_3$ |
| IV'a-6 | S | 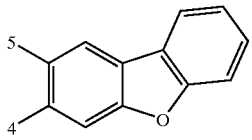 | $(CH_2)_2O(CH_2)_2O$ 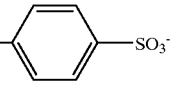 $SO_3^-$ | $HN^+(C_2H_5)_3$ |
| IV'a-7 | S | 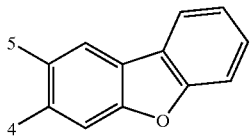 | $(CH_2)_2CH(SO_3^-)Ph$ | $HN^+(C_2H_5)_3$ |
| IV'a-8 | S | 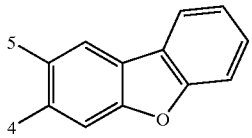 | $CH_2C_6H_4SO_3^-$-o | $HN^+(C_2H_5)_3$ |

-continued
| | | | | |
|---|---|---|---|---|
| IV'a-9 | O | 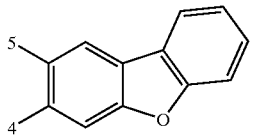 | $CH_2C_6H_4SO_3^-$-o | $HN^+(C_2H_5)_3$ |
| IV'a-10 | O | 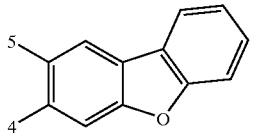 | $(CH_2)_2CH(SO_3^-)Ph$ | $HN^+(C_2H_5)_3$ |
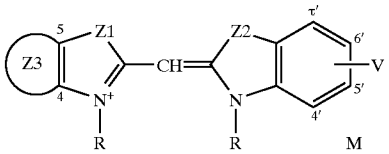
| No. | Z1 | Z3 | Z2 | V | R | M |
|---|---|---|---|---|---|---|
| IV'a-11 | S | 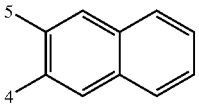 | O | 5',6'-benzo | $CH_2C_6H_4SO_3^-$-o | $HN^+(C_2H_5)_3$ |
| IV'a-12 | O | 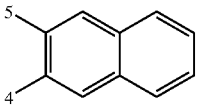 | O | 5'-(2-Thienyl) | $CH_2C_6H_3$-2,4-di$SO_3^-$ | $3Na^+$ |
| IV'a-13 | S | 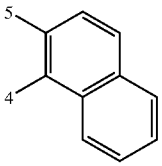 | O | 5'-(2-Furyl) | 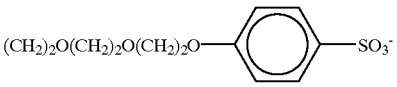 | $HN^+(C_2H_5)_3$ |
| IV'a-14 | S | 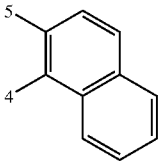 | O | 5'-Ph | 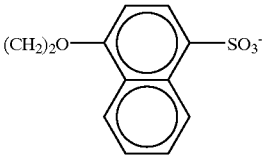 | $HN^+(C_2H_5)_3$ |
| IV'a-15 | S | 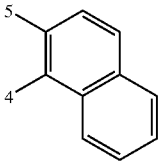 | O | 4',5'-benzo | $(CH_2)_2C_6H_4SO_3^-$-o | $HN^+(C_2H_5)_3$ |
| IV'a-16 | S | 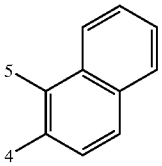 | O | 5'-Ph | $CH_2C_6H_3$-2,4-di$SO_3^-$ | $3HN^+(C_2H_5)_3$ |

-continued
| | | | | | | |
|---|---|---|---|---|---|---|
| IV'a-17 | S | 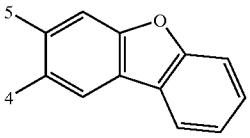 | O | 5',6'-benzo | $CH_2C_6H_4SO_3^-$-o | $HN^+(C_2H_5)_3$ |
| IV'a-18 | S | 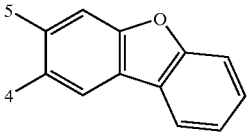 | O | 5'-Ph | 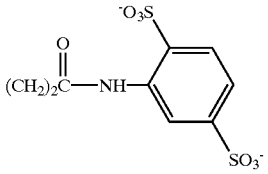 | $3Na^+$ |
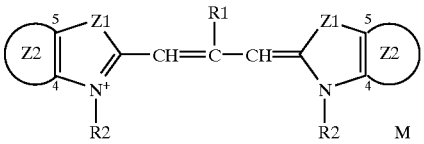
| No. | Z1 | Z2 | R1 | R2 | M |
|---|---|---|---|---|---|
| IV'a-19 | S | 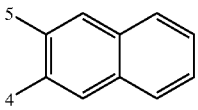 | $C_2H_5$ | $CH_2C_6H_4SO_3^-$-o | $HN^+(C_2H_5)_3$ |
| IV'a-20 | S | 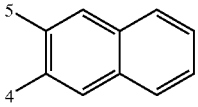 | $C_2H_5$ | 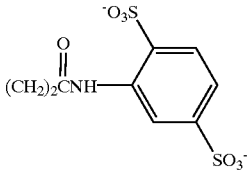 | $3Na^+$ |
| IV'a-21 | S | 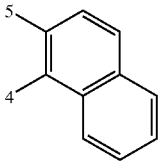 | $C_2H_5$ | $CH_2C_6H_4SO_3^-$-o | $HN^+(C_2H_5)_3$ |
| IV'a-22 | S | 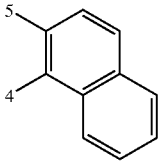 | $C_2H_5$ | $CH_2C_6H_3$-2,4-di$SO_3^-$ | $3Na^+$ |
| IV'a-23 | S | 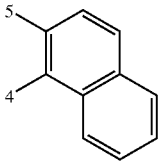 | $C_2H_5$ | $(CH_2)_2CH(SO_3^-)Ph$ | $HN^+(C_2H_5)_3$ |
| IV'a-24 | S | 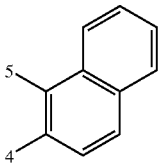 | $C_2H_5$ | $CH_2C_6H_4SO_3^-$-o | $HN^+(C_2H_5)_3$ |

-continued
| | | | | | |
|---|---|---|---|---|---|
| IV'a-25 | S | 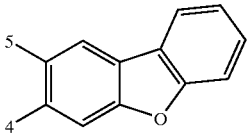 | $C_2H_5$ | $(CH_2)_2CH(SO_3^-)Ph$ | $HN^+(C_2H_5)_3$ |
| IV'a-26 | S | 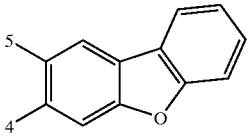 | $C_2H_5$ | $CH_2C_6H_4SO_3^-$-o | $HN^+(C_2H_5)_3$ |
| IV'a-27 | S | 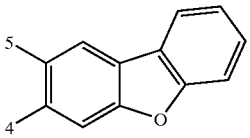 | $C_2H_5$ | 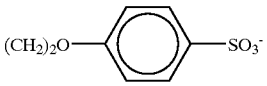 | $HN^+(C_2H_5)_3$ |
| IV'a-28 | S | 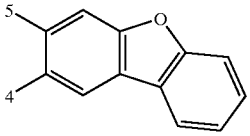 | $C_2H_5$ | $CH_2C_6H_4SO_3^-$-o | $HN^+(C_2H_5)_3$ |
| IV'a-29 | S | 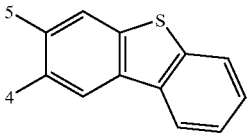 | $C_2H_5$ | $CH_2C_6H_4SO_3^-$-o | $HN^+(C_2H_5)_3$ |
| IV'a-30 | S | 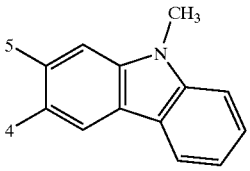 | $C_2H_5$ | $CH_2C_6H_4SO_3^-$-o | $HN^+(C_2H_5)_3$ |
| IV'a-31 | O | 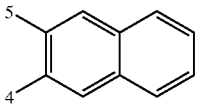 | $C_2H_5$ | $CH_2C_6H_4SO_3^-$-o | $HN^+(C_2H_5)_3$ |
| IV'a-32 | O | 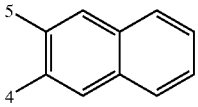 | $C_2H_5$ | $(CH_2)_2CH(SO_3^-)Ph$ | $HN^+(C_2H_5)_3$ |
| IV'a-33 | O | 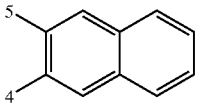 | $C_2H_5$ | 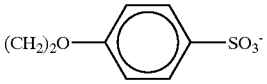 | $HN^+(C_2H_5)_3$ |
| IV'a-34 | O | 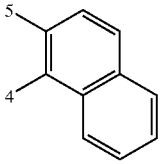 | $C_2H_5$ | $CH_2C_6H_4SO_3^-$-o | $HN^+(C_2H_5)_3$ |

-continued
| | | | | | |
|---|---|---|---|---|---|
| IV'a-35 | O | 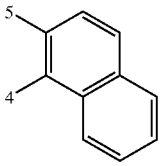 | $C_2H_5$ | $(CH_2)_2CH(SO_3^-)Ph$ | $HN^+(C_2H_5)_3$ |
| IV'a-36 | O | 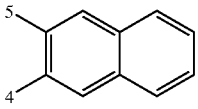 | $C_2H_5$ | 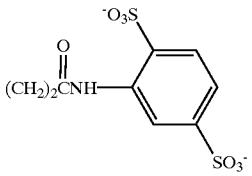 | $3HN^+(C_2H_5)_3$ |
| IV'a-37 | O | 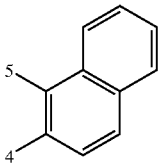 | $C_2H_5$ | $(CH_2)_2CH(SO_3^-)Ph$ | $Na^+$ |
| IV'a-38 | O | 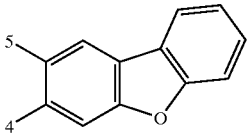 | $C_2H_5$ | $CH_2C_6H_4SO_3^-$-o | $HN^+(C_2H_5)_3$ |
| IV'a-39 | O | 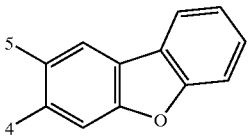 | $C_2H_5$ | 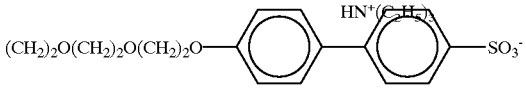 | $HN^+(C_2H_5)_3$ |
| IV'a-40 | O | 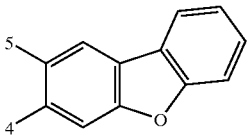 | $C_2H_5$ | 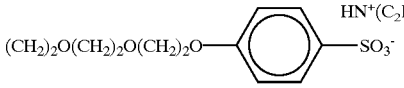 | $HN^+(C_2H_5)_3$ |
| IV'a-41 | O | 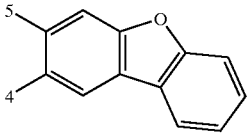 | $C_2H_5$ | $CH_2C_6H_4SO_3^-$-o | $HN^+(C_2H_5)_3$ |
| IV'a-42 | O | 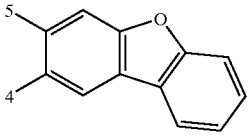 | $C_2H_5$ | $(CH_2)_2CH(SO_3^-)Ph$ | $HN^+(C_2H_5)_3$ |
| IV'a-43 | O | 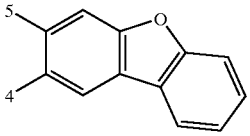 | $C_2H_5$ | 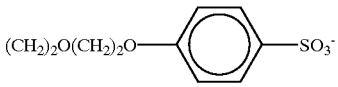 | $HN^+(C_2H_5)_3$ |
| IV'a-44 | O | 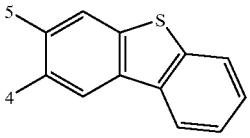 | $C_2H_5$ | $CH_2C_6H_4SO_3^-$-o | $HN^+(C_2H_5)_3$ |

-continued
| | | | | | |
|---|---|---|---|---|---|
| IV'a-45 | O | 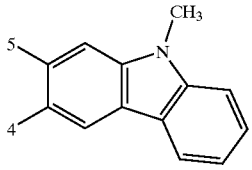 | $C_2H_5$ | $CH_2C_6H_4SO_3^-$-o | $HN^+(C_2H_5)_3$ |
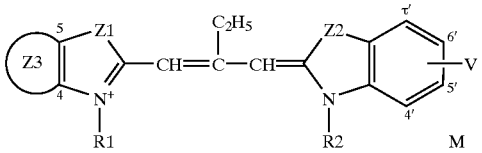
| No. | Z1 | Z3 | Z2 | V | R1 |
|---|---|---|---|---|---|
| IV'a-46 | S | 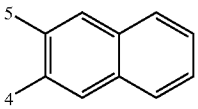 | O | 5',6'-benzo | $CH_2C_6H_4SO_3^-$-o |
| IV'a-47 | S | 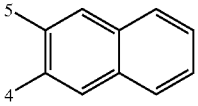 | O | 5',6'-benzo | $(CH_2)_2CH(SO_3^-)Ph$ |
| IV'a-48 | S | 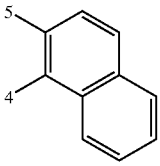 | O | 5'-Ph | $CH_2C_6H_4SO_3^-$-o |
| IV'a-49 | S | 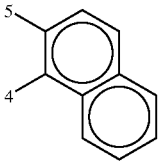 | O | 6',7'-benzo | 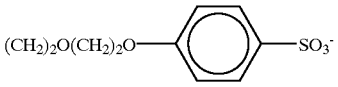 |
| IV'a-50 | S | 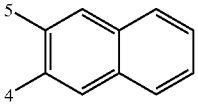 | O | 5'-Ph | $CH_2C_6H_4SO_3^-$-o |
| IV'a-51 | S | 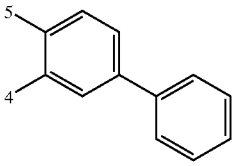 | O | 5'-Ph | $CH_2C_6H_4SO_3^-$-o |
| IV'a-52 | S | 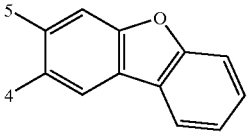 | O | 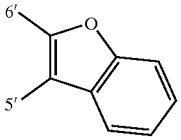 | $CH_2C_6H_4SO_3^-$-o |

-continued

| | | | | | |
|---|---|---|---|---|---|
| IV'a-53 | S | 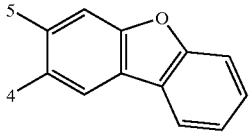 | O | 5'-Ph | $(CH_2)_2CH(SO_3^-)Ph$ |
| IV'a-54 | S | 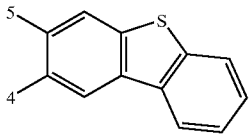 | O | 5'-Ph | $(CH_2)_2CH(SO_3^-)Ph$ |
| IV'a-55 | S | 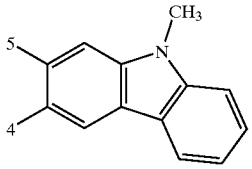 | O | 5'-(2-Furyl) | $(CH_2)_2CH(SO_3^-)Ph$ |
| IV'a-56 | S | 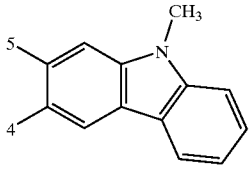 | O | 5'-Ph | $(CH_2)_2CH(SO_3^-)Ph$ |

| | R2 | M |
|---|---|---|
| IV'a-46 | $CH_2C_6H_4SO_3^-$-o | $HN^+(C_2H_5)_3$ |
| IV'a-47 | $CH_2C_6H_4SO_3^-$-o | $HN^+(C_2H_5)_3$ |
| IV'a-48 | $CH_2C_6H_4SO_3^-$-o | $HN^+(C_2H_5)_3$ |
| IV'a-49 | $CH_2C_6H_4SO_3^-$-o | $Na^+$ |
| IV'a-50 | 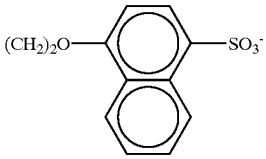 | $Na^+$ |
| IV'a-51 | $CH_2C_6H_4SO_3^-$-o | $Na^+$ |
| IV'a-52 | $CH_2C_6H_4SO_3^-$-o | $HN^+(C_2H_5)_3$ |
| IV'a-53 | $CH_2C_6H_4SO_3^-$-o | $HN^+(C_2H_5)_3$ |
| IV'a-54 | $CH_2C_6H_4SO_3^-$-o | $HN^+(C_2H_5)_3$ |
| IV'a-55 | $(CH_2)_2CH(SO_3^-)Ph$ | $Na^+$ |
| IV'a-56 | 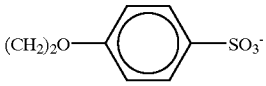 | $Na^+$ |

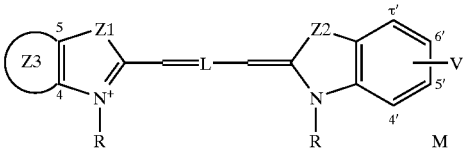

| No. | Z1 | Z3 | Z2 | V | L | R | M |
|---|---|---|---|---|---|---|---|
| IV'a-57 | S | 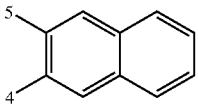 | S | 5',6'-benzo | ═CH—CH═CH— | $CH_2C_6H_4SO_3^-$-o | $HN^+(C_2H_5)_3$ |

-continued
| | | | | | | | |
|---|---|---|---|---|---|---|---|
| IV'a-58 | O | 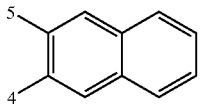 | O | 5',6'-benzo | 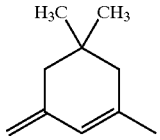 | $(CH_2)_2CH(SO_3^-)Ph$ | $HN^+(C_2H_5)_3$ |
| IV'a-59 | O | 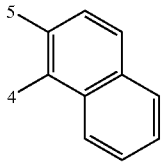 | O | 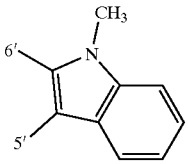 | 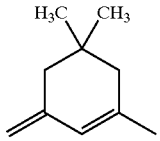 | $(CH_2)_2C_6H_4SO_3^-$-p | $HN^+(C_2H_5)_3$ |
| IV'a-60 | O | 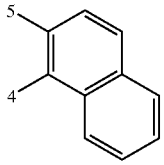 | O | 4',5'-benzo | 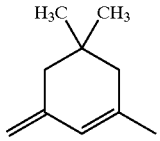 | $(CH_2)_2C_6H_4SO_3^-$-p | $HN^+(C_2H_5)_3$ |
| IV'a-61 | O | 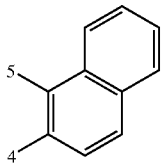 | O | 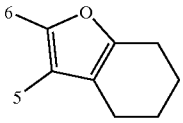 | 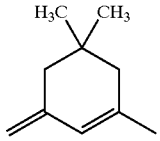 | $CH_2C_6H_4SO_3^-$-o | $HN^+(C_2H_5)_3$ |
IV'a-62
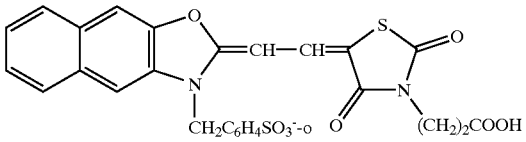
$HN(C_2H_5)_3^+$
IV'a-63
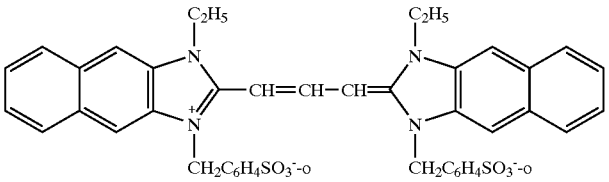
$HN(C_2H_5)_3^+$
IV'a-64
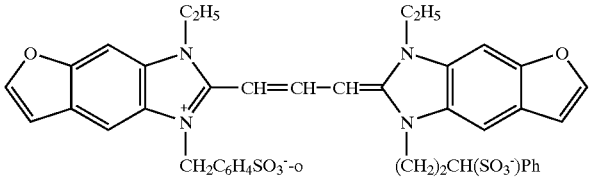
$HN(C_2H_5)_3^+$ -continued
IV'a-65
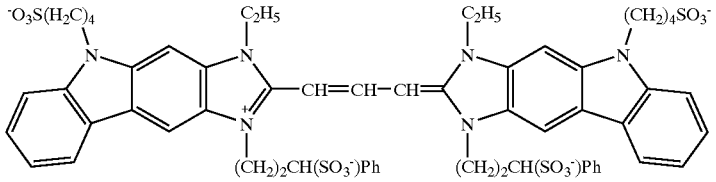
$3Na^+$
IV'a-66
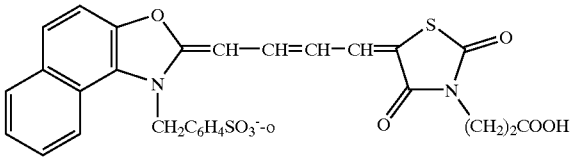
$HN(C_2H_5)_3^+$
IV'a-67
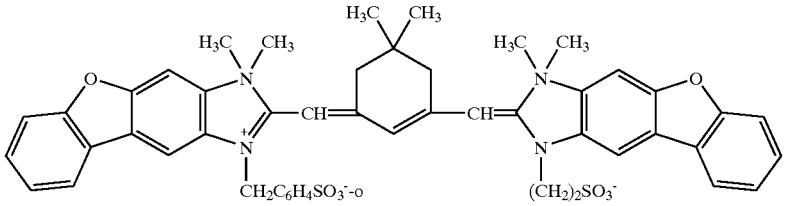
$HN(C_2H_5)_3^+$
IV'a-68
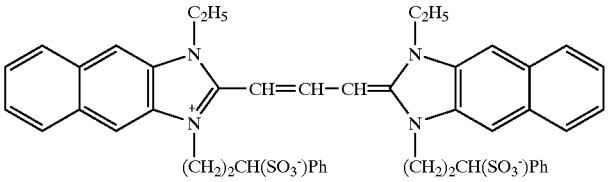
$HN(C_2H_5)_3^+$
IV'a-69
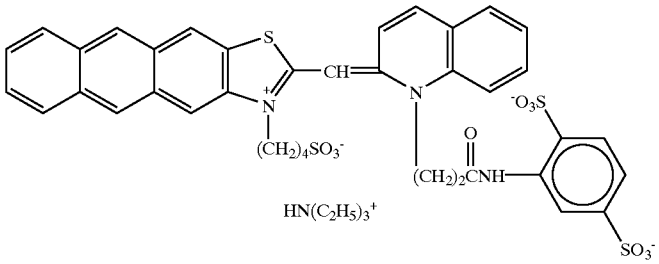
$HN(C_2H_5)_3^+$ -continued IV'a-70

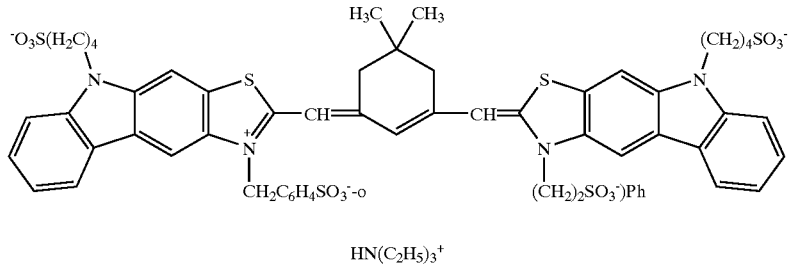

The dyes of the present invention can be synthesized according to the methods described in F. M. Harmer, *Heterocyclic Compounds—Cyanine Dyes and Related Compounds, John Wiley & Sons, New York, London* (1964), D. M. Sturmer, *Heterocyclic Compounds—Special topics in heterocyclic chemistry,* Chap. 18, Sec. 14, pp. 482–515, John Wiley & Sons, New York, London (1977), *Rodd's Chemistry of Carbon Compounds,* 2nd ed., Vol. IV, Part B, Chap. 15, pp. 369–422, Elsevier Science Publishing Company Inc., New York (1977), and patents and literatures described above (cited for describing specific examples).

The present invention is not limited only to the use of sensitizing dyes of the present invention but a spectral sensitizing dye other than those of the present invention may also be used in combination.

To the dyes used in combination, any nucleus usually used as a basic heterocyclic nucleus in cyanine dyes may be applied. Namely, Examples of the nucleus include a pyrroline nucleus, a toxazoline nucleus, a thiazoline nucleus, a pyrrol nucleus, a oxazole nucleus, a thiazole nucleus, a selenazole nucleus, a imidazol nucleus, a tetrazole nucleus and a pyridine nucleus; nuclei obtained by fusing an alicyclic or aromatic hydrocarbon ring to the above-described nuclei (e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei each may be substituted on a carbon atom.

To the merocyanine dye or composite merocyanine dye, a 5- or 6-membered heterocyclic nucleus may be applied as a nucleus having a ketomethylene structure, such as pyrazolin-5-one nucleus, thiohydantoin nucleus, 2-thiooxazolidine-2,4-dione nucleus, thiazolidine-2,4-dione nucleus, rhodanine nucleus, thiobarbituric acid nucleus and 2-thioselenazoline-2,4-dione nucleus may be applied.

For examples, the compounds described in *Research Disclosure,* No. 17643, page 23, Item IV (December, 1978) and the compounds described in the literatures cited therein may be used.

The concrete compounds (dyes) used are shown below:

a: 5,5'-dichloro-3,3'-diethylthiacyanine bromide b: 5,5'-dichloro-3,3'-di(4-sulfobutyl)-thiacyanine sodium salt c: 5-methoxy-4,5-benzo-3,3'-di(3-sulfopropyl)thiacyanine sodium salt d: 5,5'-dichloro-3,3'-diethylselenacyanine iodide e: 5,5'-dichloro-9-ethyl-3,3'-di(3-sulfopropyl) thiacarbocyanine pyridinium salt f: anhydro-5,5'-dichloro-9-ethyl-3-(4-sulfobutyl)-3'-ethyl hydroxide g: 1,1-diethyl-2,2'-cyanine bromide h: 1,1-dipentyl-2,2'-cyanineperchloric acid i: 9-methyl-3,3'-di(4-sulfobutyl)-thiacarbocyanine pyridinium salt j: 5,5'-diphenyl-9-ethyl-3,3'-di(2-sulfoethyl) oxacarbocyanine sodium salt k: 5-chloro-5'-phenyl-9-ethyl-3-(3-sulfopropyl)-3'-(2-sulfoethyl)oxacarbocyanine sodium salt l: 5,5'-dichloro-9-ethyl-3,3'-di(3-sulfopropyl) oxacarbocyanine sodium salt m: 5,5'-dichloro-6,6'-dichloro-l,1'-diethyl-3,3'-di(3-sulfopropyl)imidacarbocyanine sodium salt n: 5,5'-diphenyl-9-ethyl-3,3'-di(3-sulfopropyl) thiacarbocyanine sodium salt The sensitizing dye for use in the present invention may be incorporated into the silver halide photographic emulsion of the present invention by directly dispersing the sensitizing dye in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran and N,N-dimethylformamide, or a mixed solvent thereof.

Also, a method of dissolving a dye in a volatile organic solvent, dispersing the solution in water or hydrophilic colloid and adding the dispersion in the emulsion described in U.S. Pat. No. 3,469,987, a method of dispersing a water-insoluble dye in a water-soluble solvent without dissolving the dye, and adding this dispersion to the emulsion described in JP-B-64-24185 (the term "JP-B" as used herein means an "examined Japanese patent publication"), a method of dissolving a dye in an acid and adding the solution to the emulsion or forming an aqueous solution while allowing an acid or base to be present together and adding the solution to the emulsion described in JP-B-44-23389, JP-B-44-27555 and JP-B-57-22091, a method of forming an aqueous solution or colloid dispersion by allowing a surface active agent to be present together and adding the solution or dispersion to the emulsion described in U.S. Pat. Nos. 3,822,135 and 4,006,025, a method of directly dispersing a dye in a hydrophilic colloid and adding the dispersion to the emulsion described in JP-A-53-102733 and JP-A-58-105141, and a method of dissolving a dye using a compound capable of red shifting, and adding the solution to the emulsion described in JP-A-51-74624 may be used.

For dissolving the dye, an ultrasonic wave may also be used.

The use method and preferred embodiments of the dyes represented by formulae (IV'), (IV'-1) to (IV'-4), (V'), (IV'c) and (IV'a) of the present invention are described below.

In the present invention, when the anionic dye and the cationic dye are used at the same time, the anionic dye and the cationic dye both preferably occupy 30% or more in the total amount of sensitizing dyes added.

Furthermore, it is preferred that either one of the cationic dye and the anionic dye is added in an amount corresponding to 80% or more of the saturation coverage and also added in an amount such that the total amount of sensitizing dyes added corresponds to 160% or more of the saturation coverage.

The dyes may be added after previously mixing those two dyes, however, the cationic dye and the anionic dye are preferably added separately. In a preferred embodiment, the cationic dye is added earlier, in a more preferred embodiment, the cationic dye is added in an amount corresponding to 80% or more of the saturation coverage and then the anionic dye is added, and in a still more preferred embodiment, the cationic dye is added in an amount corresponding to 80% or more of the saturation coverage and then the anionic dye is added in an amount corresponding to 50% of the saturation coverage.

In the case of adding the dyes separately, the dye added later preferably has a fluorescence yield in gelatin dry film, of 0.5 or more, more preferably 0.8 or more.

The dyes may be added at any time during the preparation of emulsion. Also, the dyes may be added at any temperature, however, the emulsion temperature at the addition of dyes is preferably from 10 to 75° C., more preferably from 30 to 65° C.

For the photographic emulsion undertaking the photosensitive mechanism in the present invention, any of silver bromide, silver iodobromide, silver chlorobromide, silver iodide, silver iodochloride, silver iodobromo-chloride and silver chloride may be used. However, the halogen composition on the outermost surface of emulsion grain preferably has an iodide content of 0.1 mol % or more, more preferably 1 mol % or more, still more preferably 5 mol % or more, whereby the multi-layer adsorption structure can be more firmly constructed.

The grain size distribution may be either broad or narrow but narrow distribution is preferred.

The silver halide grain of the photographic emulsion may be a grain having a regular crystal form such as cubic, octahedral, tetradecahedral or rhombic dodecahedral form, a grain having an irregular crystal form such as spherical or tabular form, a grain having a (hkl) face, or a mixture of grains having these crystal forms, however, a tabular grain is preferred. The tabular grain is described in detail later. The grain having a (hkl) face is described in *Journal of Imaging Science,* Vol. 30, pp. 247–254 (1986).

For the silver halide photographic emulsion for use in the present invention, the above-described silver halide grains may be used either individually or in mixture of a plurality of grains. The silver halide grain may have different phases between the interior and the surface layer, may have a multi-phase structure, for example, with a conjugation structure, may have a localized phase on the grain surface or may have a uniform phase throughout the grain. These grains may also be present together.

These various emulsions each may be either a surface latent image-type emulsion in which a latent image is mainly formed on the surface, or an internal latent image-type emulsion in which a latent image is formed inside the grain.

The silver halide emulsion for use in the present invention is preferably a tabular silver halide grain having a higher ratio of surface area/volume and having adsorbed thereto a sensitizing dye disclosed in the present invention. The aspect ratio of the grain is 2 or more (preferably 100 or less), preferably from 5 to 80, more preferably from 8 to 80, and the thickness of the tabular grain is preferably less than 0.2 μm, more preferably less than 0.1 μm, still more preferably less than 0.07 μm. For preparing a tabular grain having such a high aspect ratio and a small thickness, the following technique is applied.

In the present invention, a silver halide tabular grain having a halogen composition of silver chloride, silver bromide, silver chlorobromide, silver iodobromide, silver chloroiodobromide or silver iodochloride is preferably used. The tabular grain preferably has a main plane of (100) or (111). The tabular grain having a (111) main plane is hereinafter referred to as a (111) tabular grain and this grain usually has a triangular or hexagonal face. In general, when the distribution becomes more uniform, tabular grains having a hexagonal face occupy a higher ratio. JP-B-5-61205 describes the monodisperse hexagonal tabular grains.

The tabular grain having a (100) face as the main plane is hereinafter called a (100) tabular grain and this grain has a rectangular or square form. In the case of this emulsion, a grain having a ratio of adjacent sides of less than 5:1 is called a tabular grain rather than an acicular grain. When the tabular grain is silver chloride or a grain having a high silver chloride content, the (100) tabular grain is higher in the stability of the main plane than that of the (111) tabular grain. Therefore, the (111) tabular grain must be subjected to stabilization of the (111) main plane, and the method therefor is described in JP-A-9-80660, JP-A-9-80656 and U.S. Pat. No. 5,298,388.

The (111) tabular grain comprising silver chloride or having a high silver chloride content for use in the present invention is disclosed in the following patents:

U.S. Pat. Nos. 4,414,306, 4,400,463, 4,713,323, 4,783,398, 4,962,491, 4,983,508, 4,804,621, 5,389,509, 5,217,858 and 5,460,934.

The (111) tabular grain having a high silver bromide content for use in the present invention is described in the following patents:

U.S. Pat. Nos. 4,425,425, 4,425,426, 4,434,266, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grain for use in the present invention is described in the following patents:

U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

The silver halide emulsion is generally subjected to chemical sensitization before use. The chemical sensitization is performed using chalcogen sensitization (e.g., sulfur sensitization, selenium sensitization, tellurium sensitization), noble metal sensitization (e.g., gold sensitization) and reduction sensitization individually or in combination.

In the present invention, the silver halide emulsion is preferably subjected to at least selenium sensitization. More specifically, selenium sensitization alone or a combination of selenium sensitization with another chalcogen sensitization and/or noble metal sensitization (particularly gold sensitization) is preferred, and a combination of selenium sensitization and noble metal sensitization is more preferred.

In the selenium sensitization, a labile selenium compound is used as a sensitizer. The labile selenium compound is described in JP-B-43-13489, JP-B-44-15748, JP-A-4-25832, JP-A-4-109240, JP-A-4-271341 and JP-A-5-40324. Examples of the selenium sensitizer include colloidal metal selenium, selenoureas (e.g., N,N-dimethylselenourea, trifluoromethylcarbonyl-trimethylselenourea, acetyl-trimethylselenourea), selenoamides (e.g., selenoamide, N,N-diethylphenylselenoamide), phosphine selenides (e.g., triphenylphosphineselenide, pentafluorophenyl-triphenylphosphineselenide), selenophosphates (e.g., tri-p-tolylselenophosphate, tri-n-butylselenophosphate), selenoketones (e.g., selenobenzophenone), isocyanates, selenocarboxylic acids, selenoesters and diacyl selenides. In addition, relatively stable selenium compounds such as selenious acid, potassium selenocyanate, selenazoles and selenides (described in JP-B-46-4553 and JP-B-52-34492) may also be used as a selenium sensitizer.

In the sulfur sensitization, a labile sulfur compound is used as a sensitizer. The labile sulfur compound is described in P. Glafkides, *Chemie et Physique Photographique,* 5th ed., Paul Montel (1987), and *Research Disclosure,* Vol. 307, No. 307105. Examples of the sulfur sensitizer include thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethyl-rhodanine), phosphinesulfides (e.g., trimethylphosphinesulfide), thiohydantoins, 4-oxo-oxazolidine-2-thiones, dipolysulfides (e.g., dimorpholinedisulfide, cystine, hexathiocane-thione), mercapto compounds (cysteine), polythionic acid salts and elemental sulfur. Also, an active gelatin may be used as the sulfur sensitizer.

In the tellurium sensitization, a labile tellurium compound is used as a sensitizer. The labile tellurium compound is described in Canadian Patent 800,958, British Patents 1,295,462 and 1,396,696, JP-A-4-204640, JP-A-4-271341, JP-A-4-333043 and JP-A-5-303157. Examples of the tellurium sensitizer include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphophinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(ethoxycarbonyl)telluride), isotellurocyanates, telluroamides, tellurohydrzides, telluroesters (e.g., butylhexyltelluroester), telluroketones (e.g., telluroacetophenone), colloidal tellurium, (di)tellurides and other tellurium compounds (e.g., potassium telluride, telluropentathionate sodium salt).

In the noble metal sensitization, a salt of noble metals such as gold, platinum, palladium and iridium is used as a sensitizer. The noble metal salt is described in P. Glafkides, *Chemie et Phisique Photographique,* 5th ed., Paul Montel (1987) and *Research Disclosure,* Vol. 307, No. 307105. Among these, gold sensitization is preferred. As described above, the present invention is particularly effective in the embodiment where gold sensitization is performed.

In *Photographic Science and Engineering,* Vol. 19322 (1975) and *Journal of Imaging Science,* Vol. 3228 (1988), it is stated that a solution containing potassium cyanide (KCN) can remove gold from a sensitization nucleus on an emulsion grain. According to these publications, gold atom or gold ion adsorbed to a silver halide grain is liberated as a cyan complex by cyan ion, whereby the gold sensitization is inhibited. When the generation of cyan is prevented in accordance with the present invention, the action of gold sensitizer can be fully brought out.

Examples of the gold sensitizer include chloroauric acid, potassium chloroaurate, potassium aurithiocyanate, gold sulfide and gold selenide. The gold compounds described in U.S. Pat. Nos. 2,642,361, 5,049,484 and 5,049,485 may also be used.

In the reduction sensitization, a reducing compound is used as a sensitizer. The reducing compound is described in P. Glafkides, *Chemie et Phisique Photographique,* 5th ed., Paul Montel, (1987), and *Research Disclosure,* Vol. 307, No. 307105. Examples of the reducing sensitizer include aminoiminomethanesulfinic acid (i.e., thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfites, aldehyde compounds and hydrogen gas. The reduction sensitization may also be performed by an atmosphere of high pH or excess silver ion (so-called silver ripening). The reduction sensitization is preferably applied at the formation of silver halide grains.

The amount of the sensitizer used is generally determined according to the kind of silver halide grain and the conditions of chemical sensitization.

The amount of the chalcogen sensitizer used is from $10^{-8}$ to $10^{-2}$ mol, preferably from $10^{-7}$ to $5\times10^{-3}$ mol, per mol of silver halide. The amount of the noble metal sensitizer used is preferably from $10^{-7}$ to $10^{-2}$ mol per mol of silver halide.

The conditions for chemical sensitization are not particularly limited. The pAg is generally from 6 to 11, preferably from 7 to 10. The pH is preferably from 4 to 10. The temperature is preferably from 40 to 95° C., more preferably from 45 to 85° C.

With respect to the preparation method and the like of the photographic emulsion for use in the present invention, JP-A-10-239789, column 63, line 36 to column 65, line 2, may be applied.

Furthermore, with respect to the additives such as color coupler, additives to the photographic light-sensitive material, the kind of light-sensitive material to which the present invention can be applied, the processing of the light-sensitive material, and the like, JP-A-10-239789, column 65, line 3 to column 73, line 13 may be applied.

The present invention is described in greater detail below by referring to the Examples, however, the present invention should not be construed as being limited thereto.

EXAMPLE 1

Preparation of Silver Bromide Octahedral Emulsion (Emulsion A) and Silver Bromide Tabular Emulsions (Emulsion B and Emulsion C)

To a reactor, 1,000 ml of water, 25 g of deionized ossein gelatin, 15 ml of a 50% $NH_4NO_3$ aqueous solution and 7.5 ml of a 25% $NH_3$ aqueous solution were charged. The resulting solution was kept at 50° C. and thoroughly stirred and thereto, 750 ml of a 1N aqueous silver nitrate solution and 1 mol/l of an aqueous potassium bromide solution were added over 50 minutes. During the reaction, the silver potential was kept at −40 mV. The silver bromide grain obtained was octahedral and had an equivalent sphere diameter of 0.846±0.036 μm. The temperature of the thus-obtained emulsion was lowered and after adding thereto a copolymer of isobutene and maleic acid sodium salt as a coagulant, desalted by precipitation washing. Subsequently, 95 g of deionized ossein gelatin and 430 ml of water were added thereto and the resulting solution was adjusted to have a pH of 6.5 and a pAg of 8.3 at 50° C. Thereto, potassium thiocyanate, chloroauric acid and sodium thiosulfate were added to give optimal sensitivity, and then this emulsion was ripened at 55° C. for 50 minutes. The emulsion obtained was designated as Emulsion A.

In 1.2 l of water, 6.4 g of potassium bromide and 6.2 g of a low molecular weight gelatin having an average molecular weight of 15,000 or less were dissolved, and while keeping the resulting solution at 30° C., 8.1 ml of a 16.4% aqueous silver nitrate solution and 7.2 ml of a 23.5% aqueous potassium bromide solution were added by a double jet method over 10 seconds. Subsequently, a 11.7% aqueous gelatin solution was further added and after raising the temperature to 75° C., the solution obtained was ripened for 40 minutes. Thereafter, 370 ml of a 32.2% aqueous silver nitrate solution and a 20% aqueous potassium bromide solution were added over 10 minutes while keeping the silver potential at −20 mV. After physical ripening for 1 minute, the temperature was lowered to 35° C. In this way, a monodisperse silver bromide tabular emulsion (specific gravity: 1.15) having an average projected area of 2.32 $\mu$m, a thickness of 0.09 $\mu$m and a variation coefficient of diameter of 15.1% was obtained. After this, the soluble salts were removed by a coagulating precipitation method. While again keeping the temperature at 40° C., 45.6 g of gelatin, 10 ml of an aqueous sodium hydroxide solution in a concentration of 1 mol/l, 167 ml of water and 1.66 ml of 35% phenoxy ethanol were added and the pAg and the pH were adjusted to 8.3 to 6.20, respectively. Thereto, potassium thiocyanate, chloroauric acid and sodium thiosulfate were added to give an optimal sensitivity, and then this emulsion was ripened at 55° C. for 50 minutes. The emulsion obtained was designated as Emulsion B. Also, an emulsion was prepared by performing the chemical sensitization using potassium thiocyanate, chloroauric acid, pentafluorophenyldiphenylphosphineselenide and sodium thiosulfate in place of potassium thiocyanate, chloroauric acid and sodium thiosulfate, and designated as Emulsion C. Assuming that the dye occupation area is 80 Å$^2$, the single layer saturation coverage amounts of Emulsion A and B were $5.4\times10^{-4}$ mol/mol-Ag and $1.42\times10^{-3}$ mol/mol-Ag, respectively.

To each of the thus-obtained emulsions, a first dye shown in Table 1 was added while keeping the emulsion at 50° C., and then each emulsion was stirred for 30 minutes. Thereafter, a second dye and a third dye were continuously added and each emulsion was further stirred at 50° C. for 30 minutes.

TABLE 1

| | Emulsion | First Dye and Amount Added (mol/mol Ag) | Second Dye and Amount Added (mol/mol Ag) | Third Dye and Amount Added (mol/mol Ag) |
|---|---|---|---|---|
| Comparative Example 1 | B | I-52 ($1.56 \times 10^{-3}$) | II-63 ($3.12 \times 10^{-3}$) | |
| Comparative Example 2 | B | I-52 ($1.56 \times 10^{-3}$) | II-38 ($3.12 \times 10^{-3}$) | |
| Comparative Example 3 | B | I-52 ($1.56 \times 10^{-3}$) | I-52 ($1.56 \times 10^{-3}$) | II-63 ($1.56 \times 10^{-3}$) |
| Invention 1 | B | I-52 ($1.56 \times 10^{-3}$) | I-35 ($1.56 \times 10^{-3}$) | II-38 ($1.56 \times 10^{-3}$) |
| Invention 2 | C | I-52 ($1.56 \times 10^{-3}$) | I-35 ($1.56 \times 10^{-3}$) | II-38 ($1.56 \times 10^{-3}$) |
| Invention 3 | A | I-52 ($5.94 \times 10^{-4}$) | I-35 ($5.94 \times 10^{-4}$) | II-38 ($5.94 \times 10^{-4}$) |

The amount of dye adsorbed was determined as follows. Each liquid emulsion obtained was centrifuged and thereby precipitated at 10,000 rpm for 10 minutes, the precipitate was freeze-dried, 25 ml of a 25% aqueous sodium thiosulfate solution and methanol were added to 0.05 g of the precipitate to form 50 ml of solution, the solution obtained was analyzed by high-speed liquid chromatography, and the dye density was quantitated.

The light absorption intensity per unit area was measured as follows. The emulsions obtained each was thinly coated on a slide glass and the transmission spectrum and reflection spectrum of individual grains were determined using a microspectrophotometer MSP65 manufactured by Karl Zweiss K.K. by the following method to determine the absorption spectrum. For the transmission spectrum, the area where grains were not present was used as the reference, and the reference for the reflection spectrum was obtained by measuring silicon carbide of which reflectance is known. The measured area is a circular aperture part having a diameter of 1 $\mu$m. After adjusting the position not to allow the aperture part to overlap the contour of a grain, the transmission spectrum and the reflection spectrum were measured in the wave number region of from 14,000 cm$^{-1}$ (714 nm) to 28,000 cm$^{-1}$ (357 nm). The absorption spectrum was determined from the absorption factor A which is 1−T (transmittance)−R (reflectance). Using the absorption factor A' obtained by subtracting the absorption of silver halide, −Log(1−A') was integrated with respect to the wave number (cm$^{-1}$) and the value obtained was halved and used as a light absorption intensity per unit area. The integration range is from 14,000 to 28,000 cm$^{-1}$. At this time, the light source used was a tungsten lamp and the light source voltage was 8 V. In order to minimize the damage of dye due to the light irradiation, a monochromator in the primary side was used and the wavelength distance and the slit width were set to 2 nm and 2.5 nm, respectively.

For determining the absorption spectrum of emulsion, the infinite diffusion reflectance of a finished emulsion was converted according to the Kubelka-Munk equation using as a control an emulsion in which a dye was not added, and absorption spectrum of only the dye was obtained.

The spectral sensitivity of the coated film was determined from the amount of exposure necessary for giving a density of fog +0.2 when exposure was performed using a spectral exposing machine adjusted such that the photon numbers of respective wavelengths can be the same in the exposure wavelength region.

Figure 2:
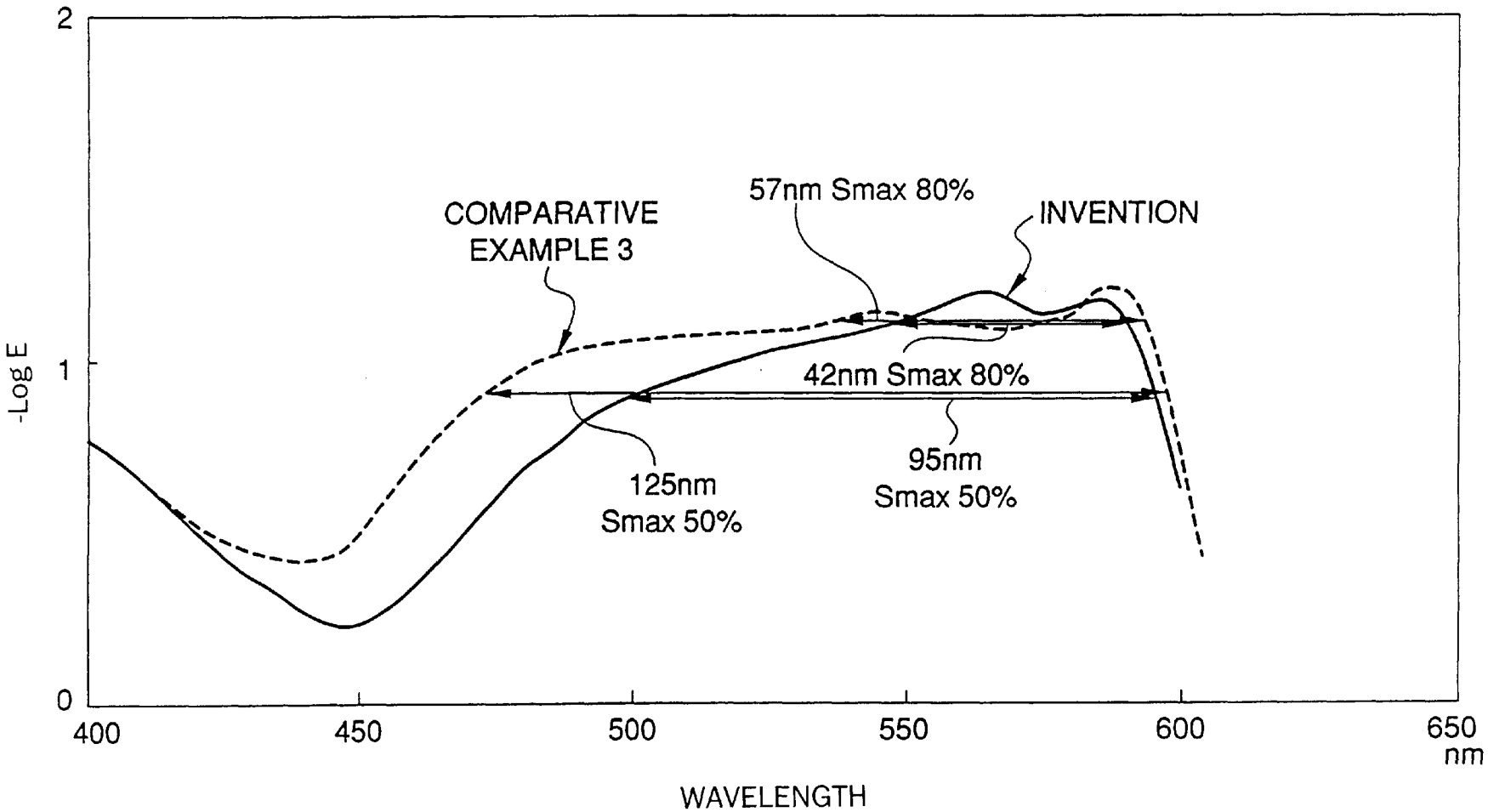
FIG. 2 shows a spectral sensitivity distribution (E is the amount of exposure necessary for giving a density of fog+0.2).

In FIG. 1 and FIG. 2, "Present Invention" shows the absorption spectrum and spectral sensitivity distribution of Invention 1, and "Comparative Example 3" shows the absorption spectrum and spectral sensitivity of Comparative Example 3.

A gelatin hardening agent and a coating aid were added to each emulsion obtained and the emulsions each was coated on a cellulose acetate film support simultaneously with the gelatin protective layer to have a coated silver amount of 3.0 g-Ag/m$^2$. The film formed was exposed to a tungsten bulb (color temperature: 285° K.) for 1 second through a continuous wedge color filter. By using as the color filter Fuji Gelatin Filter SC-50 (manufactured by Fuji Photo Film Co., Ltd.) capable of exciting the dye side, light of 500 nm or less was cut at the irradiation on samples. Each exposed sample was developed with the following surface developer MAA-1 at 20° C. for 10 minutes.

Surface Developer MAA-1

| | |
|---|---|
| Metol | 2.5 g |
| L-Ascorbic acid | 10.0 g |
| Nabox (produced by Fuji Photo Film Co., Ltd.) | 35.0 g |
| Potassium bromide | 1 g |
| Water to make | 1 liter |
| pH | 9.8 |

The developed film was measured on the optical density by Fuji Automatic Densitometer. The sensitivity is a reciprocal of light intensity necessary for giving an optical density of fog+0.2 and shown by a value while assuming that the sensitivity when only the first dye was added is 100.

The results are shown in Table 2.

EXAMPLE 2

A pure silver chloride tabular grain emulsion was prepared in the same manner as Emulsion D in Example 2 of JP-A-8-227117. The grain surface area was $5.15\times10^2$ m$^2$/mol-Ag and when the dye occupation area was taken as 80 Å$^2$, the single layer saturation coverage was $1.07\times10^{-3}$ mol/mol-Ag. In place of Sensitizing Dyes 2 and 3, $1.1\times10^{-3}$ mol/mol-Ag of Sensitizing Dye I-6 was added at 56° C. and after stirring the solution for 30 minutes, $6.0\times10^{-4}$ mol/mol-Ag of Sensitizing Dye I-6 and $6.0\times10^{-4}$ mol/mol-Ag of Sensitizing Dye II-7 were added. The resulting solution was further stirred for 20 minutes and then subjected to chemical sensitization in the same manner as Emulsion D in Example 2 of JP-A-8-227117. The emulsion obtained was designated as Emulsion 2A (Comparison). In place of Sensitizing Dyes 2 and 3, $1.1\times10^{-3}$ mol/mol-Ag of Sensitizing Dye I-6 was added at 56° C. and after stirring the solution for 30 minutes, $6.0\times10^{-4}$ mol/mol-Ag of Sensitizing Dye I-4 and $6.0\times10^{-4}$ mol/mol-Ag of Sensitizing Dye II-4 were added. The resulting solution was further stirred for 20 minutes and then subjected to chemical sensitization in the same manner as Emulsion D in Example 2 of JP-A-8-227117. The emulsion obtained was designated as Emulsion 2B (Invention). Furthermore, an emulsion was prepared by not adding I-4 and II-4 in Emulsion 2B and designated as Emulsion 2C (Comparison).

TABLE 2

| | Amount Adsorbed[1] ($10^{-3}$ mol/mol-Ag) | Number of Adsorption Layers | Light Adsorption Intensity[2] | Absorption Intensity[3] (80%, 50% of Amax) | Spectral Sensitivity Width (80%, 50% of Smax) | Minus Blue Sensitivity[4] | Coagulation of Grains |
|---|---|---|---|---|---|---|---|
| Comparative Example 1 | 2.54 | 1.79 | 151 (149) | 86, 133 | 42, 130 | 128 | X |
| Comparative Example 2 | 2.35 | 1.65 | 139 (140) | 87, 132 | 45, 134 | 123 | X |
| Comparative Example 3 | 3.34 | 2.35 | 193 (195) | 80, 125 | 57, 125 | 180 | X |
| Invention 1 | 3.21 | 2.26 | 192 (192) | 24, 93 | 42, 95 | 202 | ○ |
| Invention 2 | 3.22 | 2.27 | 193 (195) | 24, 93 | 42, 95 | 208 | ○ |
| Invention 3 | 1.15 | 2.13 | (180) | 25, 94 | 43, 96 | 196 | ○ |

[1]A total of amounts adsorbed every each kind of dyes

[2]Light absorption intensity determined by microspectrometry. Numerals in parentheses are obtained by a conversion formula based on the amounts every each kind of dyes.

[3]A value obtained from the spectrum after the diffusion reflection spectrum of emulsion is converted by the Kubelka-Munk equation.

[4]Sensitivity by taking the sensitivity when only the first dye was added, as 100.

Absorption spectra of the emulsions prepared in Comparative Example 3 and Invention 1 are shown in FIG. 1. As seen from Table 2 and FIG. 2, according to the present invention, the sensitizing dye can be adsorbed in multiple layers on the grain surface to form J-aggregate, so that the light absorption intensity can be increased within a narrow wavelength range. Furthermore, by using a silver halide emulsion having such absorption intensity and wavelength properties, the silver halide light-sensitive material obtained can have high sensitivity only to the objective wavelength region and can have good color separation and high color reproducibility.

In the multi-layer adsorption for achieving such wavelength properties, the dye in the second or subsequent layers must form J-aggregate and it has been found that by realizing such an adsorption state, there is provided an effect that the coagulation of grains is reduced. This is considered to occur because the interaction of grains on the surface is reduced as a result of formation of J-aggregate by the dye in the second or subsequent layers. This effect is quite an unexpected result.

Coated Samples were prepared in the same manner as Coated Sample F in Example 3 of JP-A-8-227117. A sample obtained by using Emulsion 2A in place of Emulsion F of Coated Sample F in Example 3 of JP-A-8-227117 was designated as Sample 2A, and samples obtained by similarly using Emulsion 2B or Emulsion 2C in place of Emulsion F were designated as Sample 2B and Sample 2C, respectively.

The amount of dye adsorbed, the adsorption layer number and the light absorption intensity were determined in the same manner as in Example 1. Furthermore, the absorption spectrum and the spectral sensitivity distribution of each emulsion were measured in the same manner as in Example 1.

For examining the sensitivity of each coated sample, the coated samples were each exposed through an optical wedge and a blue filter for 1/100 second using Fuji FW-Type Sensitometer (manufactured by Fuji Photo Film Co., ltd.), subjected to Fuji Photo Film CN16 processing, and compared on the photographic properties.

The sensitivity is a reciprocal of an exposure amount necessary for giving a density of fog+0.2 and shown by a relative value based on the sensitivity of Sample 2C.

The results are shown in Table 3 below. The high-sensitive light-sensitive material having the desired absorption and the desired sensitivity waveform can be obtained by the dye addition method according to the present invention.

TABLE 3

| | Amount Adsorbed(1) ($10^{-3}$ mol/mol-Ag) | Number of Adsorption Layers | Light Adsorption Intensity | Absorption Width(3) (80%, 50% of Amax) | Spectral Sensitivity Width (80%, 50% of Smax) | Spectral Absorption Maximum Wavelength (nm) | Minus Blue Sensitivity(4) | Coagulation of Grains |
|---|---|---|---|---|---|---|---|---|
| Sample 2C (Comparative Example) | 0.99 | 0.93 | 51 | 18, 83 | 23, 88 | 471 | 100 | ○ |
| Sample 2A (Comparative Example) | 1.78 | 1.66 | 88 | 45, 127 | 53, 132 | 438 | 145 | X |
| Sample 2B (Invention) | 1.86 | 1.74 | 90 | 26, 90 | 35, 95 | 473 | 164 | ○ |

EXAMPLE 3

The method for preparing a silver halide emulsion is described below.

Seven kinds of silver halide emulsion grains [Emulsion A-1 and Emulsions B to G] were prepared by the following method for preparing silver halide grains.

Preparation of Emulsion A-1 (Octahedral Internal Latent Image-type Direct Positive Emulsion)

To 1,000 ml of an aqueous gelatin solution containing 0.05 M of potassium bromide, 1 g of 3,6-dithia-1,8-octanediol, 0.034 mg of lead acetate and 60 g of deionized gelatin having a Ca content of 100 ppm or less, 0.4 M of an aqueous silver nitrate solution and 0.4 M of an aqueous potassium bromide solution were added while keeping the temperature at 75° C. by a controlled double jet method where the addition rate of the aqueous potassium bromide solution was controlled to have a pBr of 1.60 and 300 ml of the aqueous silver nitrate solution was added over 40 minutes.

After the completion of addition, octahedral silver bromide crystals (hereinafter referred to as "core grain") having an average grain size (equivalent sphere diameter) of about 0.7 μm and equalized in the grain size were produced.

The core grain obtained was subjected to chemical sensitization using the following container and formulation.

1. Tank

A tank having a semispherical bottom made of a metal of which surface was teflon-coated with fluororesin material FEP produced by Du Pont to have a thickness of 120 μm.

2. Stirring Blade

A propeller-style seamless integrated blade made of a metal of which surface was teflon-coated.

3. Formulation

To the octahedral direct positive emulsion solution prepared above, 3 ml of an aqueous solution obtained by dissolving 1 mg of sodium thiosulfate, 90 mg of potassium tetrachloroaurate and 1.2 g of potassium bromide in 1,000 ml of water was added. The resulting solution was heated at 75° C. for 80 minutes to perform the chemical sensitization treatment. To the thus chemically sensitized emulsion solution, 0.15 M of potassium bromide was added and thereto, similarly to the preparation of core grain, 0.9 M of an aqueous silver nitrate solution and 0.9 M of an aqueous potassium bromide solution were added while keeping the temperature at 75° C. by a controlled double jet method where the addition rate of the aqueous potassium bromide solution was controlled to have a pBr of 1.30 and 670 ml of the aqueous silver nitrate solution was added over 70 minutes.

The resulting emulsion was washed with water by an ordinary flocculation method and thereto, the gelatin prepared above, 2-phenoxyethanol and methyl p-hydroxybenzoate were added to obtain octahedral silver bromide crystals having an average grain size (equivalent sphere diameter) of about 1.4 μm and equalized in the grain size (hereinafter referred to as an "internal latent image-type core/shell grain").

To this internal latent image-type core/shell emulsion, 3 ml of an aqueous solution prepared by dissolving 100 mg of sodium thiosulfate and 40 mg of sodium tetraborate in 1,000 ml of water was added and further, 14 mg of poly(N-vinylpyrrolidone) was added. The resulting emulsion was ripened under heating at 60° C. and then thereto 0.005 M of potassium bromide was added, thereby preparing an octahedral internal latent image-type direct positive emulsion.

Preparation of Emulsions B to G (Octahedral Internal Latent Image-type Direct Positive Emulsions)

Octahedral internal latent image-type direct positive silver halide emulsions each having an average grain size (equivalent sphere diameter) shown in Table 4 and equalized in the grain size were obtained by changing respective addition times of the aqueous silver nitrate solution and the aqueous potassium bromide solution and further changing the amounts of chemicals added in the preparation of Emulsion A-1.

TABLE 4

| Name of Emulsion | Average Grain Size, μm |
|---|---|
| B | 1.20 |
| C | 0.93 |
| D | 1.20 |
| E | 0.94 |
| F | 0.74 |
| G | 0.66 |

Using Emulsions A-1 and B to G, a comparative light-sensitive element (Sample 101) having a structure shown below was prepared. The sensitizing dyes were added at the completion of chemical sensitization of the shell and the kind of dye, the dispersion form, the addition temperature and the amount are shown in Table 5.

Structure of Comparative Light-Sensitive Element 101

| Layer No. | Name of Layer | Additive | Amount Coated ($g/m^2$) |
|---|---|---|---|
| 22nd Layer | Protective Layer | Matting Agent (1) | 0.15 |
| | | Gelatin | 0.25 |
| | | Surface Active Agent (1) | $5.3 \times 10^{-3}$ |
| | | Surface Active Agent (2) | $4.1 \times 10^{-3}$ |
| | | Surface Active Agent (3) | $3.9 \times 10^{-3}$ |
| | | Additive (1) | $8.0 \times 10^{-3}$ |
| | | Additive (5) | 0.009 |
| 21st Layer | Ultraviolet Absorbing Layer | Ultraviolet Absorbent (1) | 0.09 |
| | | Ultraviolet Absorbent (2) | 0.05 |
| | | Ultraviolet Absorbent (3) | 0.01 |
| | | Additive (2) | 0.17 |
| | | Surface Active Agent (3) | 0.013 |
| | | Surface Active Agent (4) | 0.019 |
| | | Additive (1) | $8.0 \times 10^{-3}$ |
| | | Additive (5) | 0.023 |
| | | Hardening Agent (1) | 0.050 |
| | | Hardening Agent (2) | 0.017 |
| | | Gelatin | 0.52 |
| 20th Layer | Blue-Sensitive Layer (high sensitivity) | Internal Latent Image-Type Direct Positive Emulsion: A-1 | 0.38 as silver |
| | | Nucleating Agent (1) | $2.9 \times 10^{-6}$ |
| | | Additive (3) | $4.0 \times 10^{-3}$ |
| | | Additive (4) | 0.013 |
| | | Additive (5) | $3.8 \times 10^{-3}$ |
| | | Additive (1) | $9.0 \times 10^{-3}$ |
| | | Surface Active Agent (5) | $9.0 \times 10^{-3}$ |
| | | Gelatin | 0.42 |
| 19th Layer | Blue-Sensitive Layer (low sensitivity) | Internal Latent Image-Type Direct Positive Emulsion: B | 0.07 as silver |
| | | Internal Latent Image-Type Direct Positive Emulsion: C | 0.10 as silver |
| | | Nucleating Agent (1) | $2.5 \times 10^{-6}$ |
| | | Additive (3) | 0.022 |
| | | Additive (5) | $9.0 \times 10^{-3}$ |
| | | Additive (1) | 0.013 |
| | | Surface Active Agent (5) | $9.0 \times 10^{-3}$ |
| | | Gelatin | 0.35 |
| 18th Layer | White Reflective Layer | Titanium dioxide | 0.30 |
| | | Additive (1) | $9.0 \times 10^{-3}$ |
| | | Surface Active Agent (1) | $7.2 \times 10^{-5}$ |
| | | Additive (5) | 0.011 |
| | | Additive (8) | $2.8 \times 10^{-3}$ |
| | | Gelatin | 0.37 |
| 17th Layer | Yellow Color Material Layer | Yellow Dye Releasing Compound (1) | 0.62 |
| | | High Boiling Point Organic Solvent (1) | 0.27 |
| | | Additive (6) | 0.18 |
| | | Additive (7) | 0.09 |
| | | Surface Active Agent (4) | 0.062 |
| | | Surface Active Agent (5) | 0.030 |
| | | Additive (9) | 0.031 |
| | | Additive (1) | $6.0 \times 10^{-3}$ |
| | | Gelatin | 0.87 |
| 16th Layer | Interlayer | Additive (10) | 0.013 |
| | | Surface Active Agent (1) | $4.0 \times 10^{-4}$ |
| | | Additive (1) | $7.0 \times 10^{-3}$ |
| | | Gelatin | 0.42 |
| 15th Layer | Color Mixing Inhibiting Layer | Additive (11) | 0.47 |
| | | High Boiling Point Organic Solvent (2) | 0.23 |
| | | Polymethyl methacrylate | 0.81 |
| | | Surface Active Agent (5) | 0.019 |
| | | Additive (1) | $2.0 \times 10^{-3}$ |
| | | Additive (12) | 0.61 |
| | | Gelatin | 0.81 |

-continued

| Layer No. | Name of Layer | Additive | Amount Coated ($g/m^2$) |
|---|---|---|---|
| 14th Layer | Green-Sensitive Layer (high sensitivity) | Internal Latent Image-Type Direct Positive Emulsion: A-1 | 0.69 as silver |
| | | Nucleating agent (1) | $2.2 \times 10^{-6}$ |
| | | Additive (3) | 0.12 |
| | | Additive (5) | 0.014 |
| | | Additive (1) | $3.0 \times 10^{-3}$ |
| | | Additive (2) | 0.15 |
| | | High Boiling Point Organic Solvent (2) | 0.07 |
| | | Surface Active Agent (5) | 0.06 |
| | | Gelatin | 0.97 |
| 13th Layer | Green Sensitive Layer (low sensitivity) | Internal Latent Image-Type Direct Positive Emulsion: D | 0.11 as silver |
| | | Internal Latent Image-Type Direct Positive Emulsion: E | 0.08 as silver |
| | | Nucleating agent (1) | $2.7 \times 10^{-6}$ |
| | | Additive (3) | 0.011 |
| | | Additive (4) | 0.033 |
| | | Additive (5) | $1.5 \times 10^{-3}$ |
| | | Additive (1) | 0.010 |
| | | Surface Active Agent (5) | 0.024 |
| | | Gelatin | 0.26 |
| 12th Layer | Interlayer | Additive (1) | 0.014 |
| | | Surface Active Agent (1) | 0.038 |
| | | Surface Active Agent (3) | $4.0 \times 10^{-3}$ |
| | | Additive (5) | 0.014 |
| | | Gelatin | 0.33 |
| 11th Layer | Magenta coloring Material Layer | Magenta Dye Releasing Compound (1) | 0.56 |
| | | High Boiling Point Organic Solvent (1) | 0.18 |
| | | Additive (13) | $9.3 \times 10^{-4}$ |
| | | Additive (5) | 0.02 |
| | | Surface Active Agent (4) | 0.04 |
| | | Additive (14) | 0.02 |
| | | Additive (1) | $7.0 \times 10^{-3}$ |
| | | Gelatin | 0.45 |
| 10th Layer | Interlayer | Additive (10) | 0.014 |
| | | Surface Active Agent (1) | $3.0 \times 10^{-4}$ |
| | | Additive (1) | $9.0 \times 10^{-3}$ |
| | | Gelatin | 0.36 |
| 9th Layer | Color Mixing Inhibiting Layer | Additive (11) | 0.38 |
| | | High Boiling Point Organic Solvent (2) | 0.19 |
| | | Polymethyl methacrylate | 0.66 |
| | | Surface Active Agent (5) | 0.016 |
| | | Additive (1) | $2.0 \times 10^{-3}$ |
| | | Additive (12) | 0.49 |
| | | Gelatin | 0.65 |
| 8th Layer | Red-Sensitive Layer (high sensitivity) | Internal Latent Image-Type Direct Positive Emulsion: A-1 | 0.33 as silver |
| | | Nucleating Agent (1) | $6.1 \times 10^{-6}$ |
| | | Additive (3) | 0.04 |
| | | Additive (5) | 0.01 |
| | | Additive (1) | $1.0 \times 10^{-3}$ |
| | | Additive (2) | 0.08 |
| | | High Boiling Point Organic Solvent (2) | 0.04 |
| | | Surface Active Agent (5) | 0.02 |
| | | Gelatin | 0.33 |
| 7th Layer | Red-Sensitive Layer (low sensitivity) | Internal Latent Image-Type Direct Positive Emulsion: F | 0.10 as silver |
| | | Internal Latent Image-Type Direct Positive Emulsion: G | 0.11 as silver |
| | | Nucleating agent (1) | $2.5 \times 10^{-5}$ |
| | | Additive (3) | 0.047 |
| | | Additive (5) | 0.016 |
| | | Additive (1) | $8.0 \times 10^{-3}$ |
| | | Surface Active Layer (5) | 0.02 |

-continued

| Layer No. | Name of Layer | Additive | Amount Coated ($g/m^2$) |
|---|---|---|---|
| | | Gelatin | 0.57 |
| 6th Layer | White Reflective Layer | Titanium dioxide | 1.87 |
| | | Additive (1) | $7.0 \times 10^{-3}$ |
| | | Surface Active Agent (1) | $4.0 \times 10^{-4}$ |
| | | Additive (5) | 0.02 |
| | | Additive (8) | 0.015 |
| | | Gelatin | 0.73 |
| 5th Layer | Cyan Coloring Material Layer | Cyan Dye Releasing Compound (1) | 0.25 |
| | | Cyan Dye Releasing Compound (2) | 0.14 |
| | | High Boiling Point Organic Solvent (1) | 0.05 |
| | | Additive (3) | 0.06 |
| | | Additive (5) | 0.01 |
| | | Surface Active Agent (4) | 0.05 |
| | | Additive (9) | 0.05 |
| | | Additive (1) | $4.0 \times 10^{-3}$ |
| | | Hardening Agent (3) | 0.014 |
| | | Gelatin | 0.40 |
| 4th Layer | Light-Shielding Layer | Carbon black | 1.50 |
| | | Surface Active Agent (1) | 0.08 |
| | | Additive (1) | 0.06 |
| | | Additive (5) | 0.06 |
| | | Additive (12) | 0.15 |
| | | Gelatin | 1.43 |

-continued

| Layer No. | Name of Layer | Additive | Amount Coated ($g/m^2$) |
|---|---|---|---|
| 3rd Layer | Interlayer | Surface Active Agent (1) | $6.0 \times 10^{-4}$ |
| | | Additive (1) | $9.0 \times 10^{-3}$ |
| | | Additive (5) | 0.013 |
| | | Gelatin | 0.29 |
| 2nd Layer | White Reflective Layer | Titanium dioxide | 19.8 |
| | | Additive (15) | 0.378 |
| | | Additive (16) | 0.094 |
| | | Surface Active Agent (6) | 0.019 |
| | | Additive (8) | 0.16 |
| | | Hardening Agent (1) | 0.02 |
| | | Hardening Agent (2) | 0.007 |
| | | Gelatin | 2.45 |
| 1st Layer | Image-Receiving Layer | Polymer Mordant (1) | 2.22 |
| | | Additive (17) | 0.26 |
| | | Surface Active Agent (7) | 0.04 |
| | | Additive (5) | 0.11 |
| | | Hardening Agent (1) | 0.03 |
| | | Hardening Agent (2) | 0.01 |
| | | Gelatin | 3.25 |
| Support (90 μm-thick polyethylene terephthalate containing titanium dioxide for preventing light piping and subjected to undercoating) | | | |
| Back Layer | Curling Controlling Layer | Ultraviolet Absorbent (4) | 0.40 |
| | | Ultraviolet Absorbent (5) | 0.10 |
| | | Diacetyl cellulose (acetylation degree: 51%) | 4.20 |
| | | Additive (18) | 0.25 |
| | | Barium stearate | 0.11 |
| | | Hardening Agent (4) | 0.50 |

TABLE 5

Sensitizing Dye Content per 1 kg of Emulsion

| Layer No. | Name of Emulsion | Kind of Sensitizing Dye | Dye Dispersion Form | Addition Temperature | Amount of Dye, g/kg-Emulsion |
|---|---|---|---|---|---|
| 20 | A-1 | (9) | aqueous solution | 70° C. | $9.38 \times 10^{-2}$ |
| | | (8) | aqueous solution | | $1.19 \times 10^{-1}$ |
| 19 | B | (9) | aqueous solution | 60° C. | $6.50 \times 10^{-2}$ |
| | | (8) | aqueous solution | | $1.47 \times 10^{-1}$ |
| 19 | C | (9) | aqueous solution | 60° C. | $7.31 \times 10^{-2}$ |
| | | (8) | aqueous solution | | $1.66 \times 10^{-1}$ |
| 14 | A-1 | (7) | gelatin dispersion | 60° C. | $1.18 \times 10^{-1}$ |
| | | (4) | gelatin dispersion | | $2.94 \times 10^{-3}$ |
| | | (6) | water/organic solvent dispersion by surface active agent | | $9.23 \times 10^{-2}$ |
| 13 | D | (7) | gelatin dispersion | 40° C. | $6.49 \times 10^{-2}$ |
| | | (4) | gelatin dispersion | | $1.62 \times 10^{-3}$ |
| | | (6) | water/organic solvent dispersion by surface active agent | | $4.85 \times 10^{-2}$ |
| 13 | E | (7) | gelatin dispersion | 40° C. | $7.34 \times 10^{-2}$ |
| | | (4) | gelatin dispersion | | $1.83 \times 10^{-3}$ |
| | | (6) | water/organic solvent dispersion by surface active agent | | $5.69 \times 10^{-2}$ |
| 8 | A-1 | (5) | aqueous solution | 60° C. | $3.10 \times 10^{-2}$ |
| | | (4) | gelatin dispersion | | $2.26 \times 10^{-2}$ |
| | | (3) | gelatin dispersion | | $2.26 \times 10^{-2}$ |
| | | (2) | gelatin dispersion | | $2.79 \times 10^{-3}$ |
| | | (1) | gelatin dispersion | | $9.20 \times 10^{-2}$ |
| 7 | F | (5) | aqueous solution | 60° C. | $1.63 \times 10^{-2}$ |
| | | (4) | gelatin dispersion | | $1.34 \times 10^{-2}$ |
| | | (3) | gelatin dispersion | | $1.34 \times 10^{-2}$ |
| | | (2) | gelatin dispersion | | $1.91 \times 10^{-3}$ |

TABLE 5-continued
| | | | | | |
|---|---|---|---|---|---|
| | | (1) | gelatin dispersion | | $6.32 \times 10^{-2}$ |
| 7 | G | (5) | aqueous solution | 50° C. | $1.17 \times 10^{-2}$ |
| | | (4) | gelatin dispersion | | $8.90 \times 10^{-3}$ |
| | | (3) | gelatin dispersion | | $8.90 \times 10^{-3}$ |
| | | (2) | gelatin dispersion | | $1.32 \times 10^{-3}$ |
| | | (1) | gelatin dispersion | | $4.37 \times 10^{-2}$ |
Sensitizing Dye (1)
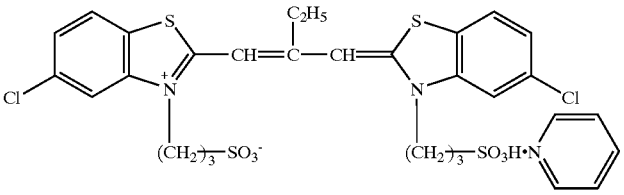
Sensitizing Dye (3)
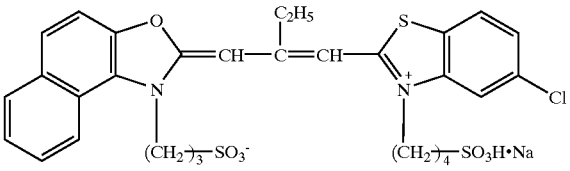
Sensitizing Dye (2)
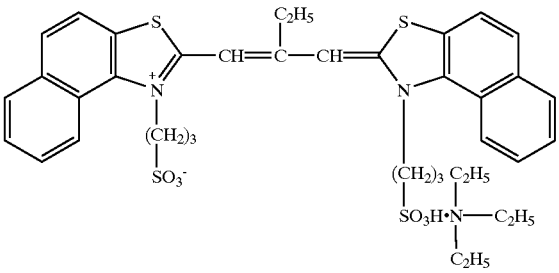
Sensitizing Dye (7)
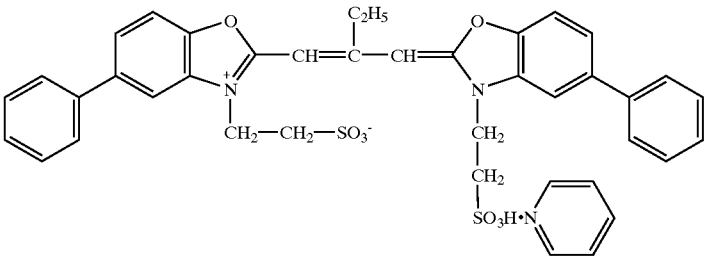
Sensitizing Dye (4)
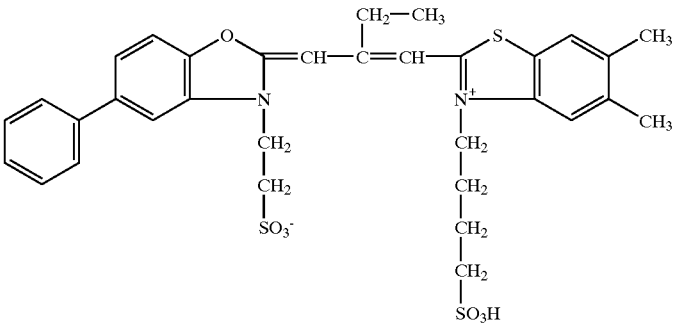

TABLE 5-continued
Sensitizing Dye (6)
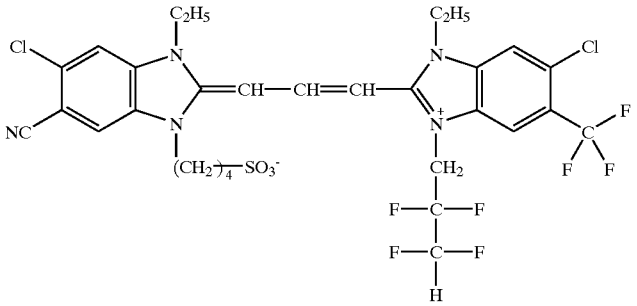
Sensitizing Dye (10)
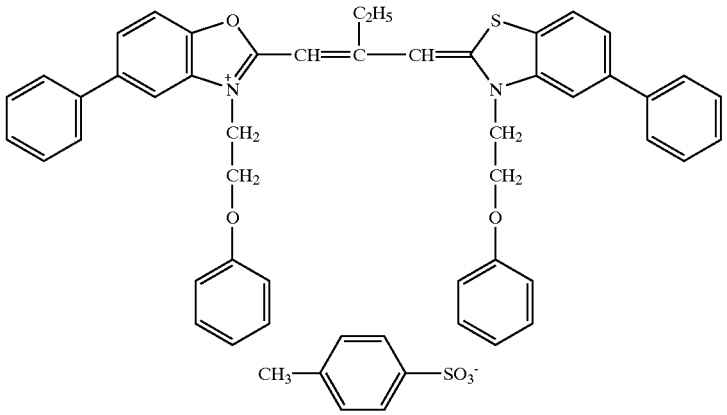
Sensitizing Dye (11)
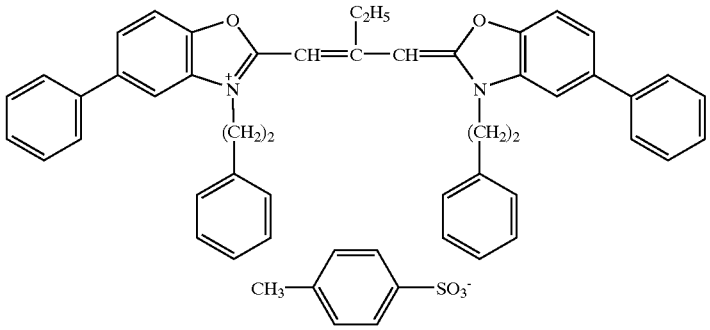
Sensitizing Dye (12)
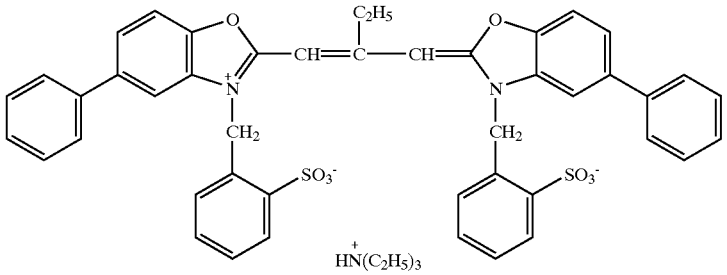

TABLE 5-continued
Sensitizing Dye (9)
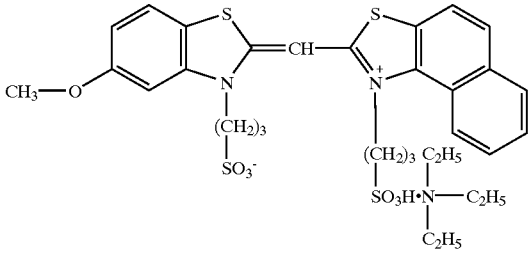
Sensitizing Dye (5)
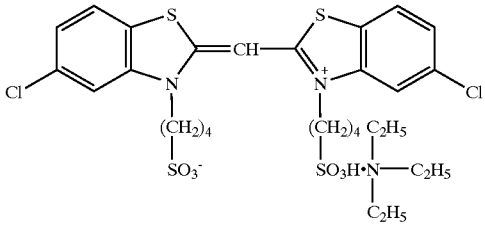
Sensitizing Dye (8)
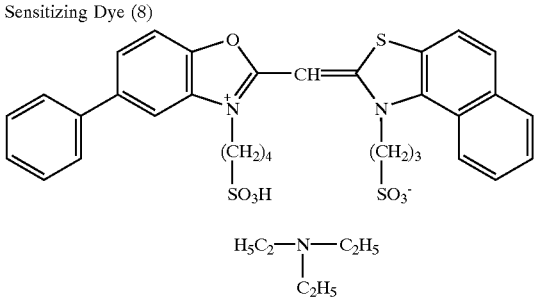
Yellow Dye Releasing Compound (1)
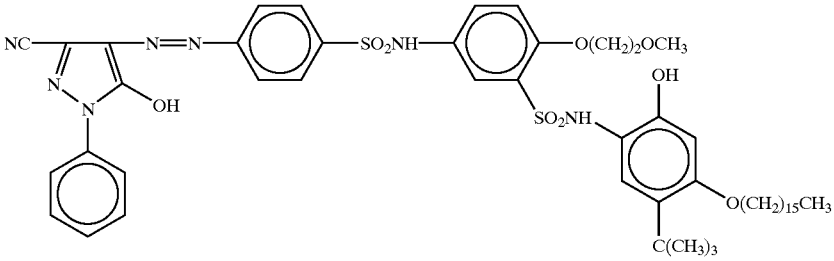

Magenta Dye Releasing Compound (1)
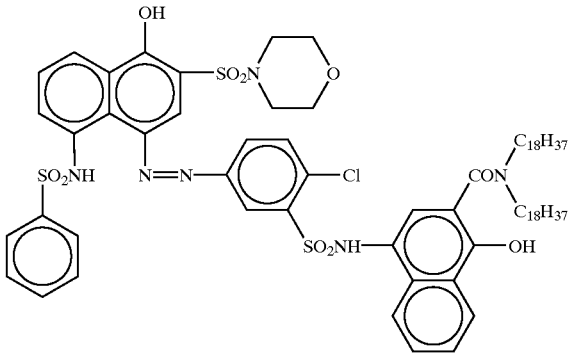
Cyan Dye Releasing Compound (1)
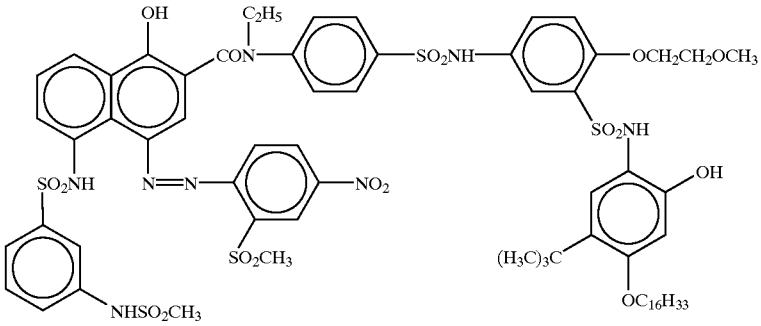
Cyan Dye Releasing Compound (2)
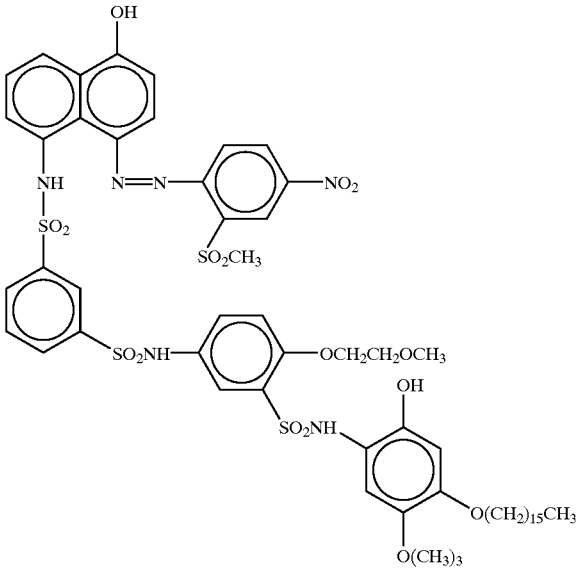
Additive (1)
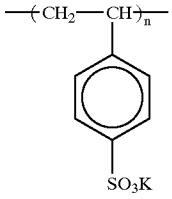
Additive (2)
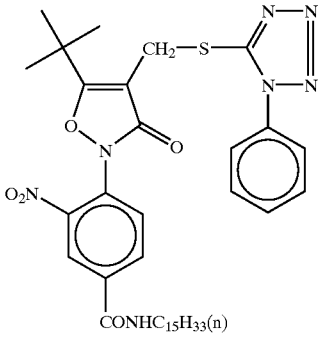

Additive (3)
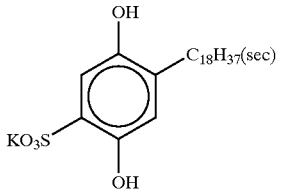
Additive (4)
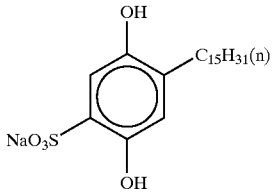
Additive (5)
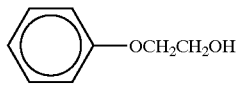
Additive (6)
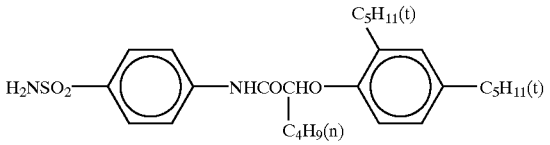
Additive (7)
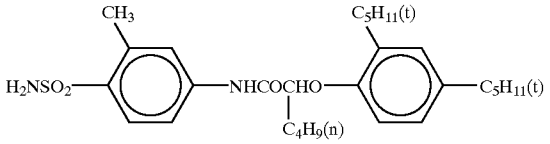
Additive (8)
Carboxymethyl cellulose
(CMC CELLOGEN 6A, produced by Daiichi Kogyo Seiyaku K.K.)
Additive (9)
Polyvinyl alcohol (PVA-220E)
Polymerization degree: about 2,000, saponification degree: 88%.
Additive (10)
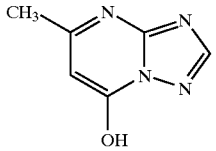
Additive (11)
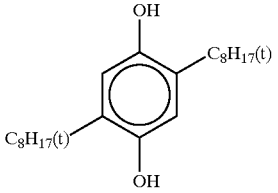
Additive (12)
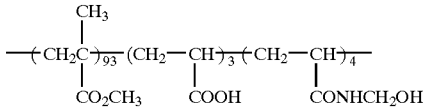
Additive (13)
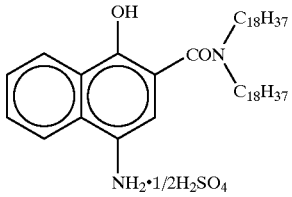
Additive (14)
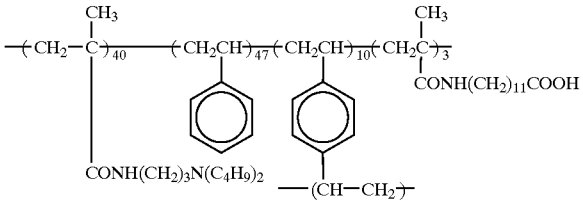
Additive (15)
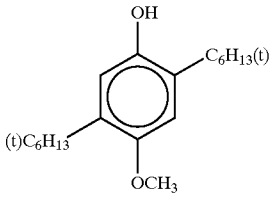
Additive (16)
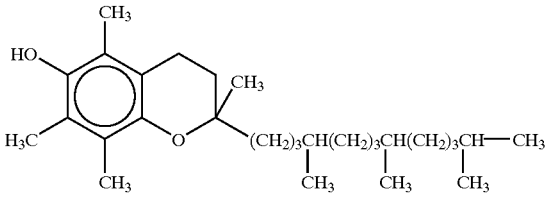

Additive (17)

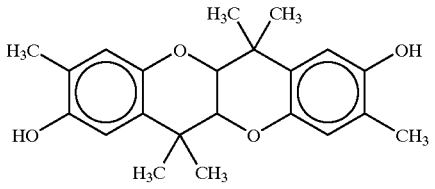

Additive (18)

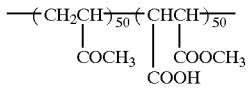

Matting Agent (1)

Polymethyl methacrylate spherical latex (average particle size: 3 $\mu$m)

Surface Active Agent (1)

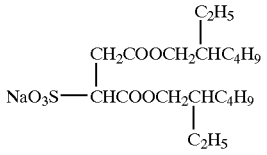

Surface Active Agent (2)

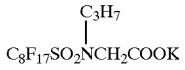

Surface Active Agent (3)

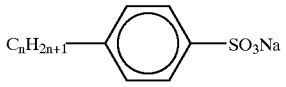

($n$ = about 12.6)

Surface Active Agent (4)

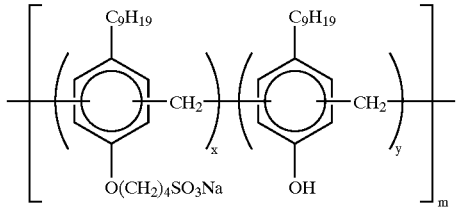

$x/y$ = 4/6
$m$ = 6.8

Surface Active Agent (5)

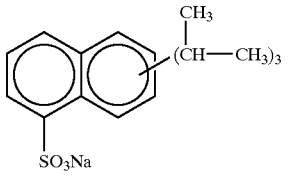

Surface Active Agent (6)

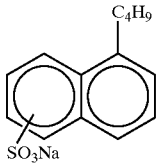

Surface Active Agent (7)

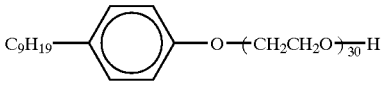

Ultraviolet Absorbent (1)

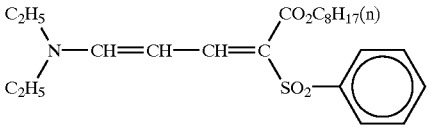

Ultraviolet Absorbent (2)

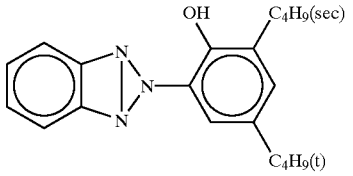

Ultraviolet Absorbent (3)

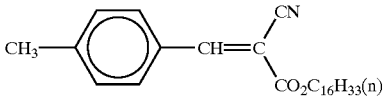

High Boiling Point Organic Solvent (1)

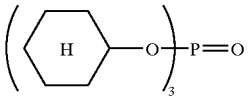

High Boiling Point Organic Solvent (2)

Ultraviolet Absorbent (4)

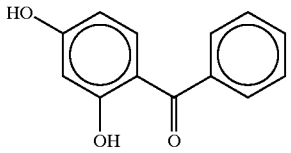

Ultraviolet Absorbent (5)

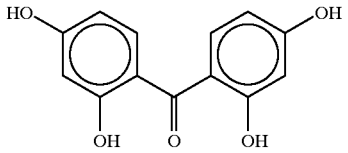

Hardening Agent (1)

$CH_2{=}CHSO_2CH_2CONH(CH_2)_2NHCOCH_2SO_2CH{=}CH_2$

Hardening Agent (2)

$CH_2{=}CHSO_2CH_2CONH(CH_2)_3NHCOCH_2SO_2CH{=}CH_2$

Hardening Agent (3)

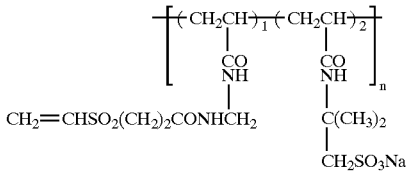

Hardening Agent (4)

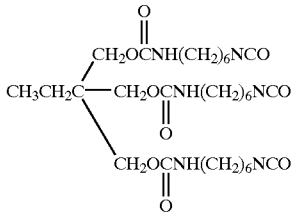

Nucleating Agent (1)

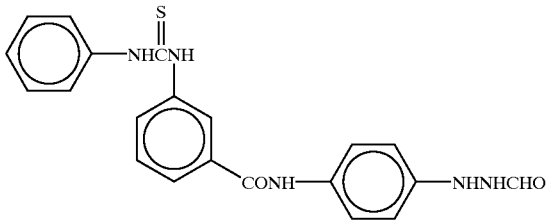

Polymer Mordant (1)

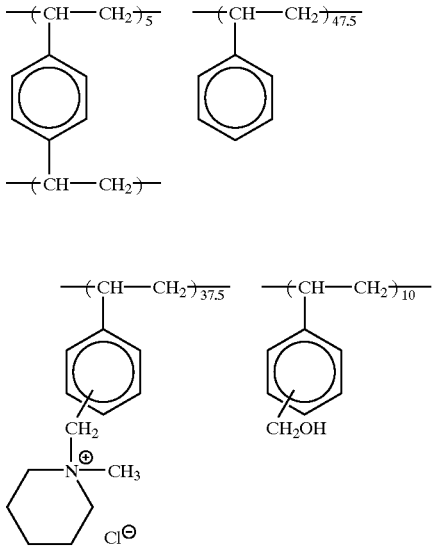

Emulsions A-2 to A-4 were prepared by adding dyes in the second and subsequent layers (first dye+second dye) after adding the first layer dye as shown in Table 6 in place of adding dyes (7), (4) and (6) to Emulsion A-1 of the fourteenth layer, and light-sensitive elements obtained by using these emulsions were designated as Samples 102 to 104, respectively.

TABLE 6

| Sample No. | Name of Emulsion | Dye in First Layer (amount added) | Dyes in Second Layer: First Dye (amount added) | Dyes in Second Layer: Second Dye (amount added) |
|---|---|---|---|---|
| 101 | A-1 | (7) ($1.18 \times 10^{-1}$)<br>(4) ($2.94 \times 10^{-3}$)<br>(6) ($9.23 \times 10^{-2}$) | none | none |
| 102 | A-2 | (11) ($2.13 \times 10^{-1}$) | (11) ($2.13 \times 10^{-1}$) | (12) ($2.13 \times 10^{-1}$) |
| 103 | A-3 | (10) ($2.13 \times 10^{-1}$) | IV'c-25 ($2.13 \times 10^{-1}$) | IV'a-31 ($2.13 \times 10^{-1}$) |
| 104 | A-4 | (10) ($2.13 \times 10^{-1}$) | IV'c-31 ($4.26 \times 10^{-1}$) | none |

(amount of dye added: g(dye)/1 kg (emulsion))

Each sample in Table 6 was measured on the amount of dye adsorbed to an emulsion grain per unit area by the method described above and the values obtained each was compared with the single layer saturation adsorption. In Samples 102, 103 and 104, adsorption of dyes in two or more layers was verified, however, in Sample 101, the dye was absorbed in one layer.

A cover sheet was prepared as follows.

The following layers were formed on a polyethylene terephthalate support containing a light piping preventive dye and under coated with gelatin:

(a) a neutralizing layer containing 10.4 g/m$^2$ of an acrylic acid/n-butyl acrylate copolymer (80/20 (mol %)) having an average molecular weight of 50,000 and 0.1 g/m$^2$ of 1,4-bis(2,3-epoxypropoxy)-butane, (b) a layer containing 4.3 g/m$^2$ of cellulose acetate having an acetylation degree of 55% and 0.2 g/m$^2$ of a methyl half ester of methyl vinyl ether/maleic acid anhydride copolymer (50/50 (mol %)), and (c) a neutralization timing layer containing 0.3 g/m$^2$ of an n-butyl methacrylate/2-hydroxyethyl methacrylate/acrylic acid copolymer (66.1/28.4/5.5 (wt %)) having an average molecular weight of 25,000 and 0.8 g/m$^2$ of an ethyl methacrylate/2-hydroxyethyl methacrylate/acrylic acid copolymer (66.1/28.4/5.5 (wt %)) having an average molecular weight of 40,000.

The light piping preventing dye used was a 3:1 mixture of KAYASET GREEN A-G produced by Nippon Kayaku K.K. and a compound shown below:

Light Piping Preventing Dye

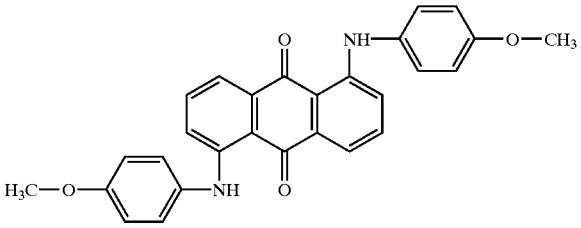

An alkali processing composition was prepared as follows.

0.8 g of a processing solution having the following composition was filled in a container which can be ruptured by a pressure.

| | |
|---|---|
| Water | 695 g |
| 1-p-tolyl-4-hydroxymethyl-4-methyl-3-pyrazolidin-1-one | 7.00 g |
| 1-Phenyl-4-hydroxymethyl-4-methyl-3-pyrazolidin-1-one | 9.85 g |
| Sulfinic acid polymer | 2.10 g |
| 5-Methylbenzotriazole | 2.50 g |
| Zinc nitrate hexahydrate | 0.60 g |
| Potassium sulfite | 1.90 g |
| Aluminum nitrate nonahydrate | 0.60 g |
| Carboxymethyl cellulose Na salt | 56.0 g |
| Potassium hydroxide | 55.0 g |
| Carbon black | 160 g |
| Anionic surface Active Agent (1) | 8.60 g |
| Anionic surface Active Agent (2) | 0.03 g |
| Alkyl-modified PVA (produced by Kuraray) | 0.06 g |
| Cationic polymer | 1.05 g |

Sulfinic Acid Polymer

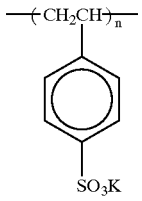

Anionic Surface Active Agent (1)

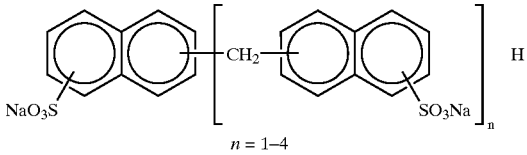

Anionic Surface Active Agent (2)

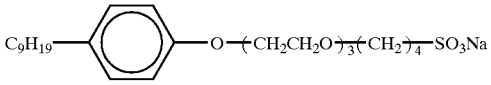

Alkyl-modified PVA

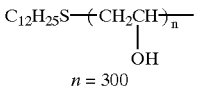

Cationic Polymer

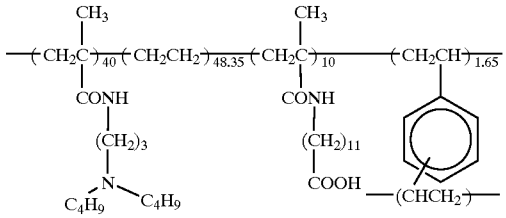

These light-sensitive elements (Samples 101 to 104) each was subjected to spectrum exposure from the emulsion layer side through a continuous wedge in an equi-energy spectrum exposing machine and then superposed on the cover sheet prepared above. Between two materials, the above-described processing solution was developed to have a thickness of 62 $\mu$m by a pressure roller. The processing was performed at 25° C. and after 10 minutes, the transfer density was measured by a color densitometer.

The samples were compared with respect to the equi-energy spectral sensitivity spectrum obtained, as a result, the samples of the present invention (Samples 103 and 104) exhibited a sharp spectral sensitivity spectrum distribution as compared with the conventional multi-layer system (Sample 102).

Separately, the light-sensitive elements (Samples 101 to 104) each was exposed from the emulsion layer side through a gray continuous wedge and superposed on the cover sheet prepared above. The above-described processing solution was developed between two materials by a pressure roller to have a thickness of 62 $\mu$m. The exposure was performed for 1/100 second while controlling the exposure illuminance to give a constant exposure amount. The processing was performed at 25° C. and after 10 minutes, the transfer density was measured by a color densitometer. Subsequently, a characteristic curve was drawn by denoting the logarithm of exposure amount on the abscissa and each color density on the ordinate. The color density in the unexposed area was obtained as a maximum density and the color density in the region where the exposure amount is sufficiently large was obtained as a minimum density. The sensitivity giving a medium density between the maximum density and the minimum density was obtained as a midpoint sensitivity and the sensitivity of giving a density of 0.3 was obtained as a foot sensitivity. The results by taking the sensitivity of Sample 101 as 100 are shown in Table 7.

TABLE 7

| Sample No. | Maximum Density | Minimum Density | Mid-point Sensitivity | Foot Sensitivity | Remarks |
|---|---|---|---|---|---|
| 101 | 2.30 | 0.16 | 100 | 100 | Comparison |
| 102 | 2.28 | 0.17 | 233 | 220 | " |
| 103 | 2.30 | 0.18 | 258 | 233 | Invention |
| 104 | 2.27 | 0.16 | 253 | 241 | " |

It is seen from Table 7 that in Samples 103 and 104 of the present invention, both the midpoint sensitivity and the foot sensitivity are elevated and the spectral sensitivity spectrum is sharper.

By using the photographic emulsion and the light-sensitive material, a high-sensitivity light-sensitive material having desired absorption and desired sensitivity waveform can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising a silver halide grain having a spectral absorption maximum wavelength of less than 500 nm and a light absorption intensity of 60 or more or having a spectral absorption maximum wavelength of 500 nm or more and a light absorption intensity of 100 or more, and at least one sensitizing dye adsorbed in multiple layers onto said silver halide grain, wherein when a maximum value of the spectral absorption factor of all dyes absorbed on said grain is Amax, the distance between the shortest wavelength showing 80% of Amax and the longest wavelength showing 80% of Amax is 20 nm or more and the distance between the shortest wavelength showing 50% of Amax and the longest wavelength showing 50% of Amax is 120 nm or less.

2. A silver halide photographic emulsion comprising a silver halide grain having a spectral absorption maximum wavelength of less than 500 nm and a light absorption intensity of 60 or more or having a spectral absorption maximum wavelength of 500 nm or more and a light absorption intensity of 100 or more, and at least one sensitizing dye adsorbed in multiple layers onto said silver halide grain, wherein when a maximum value of the spectral sensitivity of said grain is Smax, the distance between the shortest wavelength showing 80% of Smax and the longest wavelength showing 80% of Smax is 20 nm or more and the distance between the shortest wavelength showing 50% of Smax and the longest wavelength showing 50% of Smax is 120 nm or less.

3. The silver halide photographic emulsion as claimed in claim 1, wherein the longest wavelength showing a spectral absorption factor of 50% of Amax lies in the region of from 460 to 510 nm, from 560 to 610 nm, or from 640 to 730 nm.

4. The silver halide photographic emulsion as claimed in claim 2, wherein the longest wavelength showing a spectral sensitivity of 50% of Smax lies in the region of from 460 to 510 nm, from 560 to 610 nm, or from 640 to 730 nm.

5. The silver halide photographic emulsion as claimed in claim 1, 2, 3 or 4, wherein said silver halide emulsion contains a dye having at least one aromatic group.

6. The silver halide photographic emulsion as claimed in claim 1 or 2, wherein said multiple layers comprise a second sensitizing dye layer which has a structure different from a first sensitizing dye layer, and the second sensitizing dye layer contains a cationic dye, a betaine dye or a nonionic dye alone or contains both a cationic dye and an anionic dye.

7. The silver halide photographic emulsion as claimed in claim 1 or 2, which contains a sensitizing dye having a basic nucleus formed by the condensation of three or more rings.

8. The silver halide photographic emulsion as claimed in claim 1 or 2, wherein the silver halide grain having a spectral absorption maximum wavelength of less than 500 nm and a light absorption intensity of 60 or more or having a spectral absorption maximum wavelength of 500 nm or more and a light absorption intensity of 100 or more is a tabular grain having an aspect ratio of 2 or more.

9. The silver halide photographic emulsion as claimed in claim 1 or 2, wherein the silver halide grain having a spectral absorption maximum wavelength of less than 500 nm and a light absorption intensity of 60 or more or having a spectral absorption maximum wavelength of 500 nm or more and a light absorption intensity of 100 or more is subjected to selenium sensitization.

10. A silver halide photographic light-sensitive material comprising at least one silver halide photographic emulsion, which contains a silver halide photographic emulsion described in claim 1 or 2.

11. The silver halide photographic emulsion as claimed in claim 1 or 2, wherein at least one of said at least one sensitizing dye is a linked dye represented by formula (III):

$$D_1\text{—}(La\text{—}[D_2]q)rM_3m_3 \qquad \text{(III)}$$

wherein $D_1$ and $D_2$ each represents a dye chromophore, La represents a linking group or a single bond, q and r each represents an integer of from 1 to 100, $M_3$ represents a charge-balancing counter ion, and $m_3$ represents a number necessary for neutralizing the electric charge of molecule.

12. The silver halide photographic emulsion as claimed in claim 1 or 2, wherein the absorption maximum wavelength of the dye chromophore in a first layer in said multiple layers is longer than that of the dye chromophore in a second or subsequent layer in said multiple layers.

13. The silver halide photographic emulsion as claimed in claim 1 or 2, wherein at least one of said at least one sensitizing dye in a second or subsequent layer in said multiple layers forms a J-aggregate.

14. The silver halide photographic emulsion as claimed in claim 1, wherein the distance between the shortest wavelength showing 50% of Amax and the longest wavelength showing 50% of Amax is 90 nm or less.

15. A silver halide photographic light-sensitive material comprising at least one silver halide emulsion layer comprising a silver halide grain having adsorbed thereon a dye chromophore in more than one layer, wherein at least one spectral sensitizer containing the dye chromophore in said silver halide emulsion layer is represented by the following formula (IV):

(IV')

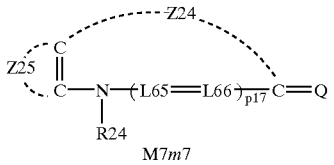

wherein Z24 represents an atomic group necessary for forming a 5- or 6-membered nitrogen-containing heterocyclic ring, Z25 represents an atomic group necessary for forming an aliphatic or aromatic ring and necessary for forming a polycyclic condensation structure comprising four or more rings including the nitrogen-containing heterocyclic ring formed by Z24, Q represents a group necessary for allowing the compound represented by formula (IV') to form a methine dye, R24 represents an alkyl group, an aryl group or a heterocyclic group, L65 and L66 each represents a methine group, p17 represents 0 or 1, M7 represents a counter ion for balancing the electric charge, and m7 represents a number of from 0 to 10 necessary for neutralizing the electric charge of the molecule.

16. The silver halide photographic light-sensitive material as claimed in claim 15, wherein Z25 in formula (IV), represents dibenzofurane, dibenzothiophene, carbazole, phenoxathiine, xanthene or thianthrene.

* * * * *